US010141696B2

(12) United States Patent
Tsai

(10) Patent No.: US 10,141,696 B2
(45) Date of Patent: Nov. 27, 2018

(54) ELECTRICAL CONNECTOR

(71) Applicant: Chou Hsien Tsai, New Taipei (TW)

(72) Inventor: Chou Hsien Tsai, New Taipei (TW)

( * ) Notice: Subject to any disclaimer, the term of this patent is extended or adjusted under 35 U.S.C. 154(b) by 0 days.

(21) Appl. No.: 15/512,611

(22) PCT Filed: Sep. 21, 2015

(86) PCT No.: PCT/CN2015/090135

§ 371 (c)(1),
(2) Date: Mar. 20, 2017

(87) PCT Pub. No.: WO2016/041528

PCT Pub. Date: Mar. 24, 2016

(65) Prior Publication Data

US 2017/0294749 A1 Oct. 12, 2017

(30) Foreign Application Priority Data

Sep. 19, 2014 (CN) ..... 2014 2 0541444 U

(51) Int. Cl.
*H01R 24/60* (2011.01)
*H01R 107/00* (2006.01)

(52) U.S. Cl.
CPC ..... *H01R 24/60* (2013.01); *H01R 2107/00* (2013.01)

(58) Field of Classification Search
CPC ..... H01R 24/60; H01R 2107/00; H01R 13/6585; H01R 13/6581; H01R 13/502; H01R 35/02; H01R 31/06; H01R 23/0256; H01R 35/00
USPC ..... 439/676, 637, 108, 607.01
See application file for complete search history.

(56) References Cited

U.S. PATENT DOCUMENTS

| | | | | |
|---|---|---|---|---|
| 7,094,086 | B2 * | 8/2006 | Teicher | H01R 27/00 439/173 |
| 8,198,563 | B2 * | 6/2012 | Tsai | H01R 23/10 218/118 |
| 9,450,341 | B2 * | 9/2016 | Kao | H01R 13/6585 |
| 9,478,918 | B1 * | 10/2016 | Yin | H01R 29/00 |
| 2013/0005193 | A1 * | 1/2013 | Tsai | H01R 13/6315 439/676 |

* cited by examiner

*Primary Examiner* — Edwin A. Leon
(74) *Attorney, Agent, or Firm* — WPAT, PC

(57) ABSTRACT

An electrical connector includes: an insulated seat provided with a base seat and a connection plate; a metal housing covering the insulated seat; one row of first terminals; and one row of second terminals. Fixing heights of fixing portions of the one row of second terminals in one row of second terminal slots are higher than fixing heights of fixing portions of the one row of first terminals in one row of first terminal slots. Extensions of the one row of second terminals are curved downwards and extend to be lower than the fixing portions. A rear end of the base seat does not have a horizontal penetrating slot providing spaces for the extensions of the second terminals and communicating with the elastic movement slot.

20 Claims, 44 Drawing Sheets

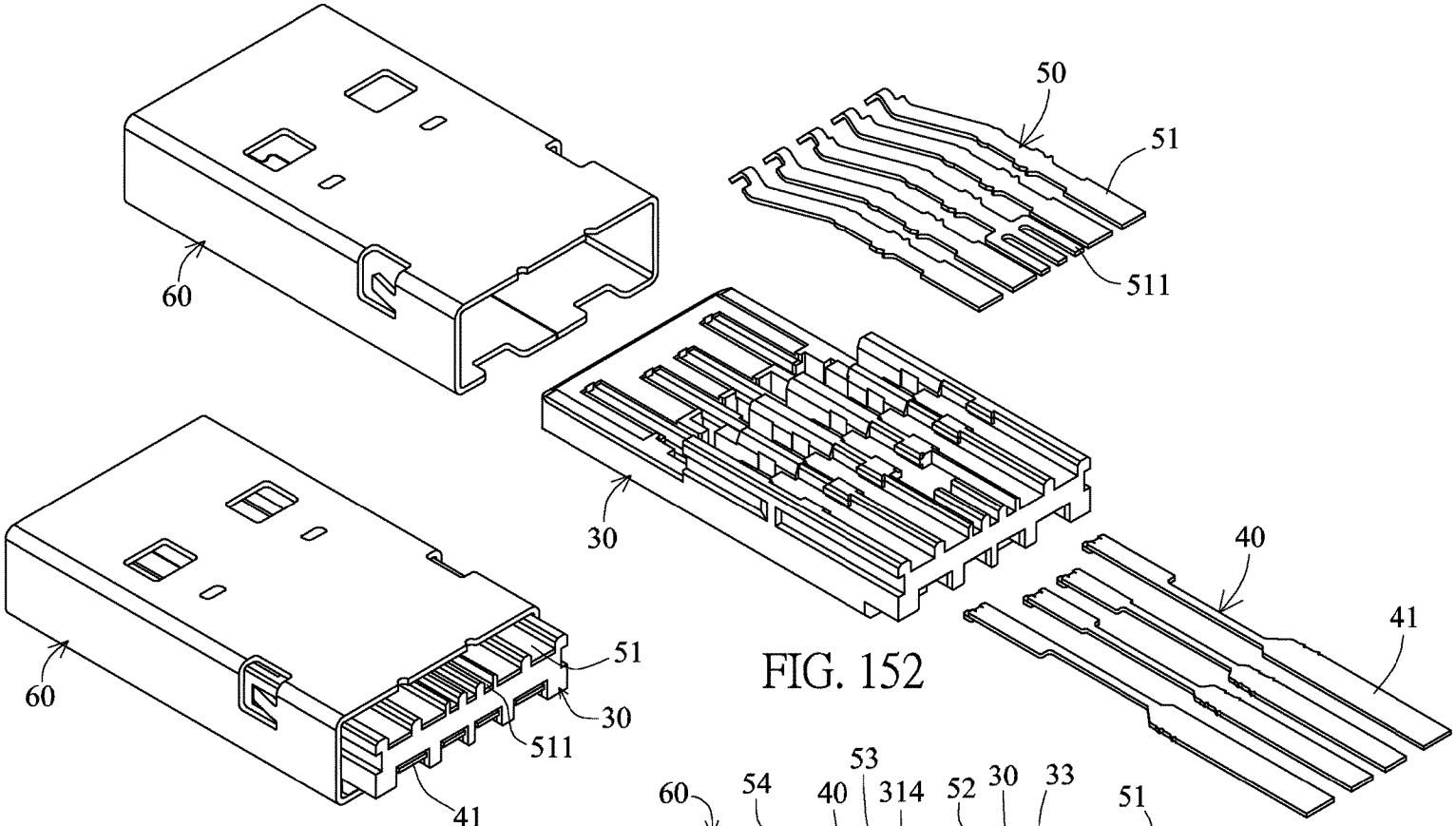
FIG. 152
FIG. 153
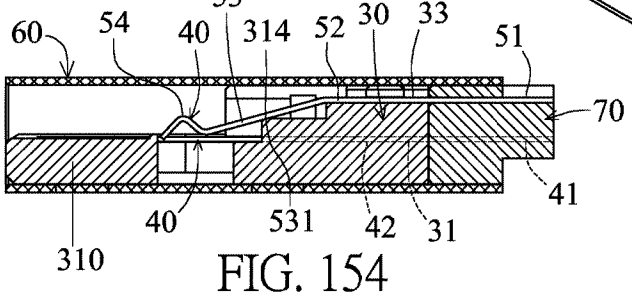
FIG. 154

ELECTRICAL CONNECTOR

BACKGROUND OF THE INVENTION

Field of the Invention

The invention relates to an electrical connector, and more particularly to an electrical connector with an elastically movable terminal having a middle section support.

Description of the Related Art

Today's most popular signal transmission specification in the computer apparatus is the universal serial bus (USB). A connector socket and a transmission cable manufactured according to this specification enable a peripheral apparatus, such as a mouse, a keyboard or the like, which is externally connected to the computer to be detected and used by the computer immediately.

At present, the USB electrical connection socket and the USB electrical connection plug have the unidirectional electrical connections. In order to ensure that the USB electrical connection plug can be electrically connected to the USB electrical connection socket when being inserted into the USB electrical connection socket, the socket and the plug have the mistake-proof designs for docking. That is, the USB electrical connection plug cannot be reversely inserted, and the user switches to the other direction to insert the plug. The correct direction allows the insertion, so that the electrical connection can be ensured after the insertion.

At present, there are two specifications including USB 2.0 and USB 3.0, as shown in FIGS. 1 and 2, a standard USB 2.0 electrical connection socket 10 specified by USB Association has an insulating seat 12 and a metal housing 13, the upper portion of the front end of the insulating seat 12 has a horizontally frontwardly projecting tongue 121. The metal housing 13 covers the insulating seat 12 and is provided with a connection slot 16 covering the tongue 121. The connection slot 16 is provided with a small space 161 and a large space 162 on top and bottom surfaces of the tongue 121, respectively. The insulating seat 12 is provided with one row of four first terminals 14. The first terminal 14 has a vertically elastically movable contact 141 projecting beyond the bottom surface of the tongue 121. In addition, the top and bottom surfaces of the metal housing 92 projecting toward the connection slot 16 are provided with two resilient snaps 131.

The connection slot 16 of the standard USB 2.0 electrical connection socket 10 has the height of 5.12 mm, the tongue 121 has the height of 1.84 mm, the large space 162 has the height of 2.56 mm, and the small space 161 has the height of 0.72 mm. That is, (the height of the large space 162)=(the height of the small space 161)+(the height of the tongue 121).

FIG. 3 shows a standard USB 2.0 electrical connection plug 20 and a standard USB 2.0 electrical connection socket 10 specified by USB Association. The standard USB 2.0 electrical connection plug 20 has an insulating seat 21, a metal housing 22 and one row of four terminals 23. The metal housing 22 covers the insulating seat 21. The connection portion of the standard electrical connection plug has a fitting slot 24 fitting with the tongue 121, and a contact interface substrate 25 fitting with the large space 162. The outside layer of the contact interface substrate 25 is the metal housing, and the inside layer of the contact interface substrate 25 is the insulating seat. The one row of four terminals 23 have contacts 231 in flat surface contact with the inner surface of the contact interface substrate 25 and facing the fitting slot 24.

The connection portion of the standard USB 2.0 electrical connection plug 20, specified by USB Association, has the height of 4.5 mm, the fitting slot 24 has the height of 1.95 mm, the metal housing has the thickness of 0.3 mm, and the contact interface substrate 25 has the height of 2.25 mm.

As shown in FIG. 3, the contact interface substrate 25 of the standard USB 2.0 electrical connection plug 20 needs to be aligned with the large space 162 so that it can be inserted into the connection slot 16 of the biased USB 2.0 electrical connection socket 10. The opposite insertion will fail because the contact interface substrate 25 having the height of 2.25 mm cannot be fit into the small space 161 having the height of 0.72 mm So, the inconvenient use is caused However, in order to facilitate the convenient use, the bidirectional electrical connection can satisfy the requirement. So, the applicant previously developed an electrical connection socket, which has the duplex electrical connection function, and into which the biased USB 2.0 electrical connection plug can be bidirectionally inserted for electrical connection, and then planed to develop a duplex electrical connection plug, which has the design adopting two contact interface substrates 25, each having the height of 2.25 mm shown in FIG. 3, in conjunction with the fitting slot 24 having the height of 1.95 m. However, this type of duplex electrical connection plug only can be electrically connected to the electrical connection socket having the duplex electrical connection function to achieve the doubled transmission speed. In addition, the two contact interface substrates of this type of duplex electrical connection plug cannot be fit for connection with the small space of the eccentric USB 2.0 electrical connection socket. The above-mentioned duplex electrical connection socket, developed by the applicant, needs to be bidirectional inserted by the biased USB 2.0 electrical connection plug for electrical connection. So, the overall height is higher than the biased USB 2.0 electrical connection socket and is not advantageous to the slim and light electronic product. In addition, the further developed duplex electrical connection plug cannot work in conjunction with and cannot be bidirectionally inserted and connected to the biased USB 2.0 electrical connection socket, is significantly larger than the biased USB 2.0 electrical connection plug, and cannot satisfy the actual requirement.

The applicant has continuously paid efforts to the research and development, and thus finally developed the invention, which is slim and light and can satisfy the bidirectional electrical connection to the eccentric electrical connection socket specified by USB Association.

SUMMARY OF THE INVENTION

A main object of the invention is to provide an electrical connector, wherein its insulated seat is provided with a resting portion, an extension of an inner end of a contact of each of the at least one row of terminals is provided with a fulcrum resiliently resting against the resting portion, the extension disposed on an outer end of the fulcrum does not rest against the resting portion so that the elastically movable arm of force of the extension has a middle section fulcrum structure, when the contact is pressed to move toward the connection surface elastically, the extension of the inner end of the fulcrum elastically moves reversely, and the action of the fulcrum makes the contact have the larger normal force.

Another main object of the invention is to provide an electrical connector, wherein extensions of one row of second terminals of the electrical connector are curved downwards and extend to be lower than fixing portion, the one row of second terminal slots do not provide, from the rear end of the base seat, horizontal penetrating slots communicating with the elastic movement slot and for providing spaces for the extension of the second terminal, so that the structure of the seat is strengthened.

Still another main object of the invention is to provide an electrical connector, wherein at least two grounding elastic sheets of the connector are the two rows of terminals are formed by pressing two metal sheets, respectively, to simplify the manufacturing processes.

To achieve the above-identified objects, the invention provides an electrical connector, comprising: an insulated seat provided with a base seat and at least one connection plate, which projects beyond a front end of the base seat; a metal housing covering the insulated seat, wherein top and bottom surfaces of the base seat and one surface of the at least one connection plate rest against the metal housing, a fitting slot is formed within the metal housing, the other surface of the connection plate is a connection surface, the connection plate is provided with an elastic movement slot depressed from the connection surface, and the connection surface faces the fitting slot; and at least one row of terminals, wherein the terminal is provided with a pin, a fixing portion and an extension, the fixing portion is fixed to the insulated seat, the extension is connected to a front end of the fixing portion, vertically elastically movable in the elastic movement slot and provided with a contact projecting beyond the connection surface of the connection plate, and the pin is connected to a rear end of the fixing portion and extends out of the insulated seat; characterized in that the insulated seat is provided with a resting portion, the extension disposed on an inner end of each of the contacts of the at least one row of terminals is provided with a fulcrum resting against the resting portion, the extension disposed on an outer end of the fulcrum does not rest against the resting portion, so that an elastically movable arm of force of the extension has a middle section fulcrum structure, when the contact is pressed to move toward the connection surface elastically, the extension reversely disposed on an inner end of the fulcrum moves elastically, and an action of the fulcrum makes the contact have a larger normal force.

The invention further provides an electrical connector, comprising: an insulated seat provided with a connection portion, wherein the connection portion is provided with at least one connection surface and an elastic movement slot depressed from the connection surface; and at least two rows of terminals, wherein the terminal is provided with a pin, a fixing portion and an extension, the fixing portion is fixed to the insulated seat, the extension is connected to one end of the fixing portion and provided with a contact disposed on the connection surface of the connection portion, and the pin is connected to the other end of the fixing portion and extends out of the insulated seat; characterized in that the insulated seat comprises at least two seats assembled together, each of the at least two seats fixes the at least one row of terminals, and the insulated seat is provided with a resting portion, wherein the extensions of the at least one row of terminals of the at least one seat are vertically elastically movable in the elastic movement slot the extension disposed on an inner end of the contact is provided with a fulcrum resting against the resting portion, the extension disposed on an outer end of the fulcrum does not rest against the resting portion, so that an elastically movable arm of force of the extension has a middle section fulcrum structure, and when the contact is pressed to move toward the connection surface elastically, the extension disposed on an inner end of the fulcrum elastically moves reversely to make the contact have a larger normal force through an action of the fulcrum.

The invention further provides an electrical connector comprising: an insulated seat provided with a base seat and a connection plate, wherein the connection plate projects beyond a front end of the base seat, a top surface of the connection plate is a connection surface, the connection surface is lower than a top surface of the base seat, the insulated seat is provided with one row of first terminal slots and one row of second terminal slots, and the second terminal slot is provided, on the connection plate, with an elastic movement slot depressed from the connection surface; a metal housing covering the insulated seat, wherein top and bottom surfaces of the base seat and a bottom surface of the connection plate rest against the metal housing, a fitting slot is formed within the metal housing, and the connection surface of the connection plate faces the fitting slot; one row of first terminals assembled in the first terminal slot, wherein the first terminal is provided with a pin, a fixing portion and an extension, the fixing portion is fixed to the first terminal slot, the extension is connected to a front end of the fixing portion and provided with a contact disposed on the connection surface of the connection plate, and the pin is connected to a rear end of the fixing portion and extends out of the insulated seat; and one row of second terminals assembled in the second terminal slot, wherein the second terminal is provided with a pin, a fixing portion and an extension, the fixing portion is fixed to the second terminal slot, the extension is connected to a front end of the fixing portion, vertically elastically movable in the elastic movement slot and provided with a contact projecting beyond the connection surface of the connection plate, and the pin is connected to a rear end of the fixing portion and extends out of the insulated seat; characterized in that fixing heights of the fixing portions of the one row of second terminals in the one row of second terminal slots are higher than fixing heights of the fixing portions of the one row of first terminals in the one row of first terminal slots, the extensions of the one row of second terminals are curved downwards and extend to be lower than the fixing portions, and the one row of second terminal slots do not have, from a rear end of the base seat, a horizontal penetrating slot providing spaces for the extensions of the second terminals and communicating with the elastic movement slot, so that the one row of second terminals cannot be horizontally and frontwardly assembled into the one row of second terminal slots from the rear end of the base seat.

The invention further provides an electrical connector, comprising: an insulated seat provided with a base seat and two connection plates, wherein a vertical gap is formed between the two connection plates projecting beyond a front end of the base seat; a metal housing covering the insulated seat, wherein top and bottom surfaces of the base seat and first surfaces of the two connection plates rest against the metal housing, second surfaces of the two connection plates are connection surfaces, the two connection plates are provided with two elastic movement slots depressed from the connection surfaces, a fitting slot is formed between the two connection surfaces, and the metal housing and the fitting slot can dock with an electrical connector in a dual-position bidirectional manner; and two rows of terminals, wherein the terminal is provided with a pin, a fixing portion and an extension, the fixing portion is fixed to the insulated seat, the extension connected to the front end of the fixing portion is vertically elastically movable in the elastic movement slot and provided with a contact projecting beyond the connection surface of the connection plate, the pin is connected to a rear end of the fixing portion and extends out of the insulated seat, and the contacts of the two rows of terminals projects beyond the connection surfaces of the two connection plates, respectively; and at least two grounding elastic sheets, wherein the grounding elastic sheet is provided with an extension, the extension is vertically elastically movable in an opening hole of the connection plate, the extensions of the at least two grounding elastic sheets are provided with two fulcrums projecting beyond the two connection plates, respectively and resting against the metal housing and are provided with two contacts projecting beyond the connection surfaces of the two connection plates, respectively; characterized in that the at least two grounding elastic sheets and the two rows of terminals are made by pressing two metal sheets, respectively.

With the above-mentioned structure, the invention has the following advantages.

1. Its insulated seat is provided with a resting portion, an extension of an inner end of a contact of each of the at least one row of terminals is provided with a fulcrum resiliently resting against the resting portion, the extension disposed on an outer end of the fulcrum does not rest against the resting portion so that the elastically movable arm of force of the extension has a middle section fulcrum structure, when the contact is pressed to move toward the connection surface elastically, the extension of the inner end of the fulcrum elastically moves reversely, and the action of the fulcrum makes the contact have the larger normal force 2. Extensions of one row of second terminals of the electrical connector are curved downwards and extend to be lower than fixing portion, the one row of second terminal slots do not provide, from the rear end of the base seat, horizontal penetrating slots communicating with the elastic movement slot and for providing spaces for the extension of the second terminal, so that the structure of the seat is strengthened.

3. At least two grounding elastic sheets of the connector are the two rows of terminals are formed by pressing two metal sheets, respectively, to simplify the manufacturing processes. The above-mentioned and other objects, advantages and features of the invention will become more fully understood from the detailed description of the preferred embodiments given hereinbelow and the accompanying drawings.

BRIEF DESCRIPTION OF THE DRAWINGS

FIG. 117 is a side cross-sectional view showing a used state according to the 46th embodiment of the invention.

FIG. 118 is a side cross-sectional view according to the 47th embodiment of the invention.

FIG. 119 is a side cross-sectional view according to the 48th embodiment of the invention.

FIG. 119A is a side cross-sectional view according to the 49th embodiment of the invention.

FIG. 120 is a pictorially exploded view according to the 50th embodiment of the invention.

FIG. 121 is a side cross-sectional view according to the 50th embodiment of the invention.

FIG. 122 is a side cross-sectional view according to the 51st embodiment of the invention.

FIG. 123 is a front cross-sectional view according to the 51st embodiment of the invention.

FIG. 124 is a side view showing a first terminal according to the 51st embodiment of the invention.

FIG. 125 is a side cross-sectional view according to the 52nd embodiment of the invention.

FIG. 126 is a front cross-sectional view according to the 52nd embodiment of the invention.

FIG. 127 is a side cross-sectional view according to the 53rd embodiment of the invention.

Figure 128:
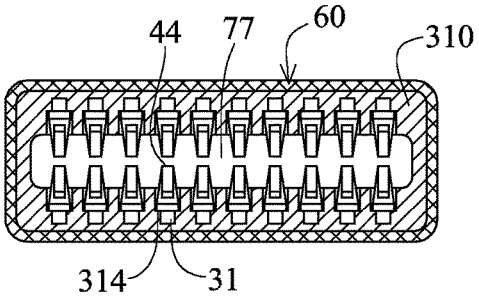

FIG. 128 is a front cross-sectional view according to the 53rd embodiment of the invention.

Figure 129:
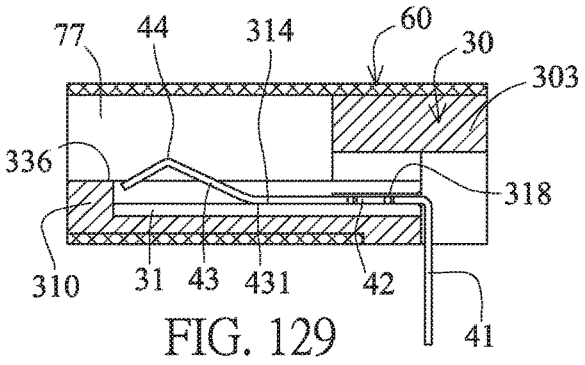

FIG. 129 is a side cross-sectional view according to the 54th embodiment of the invention.

Figure 130:
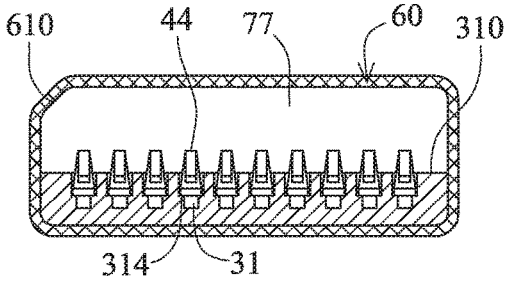

FIG. 130 is a front cross-sectional view according to the 54th embodiment of the invention.

Figure 131:
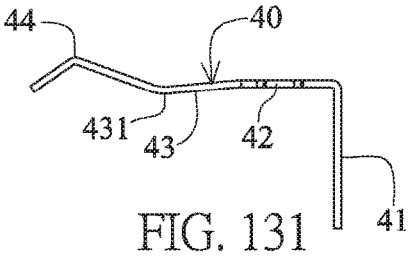

FIG. 131 is a side view showing a first terminal according to the 54th embodiment of the invention.

Figure 132:
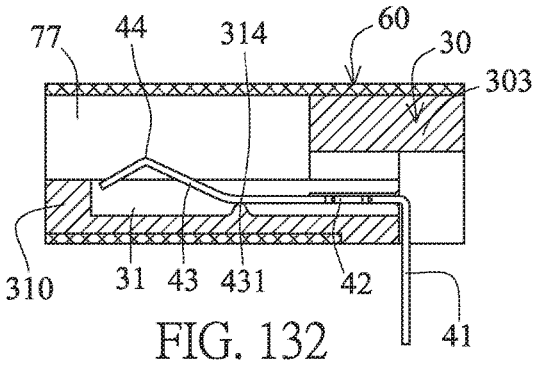

FIG. 132 is a side cross-sectional view according to the 55th embodiment of the invention.

Figure 133:
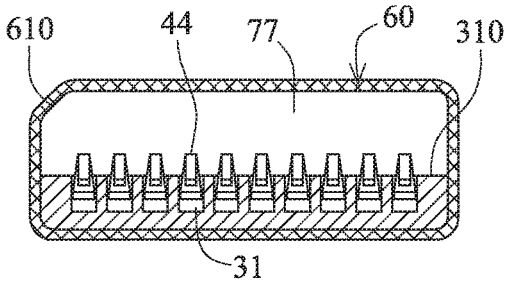

FIG. 133 is a front cross-sectional view according to the 55th embodiment of the invention.

Figure 134:
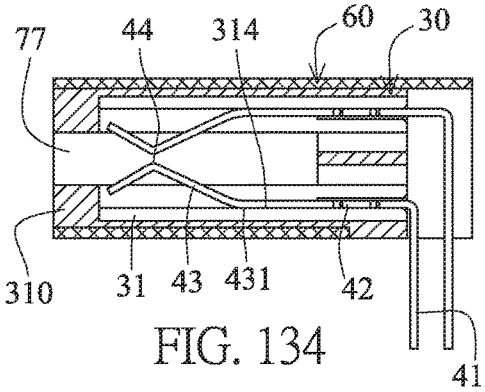

FIG. 134 is a side cross-sectional view according to the 56th embodiment of the invention.

Figure 135:
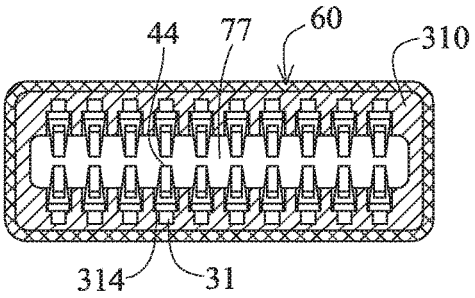

FIG. 135 is a front cross-sectional view according to the 56th embodiment of the invention.

Figure 136A:
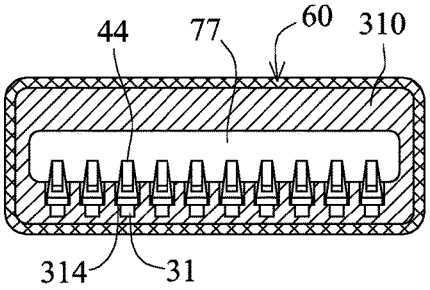
Figure 136:
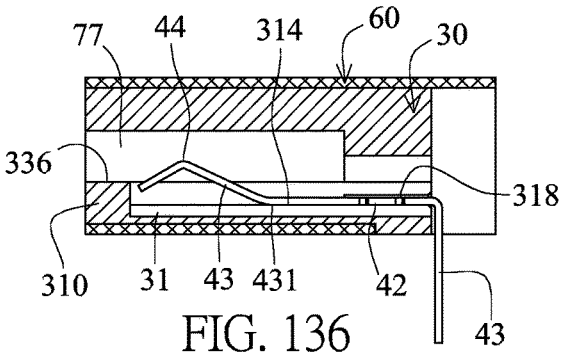

FIG. 136 is a side cross-sectional view according to the 57th embodiment of the invention.

FIG. 136A is a front cross-sectional view according to the 57th embodiment of the invention.

Figure 137:
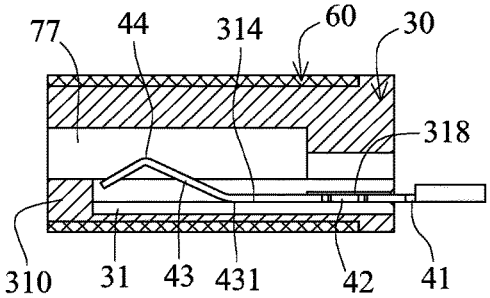

FIG. 137 is a side cross-sectional view according to the 58th embodiment of the invention.

Figure 138:
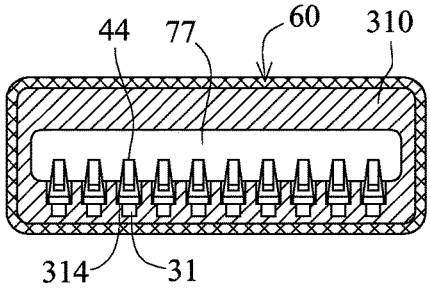

FIG. 138 is a front cross-sectional view according to the 58th embodiment of the invention.

Figure 139:
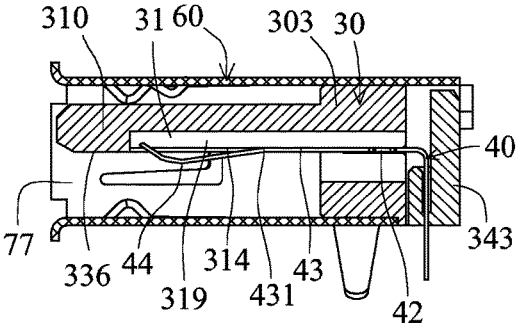

FIG. 139 is a side cross-sectional view according to the 59th embodiment of the invention.

Figure 140:
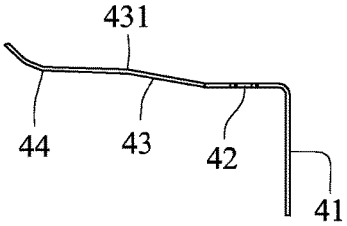

FIG. 140 is a side view showing a first terminal according to the 59th embodiment of the invention.

Figure 141:
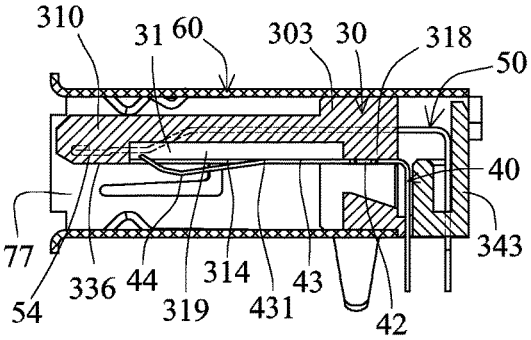

FIG. 141 is a side cross-sectional view according to the 60th embodiment of the invention.

Figure 142:
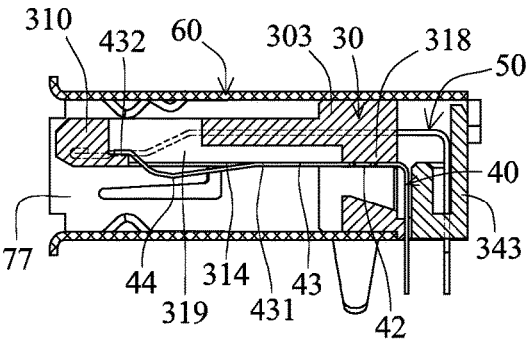

FIG. 142 is a side cross-sectional view according to the 61st embodiment of the invention.

Figure 143:
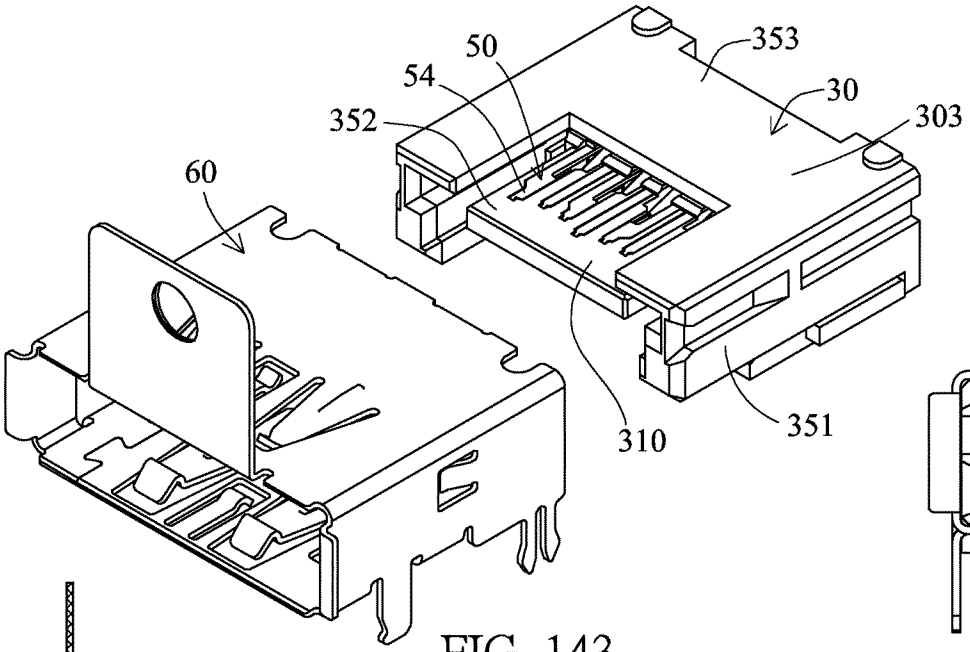

FIG. 143 is a pictorially exploded view according to the 62nd embodiment of the invention.

Figure 144:
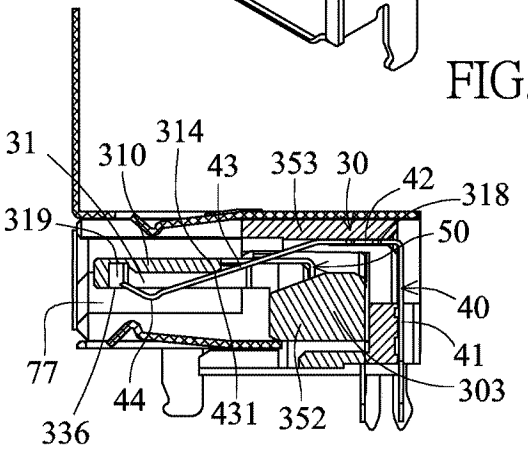

FIG. 144 is a side cross-sectional view according to the 62nd embodiment of the invention.

Figure 145:
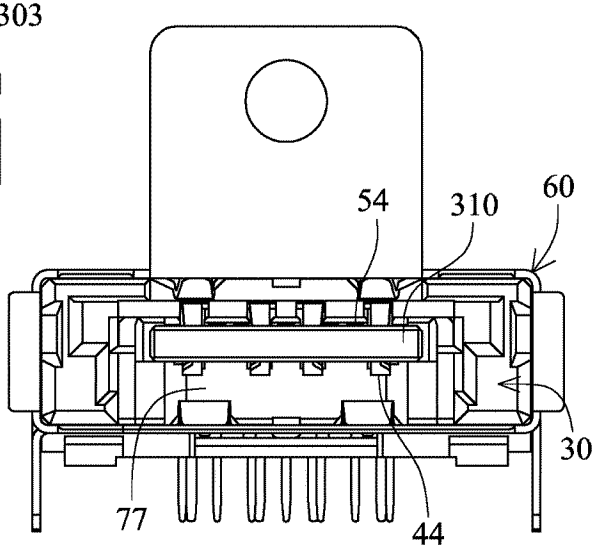

FIG. 145 is a front view according to the 62nd embodiment of the invention.

Figure 146:
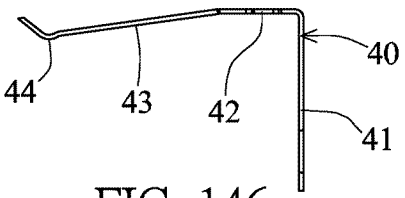

FIG. 146 is a side view showing a first terminal according to the 62nd embodiment of the invention.

Figure 147:
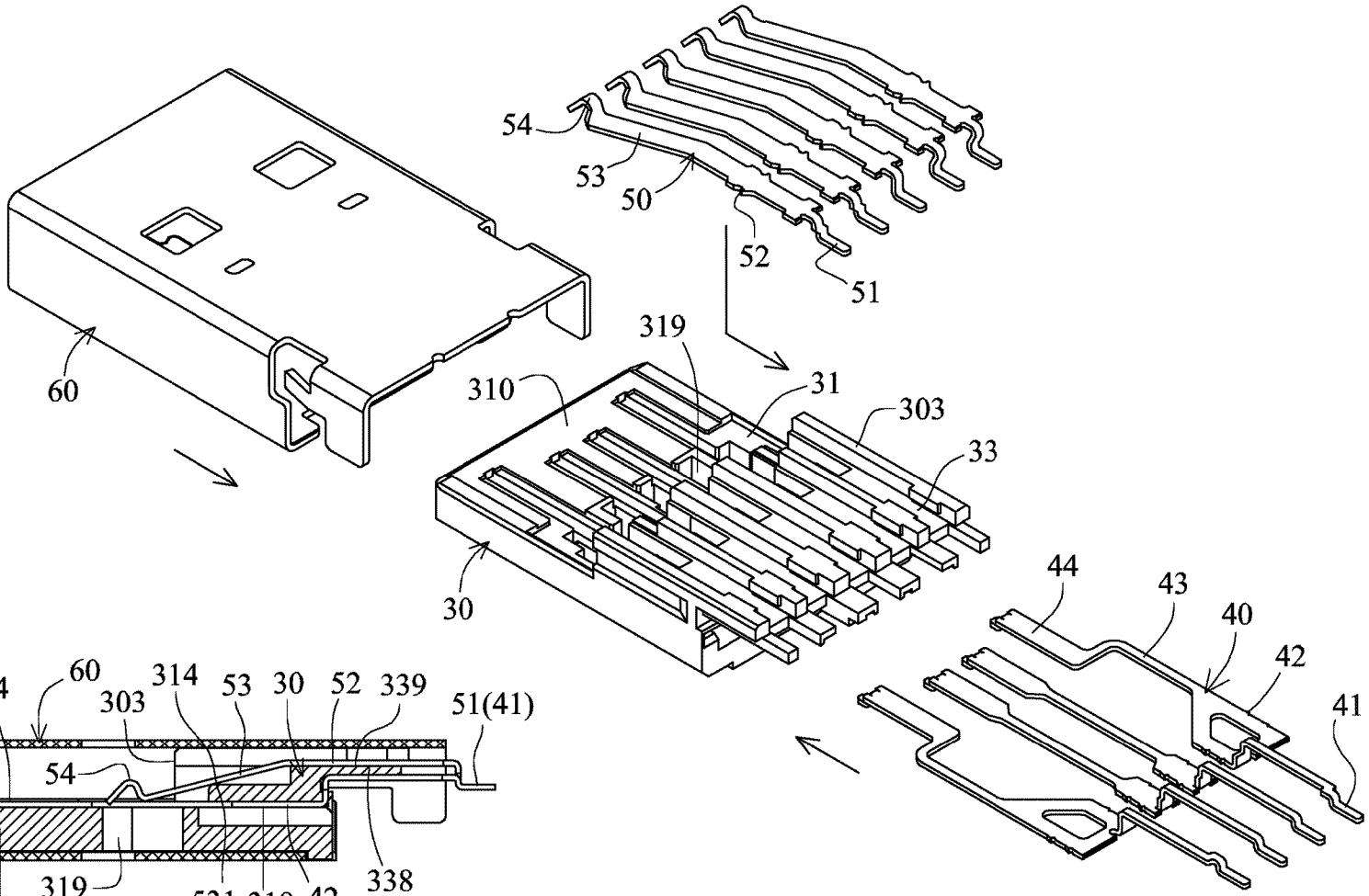

FIG. 147 is a pictorially exploded view according to the 63rd embodiment of the invention.

Figure 148:
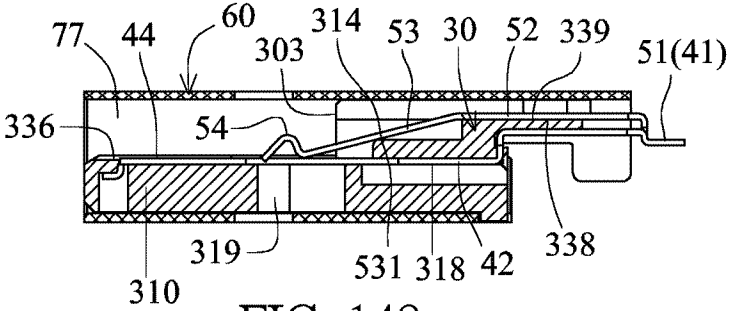

FIG. 148 is a side cross-sectional view according to the 63rd embodiment of the invention.

Figure 149:
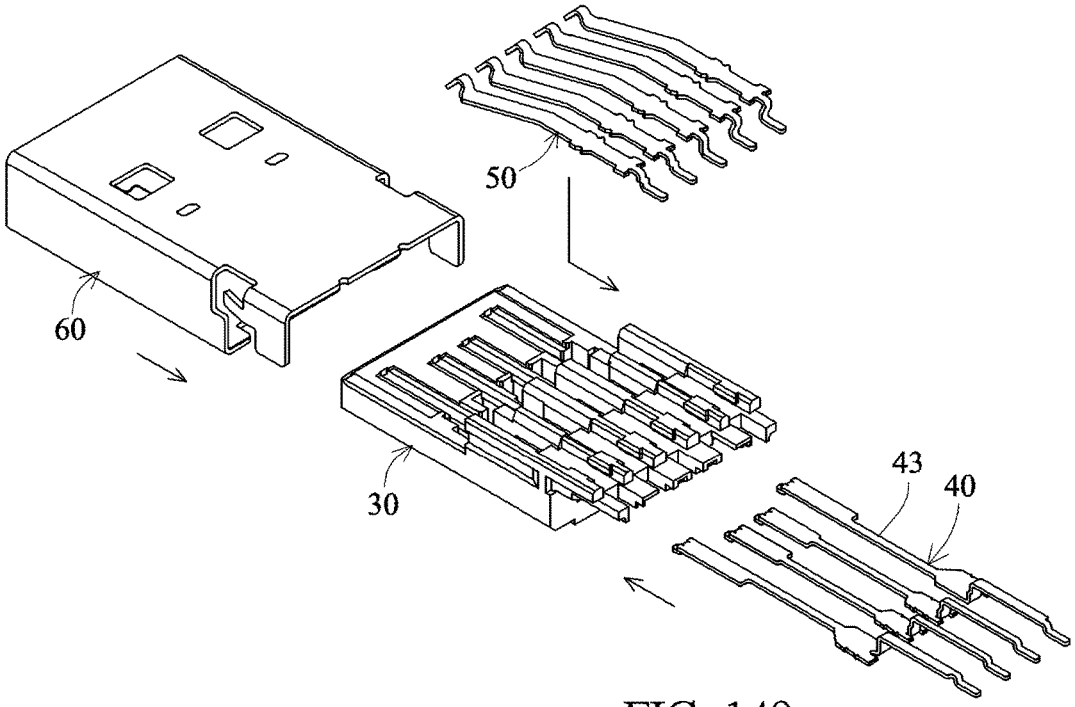

FIG. 149 is a pictorially exploded view according to the 64th embodiment of the invention.

Figure 150:
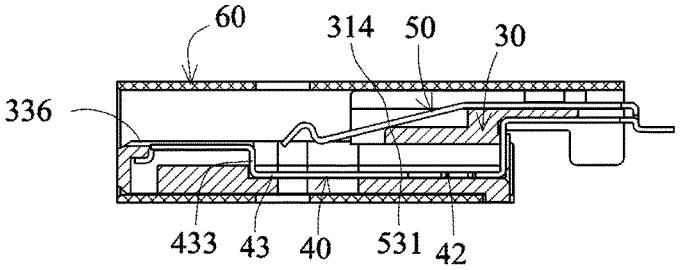

FIG. 150 is a side cross-sectional view according to the 65th embodiment of the invention.

Figure 151:
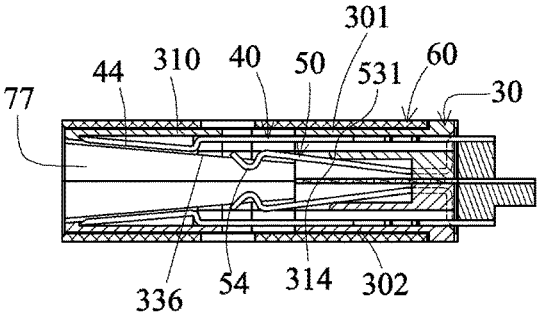

FIG. 151 is a side cross-sectional view according to the 66th embodiment of the invention.

FIG. 152 is a pictorially exploded view according to the 67th embodiment of the invention.

FIG. 153 is a pictorially assembled view according to the 67th embodiment of the invention.

FIG. 154 is a side cross-sectional view according to the 67th embodiment of the invention.

Figure 155:
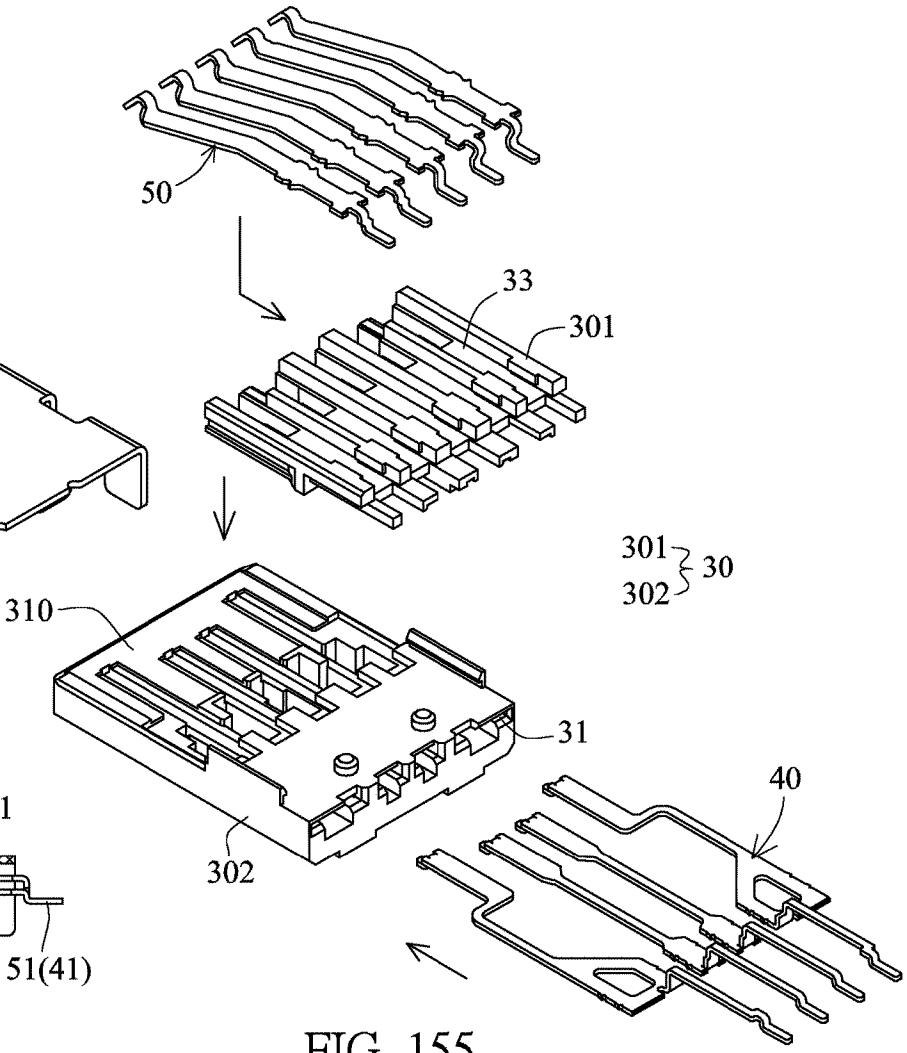

FIG. 155 is a pictorially exploded view according to the 68th embodiment of the invention.

Figure 156:
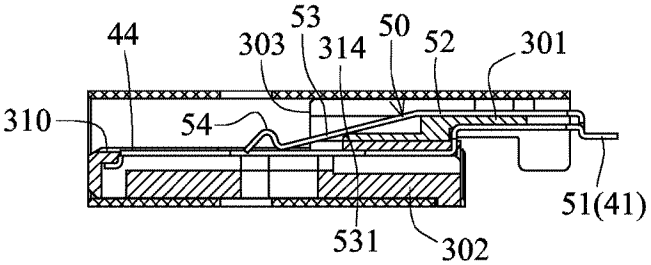

FIG. 156 is a side cross-sectional view according to the 68th embodiment of the invention.

Figure 157:
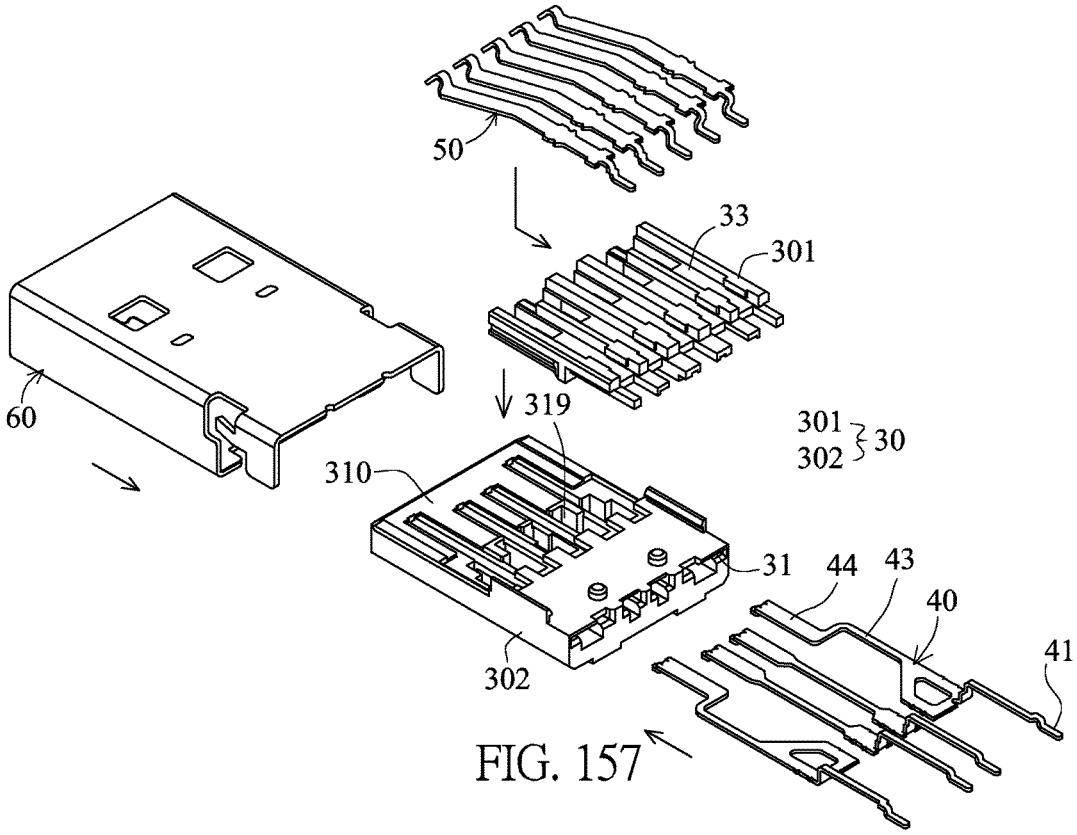

FIG. 157 is a pictorially exploded view according to the 69th embodiment of the invention.

Figure 158:
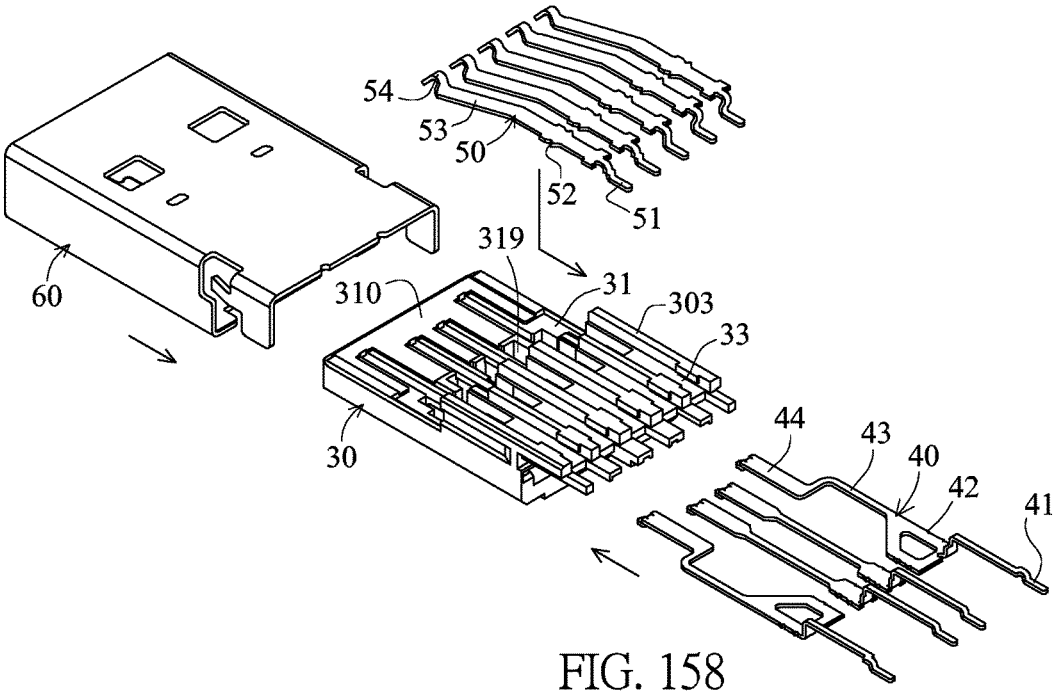

FIG. 158 is a pictorially exploded view according to the 70th embodiment of the invention.

Figure 159:
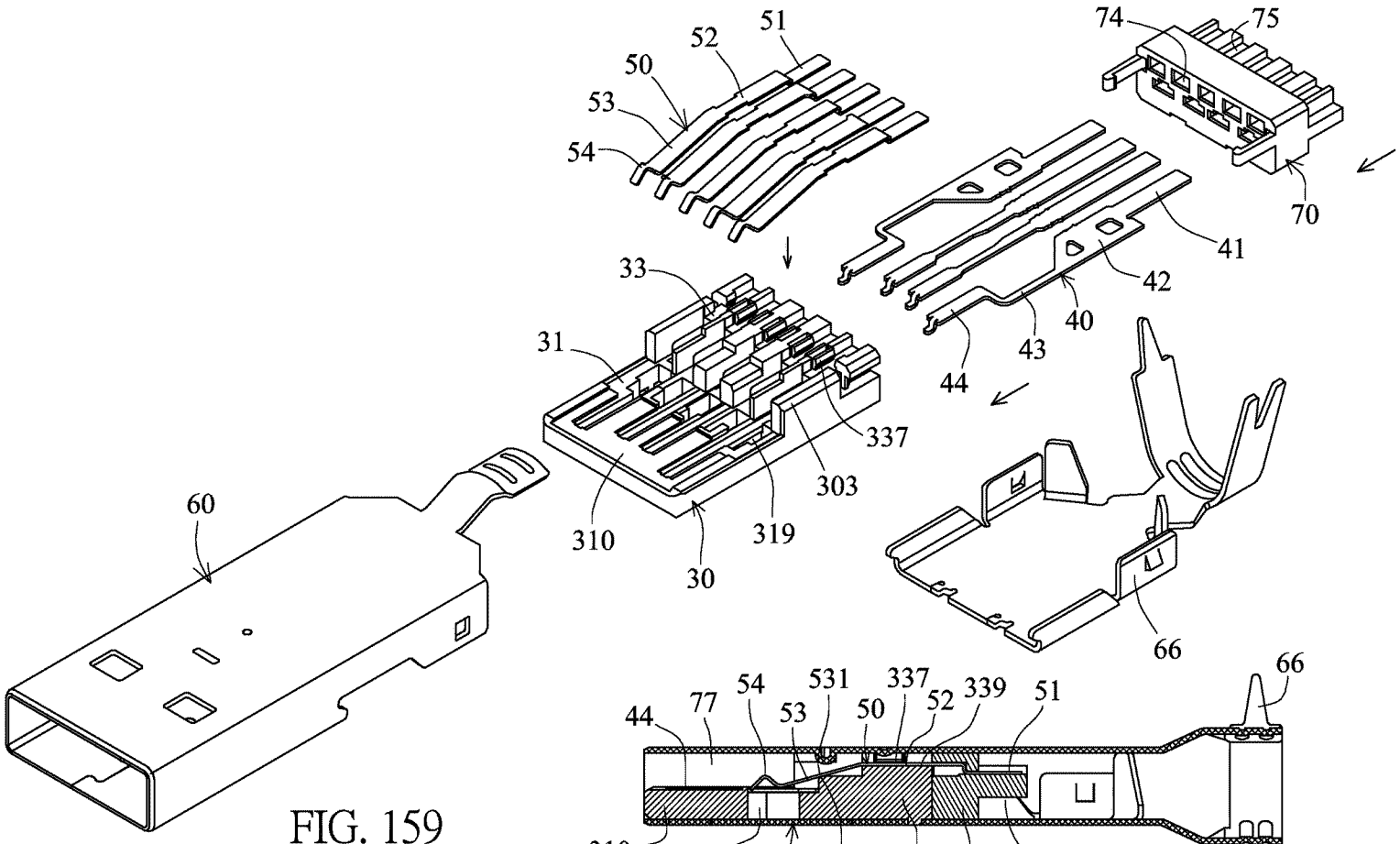

FIG. 159 is a pictorially exploded view according to the 71st embodiment of the invention.

Figure 160:
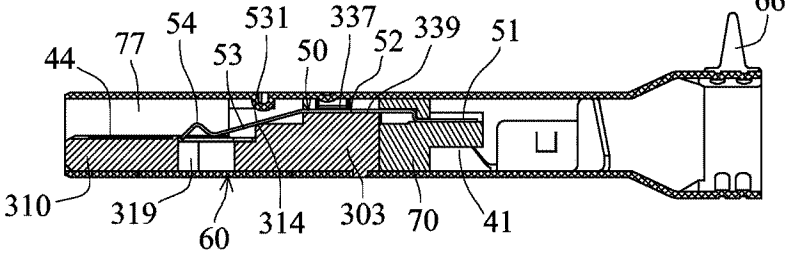

FIG. 160 is a side cross-sectional view according to the 71st embodiment of the invention.

Figures 161, 162:
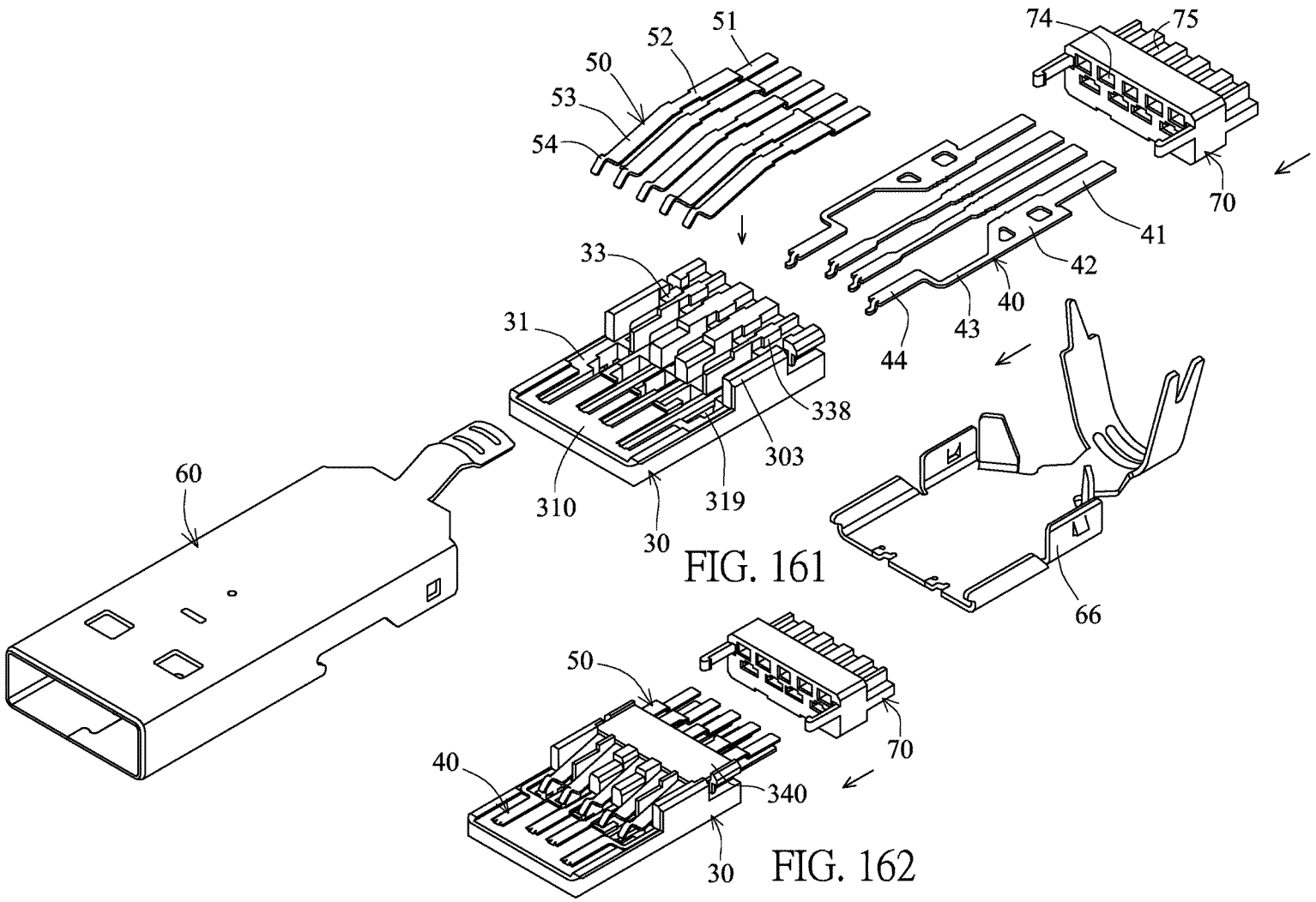

FIG. 161 is a pictorially exploded view according to the 72nd embodiment of the invention.

FIG. 162 is a pictorially exploded view showing the hot melting according to the 72nd embodiment of the invention.

Figure 163:
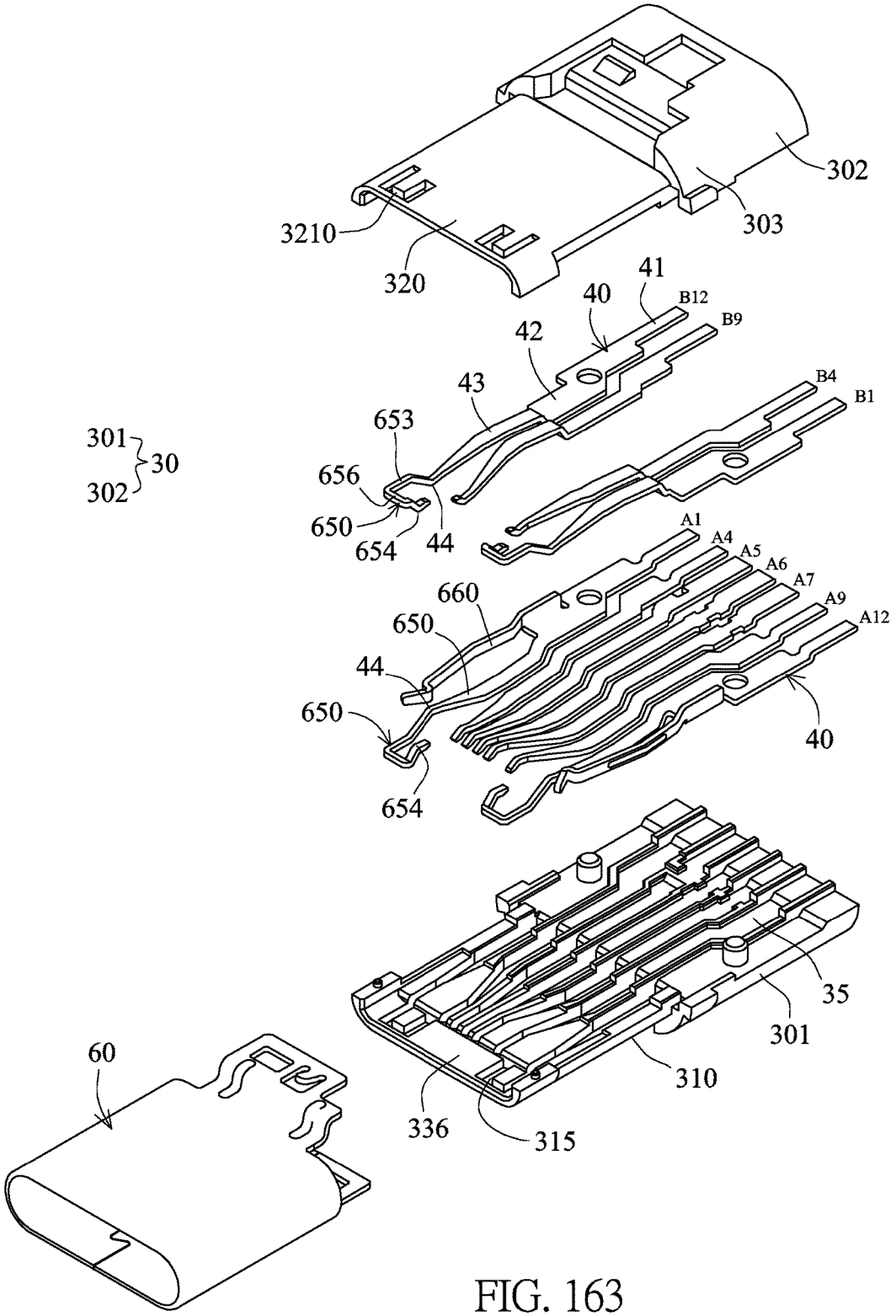

FIG. 163 is a pictorially exploded view according to the 73rd embodiment of the invention.

DETAILED DESCRIPTION OF THE INVENTION

Figure 4:
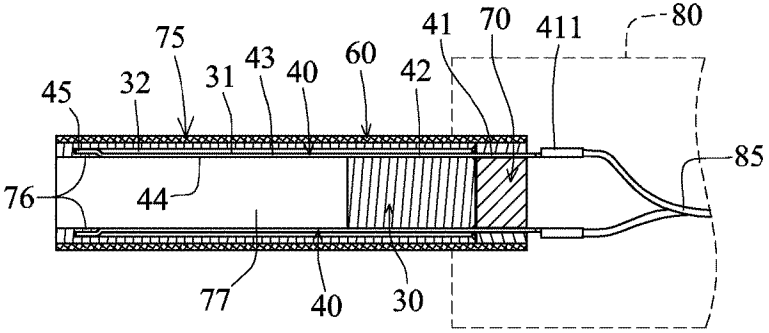
FIG. 4 shows a side cross-sectional view according to a first embodiment of the invention.
Figure 6:
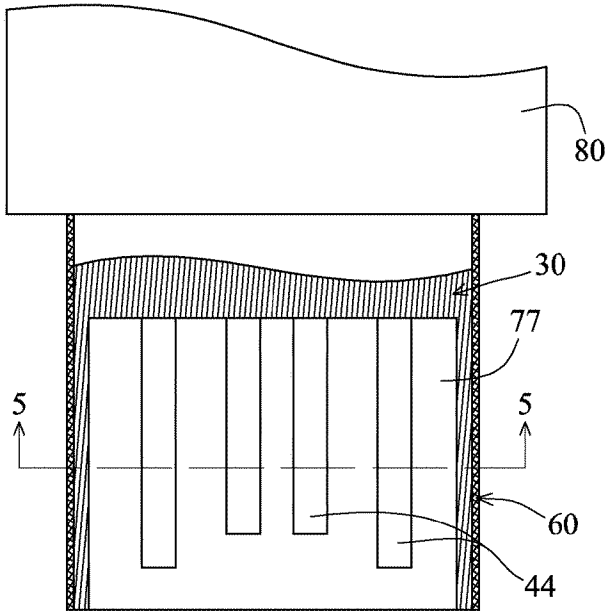
FIG. 6 shows a top cross-sectional view according to the first embodiment of the invention.
Figure 5:
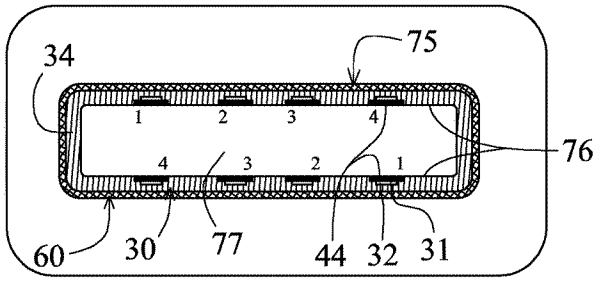
FIG. 5 shows a front cross-sectional view according to the first embodiment of the invention.

Referring to FIGS. 4 to 6, the first embodiment of the invention provides a bidirectional duplex USB 2.0 electrical connection plug comprising an insulating seat 30, two rows of first terminals 40, a metal housing 60, a fitting portion 75, a positioning structure and a rear plug 70.

The insulating seat 30 is plastically injection molded and has a front section provided with a fitting slot 77. The insulating seat 30 forms top, bottom, left and right sides of the fitting slot 77. The cross-section of the front section of the insulating seat 30 is a hollow rectangular frame structure. The insertion port of the fitting slot 77 faces frontwards. The insulating seat 30 has two rows of first terminal slots 31, wherein a middle of the first terminal slot 31 has a concave portion 32.

The metal housing 60 covers the insulating seat 30. The front-view shape of the metal housing 60 is rectangular, top-bottom symmetrical and left-right symmetrical.

The fitting portion 75 is disposed at the front end of the insulating seat 30. The fitting portion 75 has two opposite contact interface substrates 76 and a fitting slot 77. The two contact interface substrates 76 each having an insulating layer are separated by the fitting slot 77. The inside layers of the two contact interface substrates 76 are integrally formed jointly with the insulating seat 30, and the outside layers of the two contact interface substrates 76 pertain to the metal housing 60. The fitting slot 77 is the same as the fitting slot 77 of the insulating seat 30. The insulating layers of the inside layers of the two contact interface substrates 76 are the top and bottom surfaces of the fitting slot 77. Each of the two contact interface substrates 76 has a USB 2.0 contact interface to be electrically connected to the biased USB 2.0 electrical connection socket. The two USB 2.0 contact interfaces are formed by the two rows of first terminals 40. The two USB 2.0 contact interfaces are electrically connected to the rear end of the insulating seat 30, and the two USB 2.0 contact interfaces have the same contact interface and the connection points with the circuit serial numbers arranged reversely. The fitting portion 75 has the rectangular external shape in a top-bottom symmetrical and left-right symmetrical manner. The fitting portion can be bidirectionally inserted into the connection slot of the biased USB 2.0 electrical connection socket. The two contact interface substrates 76 can be fit into the small space.

The positioning structure is integrally formed jointly with two sidewalls 34 of front sections of the insulating seat 30. The two sidewalls 34 are integrally connected to two sides of the insulating layers of the two contact interface substrates 76 to position the insulating layers of the two contact interface substrates 76. The insulating layers of the inside layers of the two contact interface substrates 76 are the top and bottom surfaces of the fitting slot 77. The two sidewalls 34 are the left and right sides of the fitting slot 77.

The two rows of first terminals 40 each having four first terminals are assembled and fixed to the two rows of first terminal slots 31 of the insulating seat 30, the first terminal 40 sequentially has, from one end to the other end, a pin 41, a fixing portion 42 and an extension 43. The fixing portion 42 is fixed to the first terminal slot 31. The extension 43 is connected to the front end of the fixing portion 42, extends to the contact interface substrate 76 and has a contact 44. The contact 44 is not elastically movable and is flush with the inner surface of the contact interface substrate 76. The front end of the extension 43 has an engagement (locking) portion 45 engaged into the engagement hole formed at the front end of the concave portion 32. The pin 41, which is connected to the other end of the fixing portion 42 and extends out of out of the rear end of the insulating seat 30, has a distal section provided with a wiring portion 411. The contacts 44 of the two rows of first terminals 40 respectively form the USB 2.0 contact interfaces of the two contact interface substrates 76. The two USB 2.0 contact interfaces have the same contact interface and have the connection points with the circuit serial numbers arranged reversely, as shown in FIG. 5. The upper USB 2.0 contact interface has the connection points with the circuit serial numbers of 1, 2, 3, 4 from left to right, and the lower USB 2.0 contact interface has the connection points with the circuit serial numbers of 4, 3, 2, 1 from left to right.

The rear plug 70 is tightly fit within the rear section of the metal housing and at the rear end of the insulating seat. The rear plug 70 is a three-piece combination so that the pins 41 of the two rows of first terminals 40 can pass through and closely fit with the rear plug 70. The rear plug 70 mainly plugs the voids communicating the two rows of first terminal slots 31 with the rear end of the insulating seat 30.

This embodiment functions as a connector of a connection cable. An insulating housing 80 covering the rear section of the metal housing 60 is formed by way of glue pouring. The provision of the rear plug 70 can prevent the glue liquid from flowing into the first terminal slot 31 in the glue pouring process. Regarding the wiring portions 411 of the pins of the two rows of first terminals 40, the connection points with the same circuit serial number are connected to the same wire 85.

Figure 1:
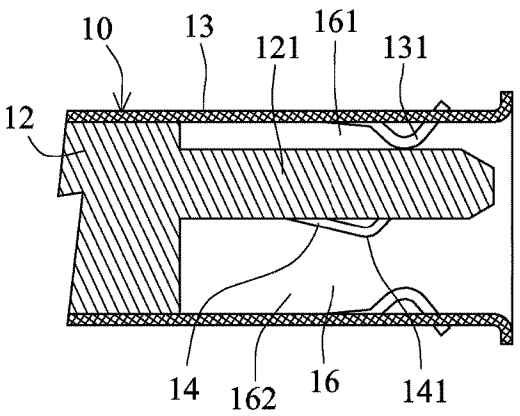
FIG. 1 (Prior Art)
FIG. 1 is a side cross-sectional view showing a conventional biased USB 2.0 electrical connection socket specified by USB Association.
Figure 2:
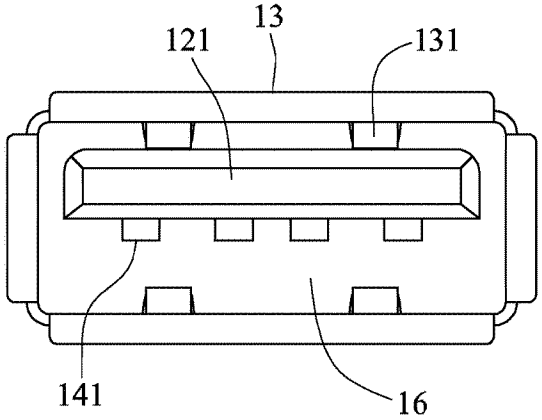
FIG. 2 (Prior Art)
FIG. 2 is a front view showing the conventional biased USB 2.0 electrical connection socket specified by USB Association.
Figure 3:
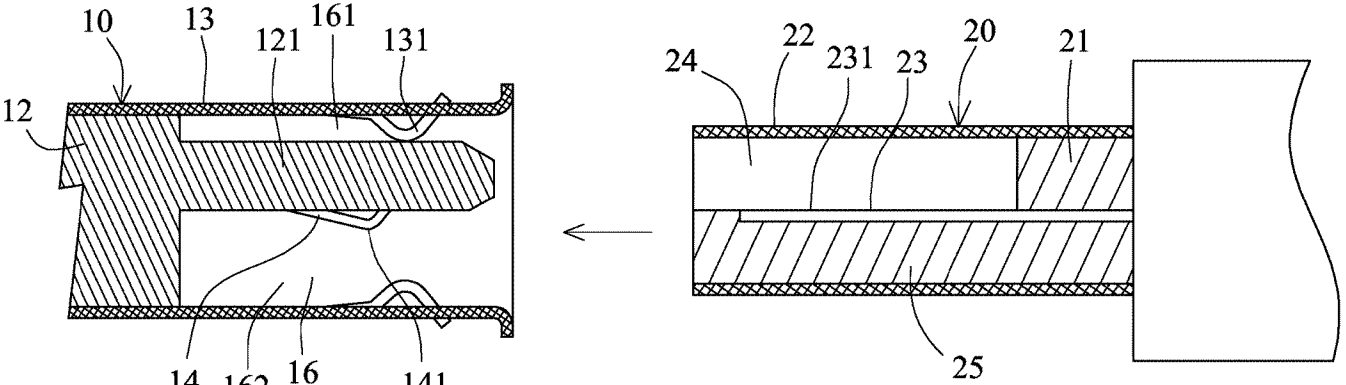
FIG. 3 (Prior Art)
FIG. 3 is a side cross-sectional view showing a conventional standard USB 2.0 electrical connection socket and a conventional biased USB 2.0 electrical connection plug specified by USB Association.
Figure 7:
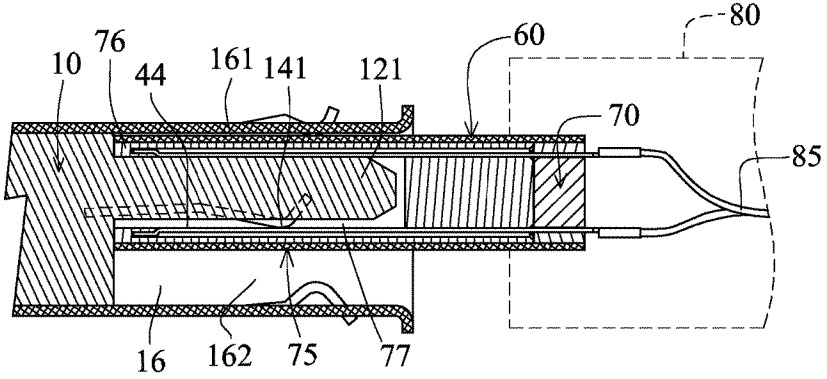
FIG. 7 is a side cross-sectional view showing a used state according to the first embodiment of the invention.

Referring to FIG. 7, with the above-mentioned structure, the heights of the two contact interface substrates 76 of the fitting portion 75 can be fit into the small space 161 of the connection slot 16 of the biased USB 2.0 electrical connection socket 10. So, the fitting portion 75 can be bidirectionally inserted into the connection slot 16 of the biased USB 2.0 electrical connection socket 10, and the USB 2.0 contact interface (contacts 44) of one of the two contact interface substrates 76 is electrically connected to the USB 2.0 contact interface (contacts 141) below the tongue 121 of the biased USB 2.0 electrical connection socket 10.

The two contact interface substrates 76 of the fitting portion 75 of this embodiment have the same height of about 0.65 mm, and the fitting slot 77 is about 1.95 mm, so the height of the fitting portion 75 is about 3.25 mm, which is significantly lower than the height (4.5 mm) of the connection portion of the biased USB 2.0 electrical connection plug 20, and higher than the large space 162 (2.65 mm) of the connection slot 16 of the biased USB 2.0 electrical connection socket 10. Thus, the fitting portion 75 cannot be incorrectly inserted into the large space 162 when being used. Upon designing, however, the height of the contact interface substrate 76 may range between 0.5 mm and 0.85 mm, and the height of the fitting portion 75 may range between 3 mm and 4 mm.

According to the above-mentioned descriptions, the invention has the following advantages.

1. The fitting portion 75 can be bidirectionally inserted into the connection slot 16 of the biased USB 2.0 electrical connection socket 10 for electrical connection, and can be used in a very convenient manner.

2. The height of the fitting portion 75 is about 3.25 mm significantly lower than the height (4.5 mm) of the connection portion of the biased USB 2.0 electrical connection plug 20, and has the slim and light advantages.

3. The structure is simplified and can be easily manufactured.

Figure 9:
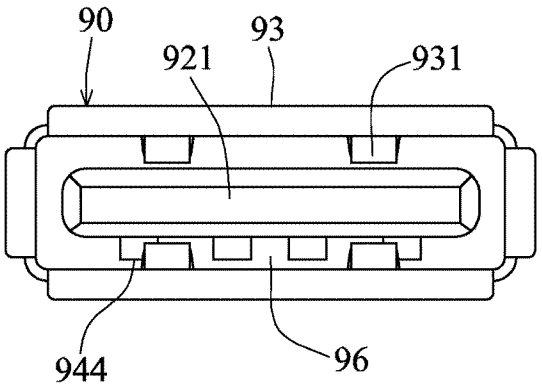
FIG. 9 shows a front view according to a second embodiment of the invention.
Figure 8:
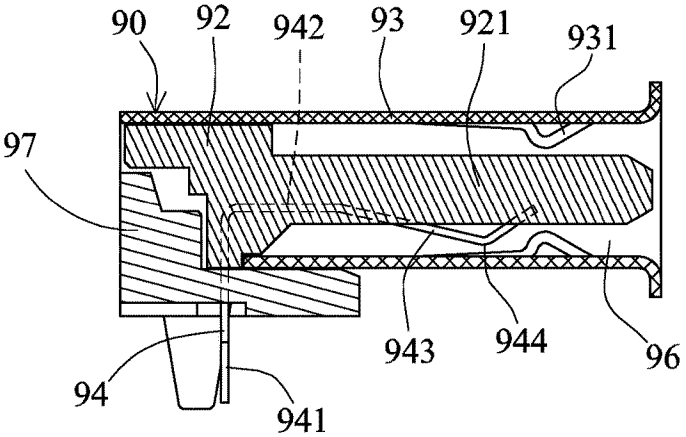
FIG. 8 shows a side cross-sectional view according to the second embodiment of the invention.

Referring to FIGS. 8 and 9, the second embodiment of the invention provides a bidirectional simplex USB 2.0 electrical connection socket 90 comprises an insulating seat 92, a metal housing 93, one row of first terminals 94 and a rear cover 97.

The insulating seat 92 is plastically injection molded and has a front end with a middle projectingly provided with a horizontally extending tongue 921, wherein the bottom surface of the tongue 921 has a USB 2.0 contact interface. The USB 2.0 contact interface is formed by the one row of first terminals 94. The contact interface is outputted from the circuit of the rear end of the insulating seat 30.

The metal housing 93 covers the insulating seat 92 and the tongue 921 to form a connection slot 96 at the front end of the insulating seat 92. The tongue 921 is disposed at a middle height of the connection slot 96. Symmetrical spaces are formed on the top and bottom surfaces of the tongue 921. The external shape of the connection slot 96 is rectangular, top-bottom symmetrical and left-right symmetrical.

The one row of first terminals 94 are assembled or disposed at the insulating seat. Each terminal has a pin 941, a fixing portion 942 and an extension 943. The fixing portion 942 is fixed to the insulating seat 92. The extension 943 connected to the front end of the fixing portion 942 extends to the tongue 921 and has a contact 944. The contact 944 projecting beyond the bottom surface of the tongue 921 is vertically elastically movable. The pin 941 connected to the rear end of the fixing portion 942 extends out of the insulating seat. The contacts 944 of the one row of first terminals 94 form the USB 2.0 contact interface.

The rear cover 97 covers the rear and bottom of the insulating seat 92 to position the pins 941 of the one row of first terminals 94.

This embodiment is characterized in that the spaces on the upper and lower symmetrical surfaces of the tongue 921 of the connection slot 96 have the same height of about 0.72 mm, which is smaller than the large space 162 of the biased USB 2.0 electrical connection socket and is substantially equal to the small space. The height of the tongue 921 is still 1.84 mm. The height of the connection slot 96 is about 3.3 mm, which is significantly lower than the biased USB 2.0 electrical connection socket 10. A fitting portion of an electrical connection plug can be bidirectionally inserted into the connection slot 96.

Figure 10:
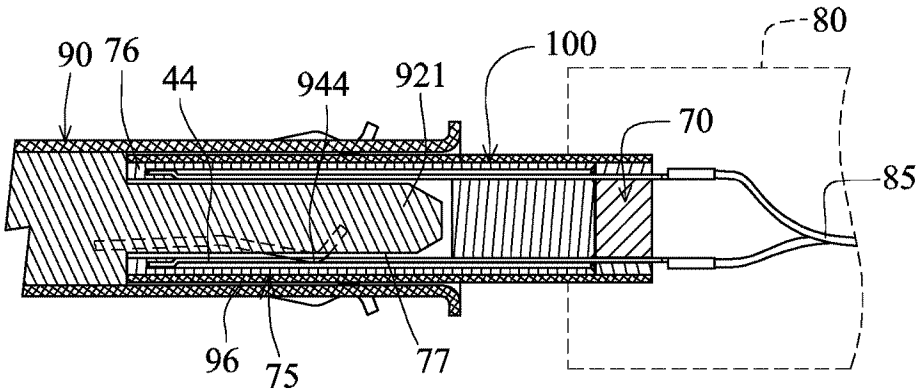
FIG. 10 is a side cross-sectional view showing a used state according to the second embodiment of the invention.

Referring to FIG. 10, with the above-mentioned structure, the heights of the two contact interface substrates 76 of the fitting portion 75 of the bidirectional duplex USB 2.0 electrical connection plug 100 can be fit into the spaces on the upper and lower symmetrical surfaces of the tongue 921 of the connection slot 96. So, the fitting portion 75 can be bidirectionally inserted into the connection slot 96 of the bidirectional simplex USB 2.0 electrical connection socket 90, and the USB 2.0 contact interface (contacts 44) of one of the two contact interface substrates 76 is electrically connected to the USB 2.0 contact interface (contacts 944) of the bottom surface of the tongue 921 of the bidirectional simplex USB 2.0 electrical connection socket 90. In addition, both of the fitting portion 75 of the bidirectional duplex USB 2.0 electrical connection plug and the connection slot 96 of the bidirectional simplex USB 2.0 electrical connection socket 90 can achieve the better fitting. So, this is different from FIG. 7, in which a too large space is still left when the contact interface substrate 76 is in the large space 162.

Regarding the design of this embodiment, the spaces on the upper and lower connection surfaces of the tongue 921 of the connection slot 96 may have the same height or different heights, wherein the height may range between 0.55 mm and 2.1 mm. The height of the connection slot 96 may be designed to range between 3 mm and 6 mm. Thus, the height of the contact interface substrate matching with the inserted bidirectional USB 2.0 electrical connection plug ranges between 0.5 mm and 2.0 mm, and the height of the fitting portion ranges between 3 mm and 6 mm.

Figure 11:
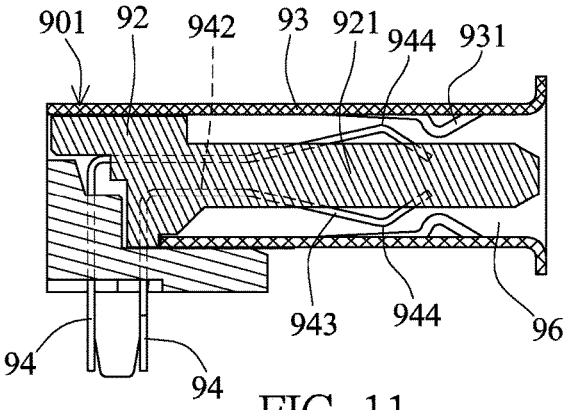
FIG. 11 shows a side cross-sectional view according to the third embodiment of the invention.
Figure 12:
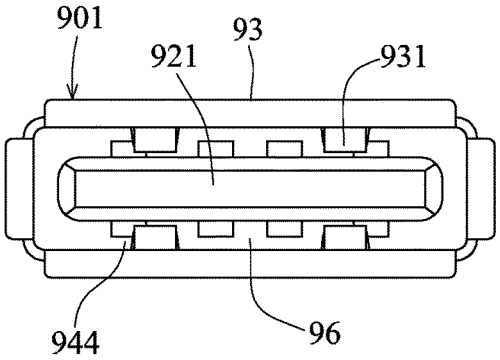
FIG. 12 shows a front view according to the third embodiment of the invention.

Referring to FIGS. 11 and 12, the third embodiment of the invention provides a USB 2.0 bidirectional duplex electrical connection socket 901 and is almost the same as the second embodiment of the invention except for the differences that there is additionally provided with one row of first terminals 94, and that the top surface of the tongue 921 is also formed with a USB 2.0 contact interface. The USB 2.0 contact interfaces on the top and bottom surfaces of the tongue 921 have the same contact interface, and have the connection points with the circuit serial numbers arranged reversely.

Figure 13:
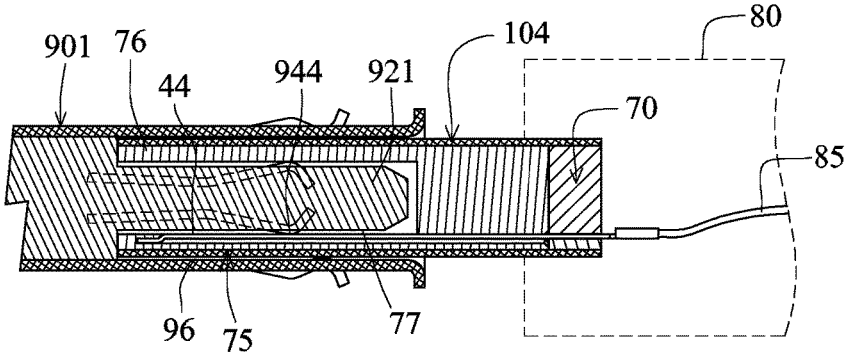
FIG. 13 is a side cross-sectional view showing a used state according to the fourth embodiment of the invention.

Referring to FIG. 13, a bidirectional simplex USB 2.0 electrical connection plug 104 according to the fourth embodiment of the invention is almost the same as the first embodiment except for the difference that only one of the two contact interface substrates 76 of the fitting portion 75 has the USB 2.0 contact interface. So, the fitting portion 75 can be bidirectionally inserted into the connection slot 96 of the bidirectional duplex USB 2.0 electrical connection socket 901, and the USB 2.0 contact interface (contacts 44) of the contact interface substrate 76 is inevitably electrically connected to one of the USB 2.0 contact interfaces (contacts 944) on the top and bottom surfaces of the tongue 921 of the bidirectional duplex USB 2.0 electrical connection socket 901.

Figure 14:
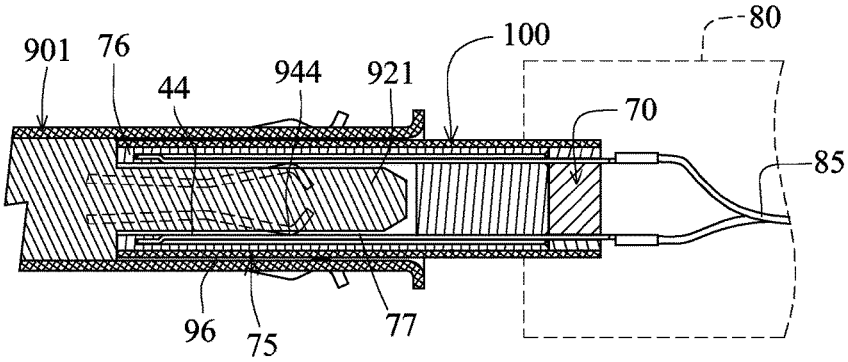
FIG. 14 is a side cross-sectional view showing a used state according to the fifth embodiment of the invention.

Referring to FIG. 14, which is the fifth embodiment of the invention, wherein the fitting portion 75 of the bidirectional duplex USB 2.0 electrical connection plug 100 can be bidirectionally inserted into the connection slot 96 of the bidirectional duplex USB 2.0 electrical connection socket 901, so that the two contact interfaces of the plug and the socket can be bidirectionally docking to achieve the convenient use and the doubled transmission speed. However, the plug and the socket of this embodiment are slimmer and lighter than those of the prior art.

Figure 15:
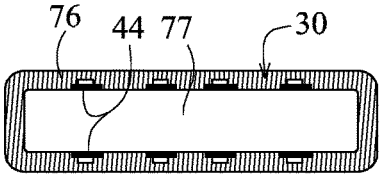
FIG. 15 shows a cross-sectional view according to the sixth embodiment of the invention.

Referring to FIG. 15, the sixth embodiment of the invention provides a bidirectional duplex USB 2.0 electrical connection plug, and is almost the same as the first embodiment except for the difference that no metal housing cover is disposed outside the insulated seat 30 and the overall two contact interface substrates 76 are formed by the insulated seat 30.

Referring to FIGS. 16 to 23, the seventh embodiment of the invention provides a bidirectional USB 3.0 electrical connection plug, and is almost the same as the first embodiment except for the differences that two rows of five second terminals 50 are further provided, that the insulating seat 30 has the upper and lower seats 301 and 302 stacked vertically, and that each of the upper and lower seats 301 and 302 has one row of five second terminal slots 33. The two rows of second terminals 50 are assembled into the two rows of second terminal slots 33, respectively. In addition, a horizontally extending metal partition plate 87 is provided between the upper and lower seats 301 and 302, to reduce the mutual electric interference of the two rows of second terminals 50 and facilitate the high-speed transmission.

Figure 17:
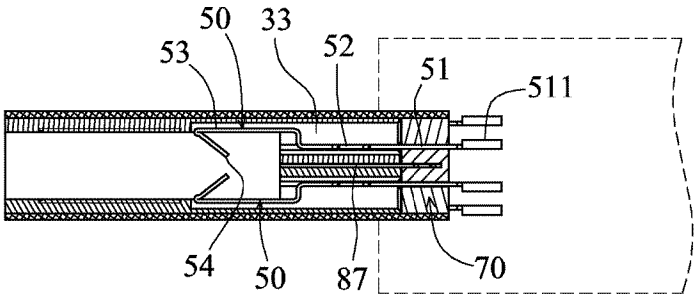
FIG. 17 shows a side cross-sectional view (taken at the position of the second terminal 50) according to the second embodiment of the invention.
Figure 16:
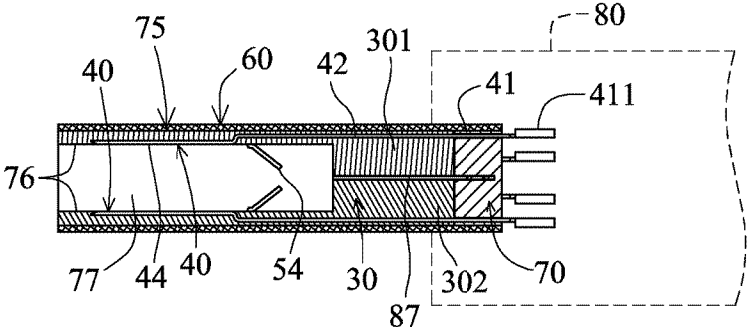
FIG. 16 shows a side cross-sectional view (taken at the position of the first terminal 40) according to a seventh embodiment of the invention.
Figure 19:
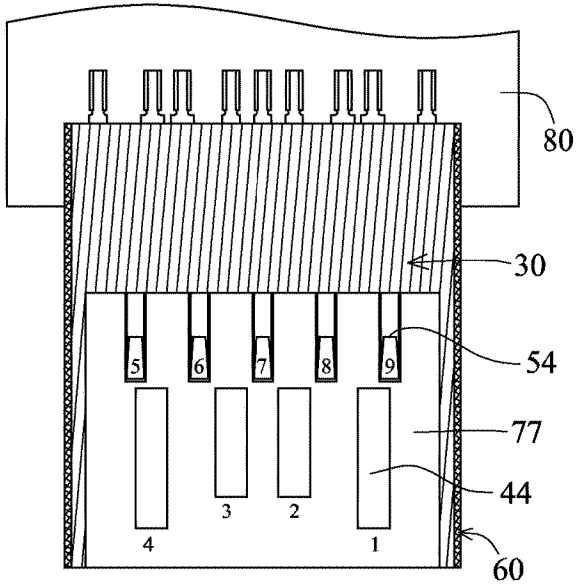
FIG. 19 shows a top cross-sectional view according to the seventh embodiment of the invention.
Figure 18:
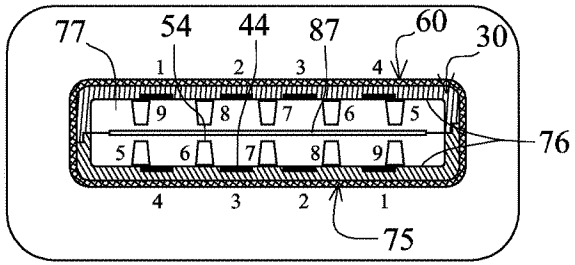
FIG. 18 shows a front cross-sectional view according to the seventh embodiment of the invention.

Referring to FIG. 17, the second terminal 50 sequentially has, from one end to the other end, a pin 51, a fixing portion 52 and an extension 53. The fixing portion 52 is fixed to the second terminal slot 33. The extension 53 connected to the front end of the fixing portion 52 extends to the contact interface substrate 76 and has a distal section bent inversely to form a contact 54. The contact 54 is the cut section of the distal end of the extension 53. The contact 54 is vertically elastically movable and projects beyond the inner surface of the contact interface substrate 76. The pin 51 is connected to the other end of the fixing portion 52, extends out of the rear end of the insulating seat 30 and has a distal section formed with a wiring portion 511. The contacts 44 of the two rows of first terminals 40 and the contacts 54 of the two rows of second terminals 50 respectively form the USB 3.0 contact interfaces of the two contact interface substrates 76, respectively. The two USB 3.0 contact interfaces have the same contact interface and the connection points with the circuit serial numbers arranged reversely. As shown in FIG. 18, the contacts 44 of the upper one row of first terminals have the connection points with the circuit serial numbers of 1, 2, 3, 4 arranged from left to right, the contacts 54 of the one row of second terminals have the connection points with the circuit serial numbers of 9, 8, 7, 6, 5 arranged from left to right, the contacts 44 of the lower one row of first terminals have the connection points with the circuit serial numbers of 4, 3, 2, 1 arranged from left to right, and the contacts 54 of the one row of second terminals 50 have the connection points with the circuit serial numbers of 5, 6, 7, 8, 9 arranged from left to right.

Figure 20:
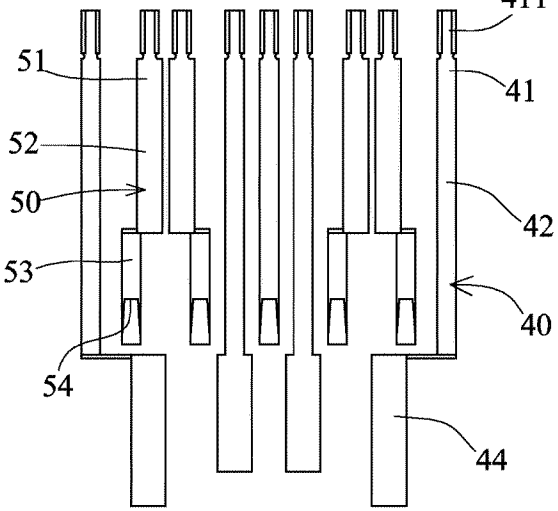
FIG. 20 is an arranged top view showing two rows of terminals according to the seventh embodiment of the invention.

Referring to FIG. 20, the middle terminal of each row of second terminals 50 is the ground terminal, and one pair of signal terminals are disposed on two sides of the middle terminal. Each pair of signal terminals can be designed to be close to each other, and this is advantageous to the high-speed transmission, so the fixing portions 52 and the pins 51 of the two second terminals 50 on the two sides are close to each other.

Figure 21:
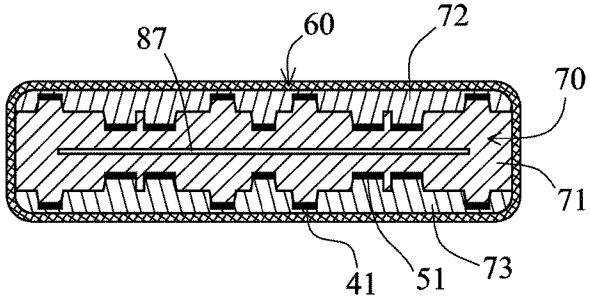
FIG. 21 shows a back cross-sectional view according to the seventh embodiment of the invention.

Referring to FIG. 21, the rear plug 70 is a three-piece combination comprising an upper portion 72, a middle portion 71 and a lower portion 73, so that the pins 41 of the two rows of first terminals 40 and the pins 51 of the two rows of second terminals 50 pass through and closely fit with the rear plug 70. The rear plug 70 mainly plugs into the voids communicating the two rows of second terminal slots 33 with the rear end of the insulating seat 30.

Figure 22:
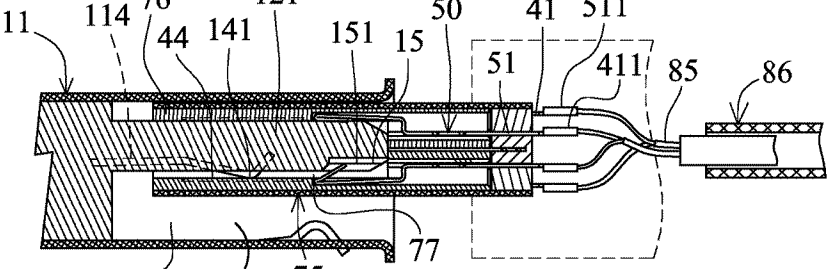
FIG. 22 is a side cross-sectional view showing a used state according to the seventh embodiment of the invention.

Referring to FIG. 22, with the above-mentioned structure, the heights of the two contact interface substrates 76 of the fitting portion 75 can be fit into the small space of the connection slot 16 of the biased USB 3.0 electrical connection socket 11. So, the biased USB 3.0 electrical connection socket 11 and the biased USB 2.0 electrical connection socket 10 have substantially the same structure except that only one row of five second terminals 15 are added. The second terminal 15 has an elastically non-movable contact 151 disposed in front of the contact 141 of the first terminal 14. So, the fitting portion 75 can be bidirectionally inserted into the connection slot 16 of the biased USB 3.0 electrical connection socket 11, and one of the USB 3.0 contact interfaces (contacts 44 and 54) of the two contact interface substrates 76 is electrically connected to the USB 3.0 contact interface (contacts 141 and 151) below the tongue 121 of the biased USB 3.0 electrical connection socket 11.

Regarding the wiring portions 411 of the pins of the two rows of first terminals 40 of this embodiment, the connection points with the same circuit serial number are connected to the same wire 85. Regarding the wiring portions 511 of the pins of the two rows of second terminals 50, the connection points with the same circuit serial number are connected to the same wire 85. So, the connection cable 86 has one set of nine wires 85 thereinside.

Figure 23:
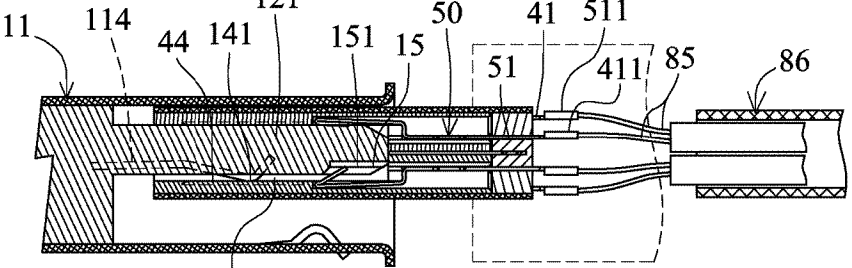
FIG. 23 is a side cross-sectional view showing the used state according to the seventh embodiment of the invention.

Referring to FIG. 23, in this embodiment, each of the wiring portions 411 of the pins of the two rows of first terminals 40 and the wiring portions 511 of the pins of the two rows of second terminals 50 is connected to a wire 85. So, the connection cable 86 has two set of nine wires 85 (18 wires 85 in total).

Figure 24:
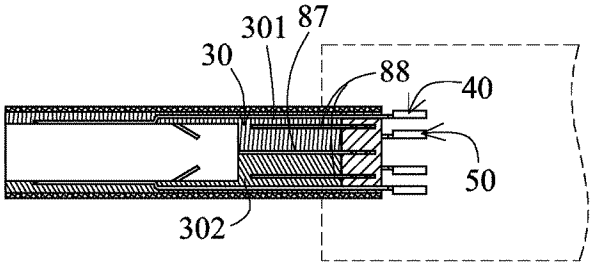
FIG. 24 shows a side cross-sectional view (taken at the position of the first terminal 40) according to the eighth embodiment of the invention.

Referring to FIG. 24, the eighth embodiment of the invention provides a bidirectional duplex USB 3.0 electrical connection plug, and is almost the same as the seventh embodiment except for the differences that a horizontally extending metal partition plate 88 is added to each of the upper and lower seats 301 and 302 of the insulating seat 30, so that the mutual electric interference of one row of first and second terminals 40 and 50 is reduced, and this is more advantageous to the high-speed transmission.

Figure 26:
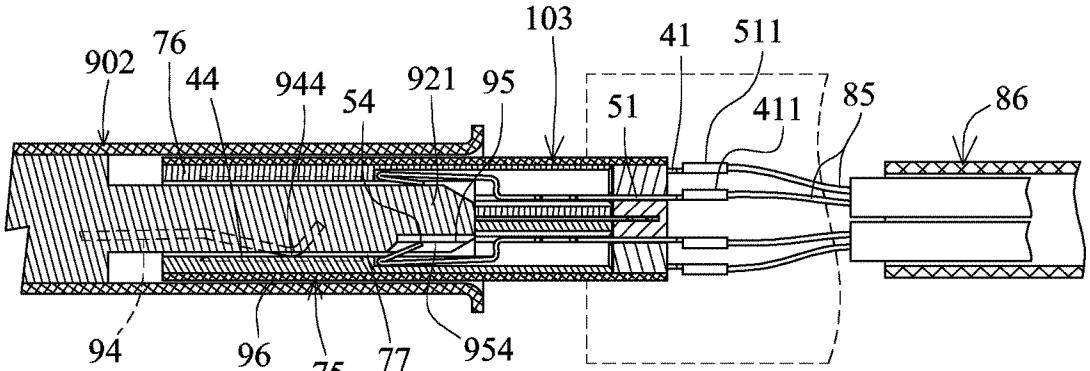
FIG. 26 is a side cross-sectional view showing a used state according to the ninth embodiment of the invention.
Figure 25:
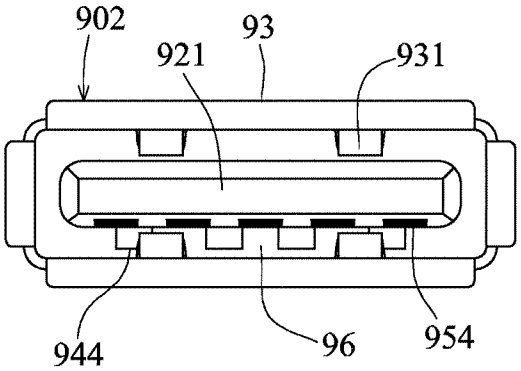
FIG. 25 shows a front view showing according to the ninth embodiment of the invention.

Referring to FIGS. 25 and 26, the ninth embodiment of the invention provides a bidirectional simplex USB 4.0 electrical connection socket 902 and is almost the same as the second embodiment except for the difference that one row of five second terminals 95 are further provided. The second terminal 95 has an elastically non-movable contact 954 disposed in front of the contact 944 of the first terminal 94. The contact 954 is slightly depressed into the bottom surface of the tongue 921. The one row of contacts 944 and the one row of contacts 954 form the USB 3.0 contact interface.

As long as the tongue 921 is at the middle height of the connection slot 96, the same symmetrical spaces are formed on the two symmetrical surfaces of the tongue 921 and the contact interface is the USB 3.0 contact interface, the structure type of the USB 4.0 electrical connection socket is provided.

The heights of the two contact interface substrates 76 of the fitting portion 75 of the bidirectional duplex USB 3.0 electrical connection plug 103 can be fit into the spaces on the upper and lower connection surfaces of the tongue 921 of the connection slot 96. So, the fitting portion 75 can be bidirectionally inserted into the connection slot 96 of the bidirectional simplex USB 4.0 electrical connection socket 902, and one of the USB 3.0 contact interfaces (contacts 44 and 54) of the two contact interface substrates 76 is electrically connected to the USB 3.0 contact interface (contacts 944 and 954) of the bottom surface of the tongue 921 of the bidirectional simplex USB.0 electrical connection socket 902. In addition, the fitting portion 75 of the bidirectional duplex USB 3.0 electrical connection plug 103 and the connection slot 96 of the bidirectional simplex USB 3.0 electrical connection socket 902 can achieve the better fitting. So, this is different from FIG. 22, in which a too large space is still left when the contact interface substrate 76 is in the large space 162.

Figure 28:
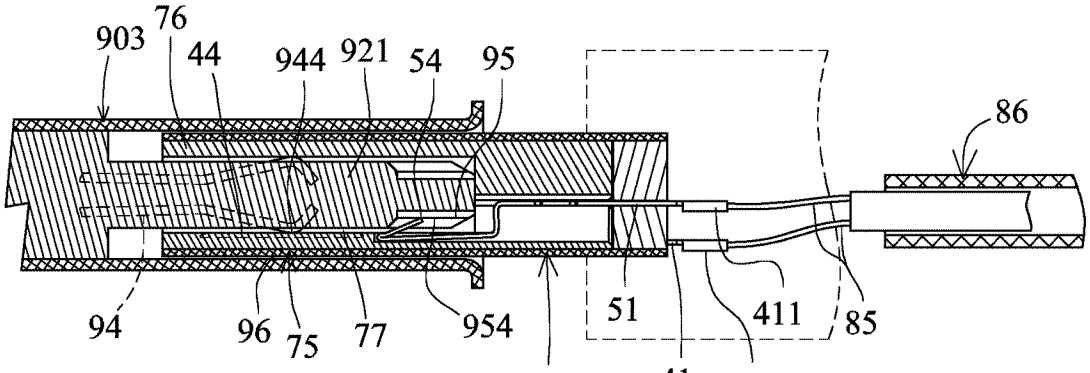
FIG. 28 is a side cross-sectional view showing a used state according to the tenth embodiment of the invention.
Figure 27:
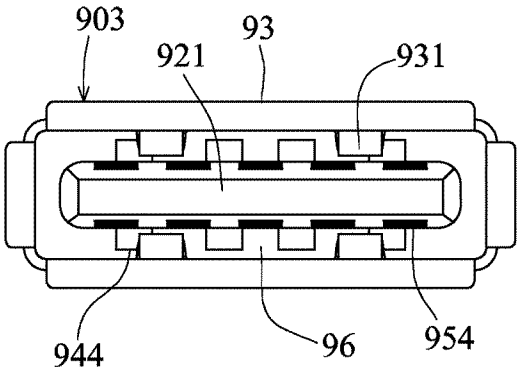
FIG. 27 shows a front view showing a duplex socket according to the tenth embodiment of the invention.

Referring to FIGS. 27 and 28, in the tenth embodiment of the invention, a bidirectional duplex USB 4.0 electrical connection socket 903 is docked with a bidirectional simplex USB 3.0 electrical connection plug 107, wherein the bidirectional duplex USB 4.0 electrical connection socket 903 is almost the same as the bidirectional simplex USB 4.0 electrical connection socket 902 of the ninth embodiment except for the differences that one row of first terminals 94 and one row of second terminals 95 are further provided, that the top surface of the tongue 921 is also formed with a USB 3.0 contact interface, that the USB 3.0 contact interfaces on the top and bottom surfaces of the tongue 921 have the same contact interface and have the connection points with the circuit serial numbers arranged reversely. The bidirectional simplex USB 3.0 electrical connection plug 107 is almost the same as the bidirectional duplex USB 3.0 electrical connection plug of the seventh embodiment except for the differences that only one of the two contact interface substrates 76 of the fitting portion 75 has the USB 3.0 contact interface. So, the fitting portion 75 can be bidirectionally inserted into the connection slot 96 of the USB 3.0 bidirectional duplex electrical connection socket 903, and the USB 3.0 contact interface (contacts 44, 54) of the contact interface substrate 76 is inevitably electrically connected to the USB 3.0 contact interface (contacts 944, 954) of one of the top and bottom surfaces of the tongue 921 of the bidirectional duplex USB 4.0 electrical connection socket 903.

Figure 29:
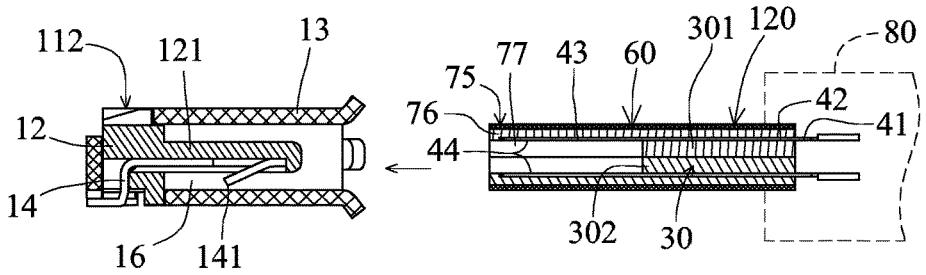
FIG. 29 shows a side cross-sectional exploded view according to an eleventh embodiment of the invention.
Figure 30:
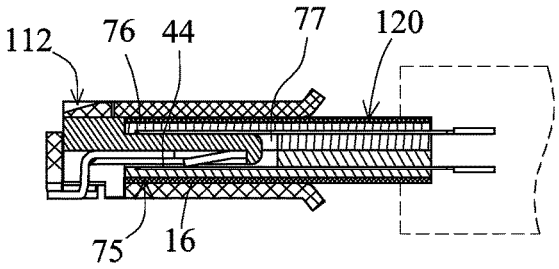
FIG. 30 shows a side cross-sectional combination view according to the eleventh embodiment of the invention.
Figure 31:
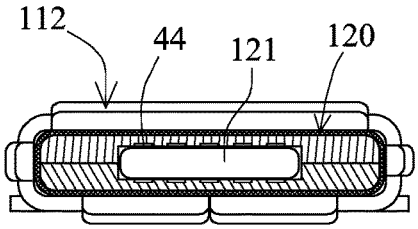
FIG. 31 shows a front cross-sectional combination view according to the eleventh embodiment of the invention.

Referring to FIGS. 29 to 31, the eleventh embodiment of the invention provides a bidirectional duplex MICRO USB 2.0 electrical connection plug 120 and a bidirectional simplex MICRO USB electrical connection socket 112, and is almost the same as the first embodiment, except for the differences that the tongue 121 of the bidirectional simplex MICRO USB 2.0 electrical connection socket 112 disposed at the middle of the connection slot 16, that the top and bottom surfaces of the tongue 121 are in the form of symmetrical spaces substantially the same as the height (0.28 mm) of the small space of the connection slot of the biased MICRO USB 2.0 electrical connection socket, wherein each of the two contact interface substrates 76 of the plug is provided with a MICRO USB contact interface, the MICRO USB 2.0 contact interface comprises the vertically elastically non-movable contacts 44 of the one row of five terminals 40, the bottom surface of the tongue 121 of the socket is provided with a MICRO USB 2.0 contact interface, and the MICRO USB 2.0 contact interface comprises vertically elastically movable contacts 141 of the one row of five terminals 14.

Figure 32:
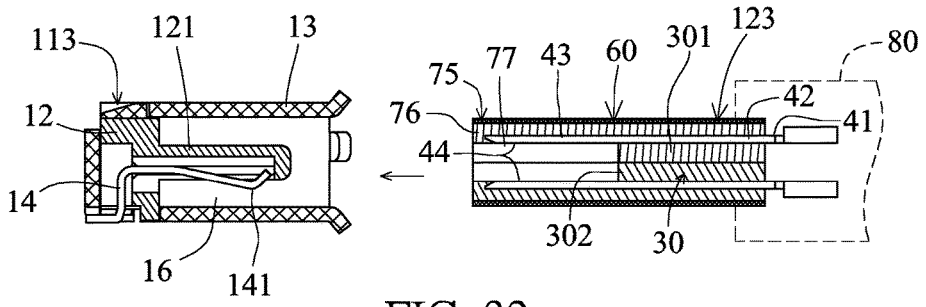
FIG. 32 shows a side cross-sectional exploded view according to an eleventh embodiment of the invention.
Figure 33:
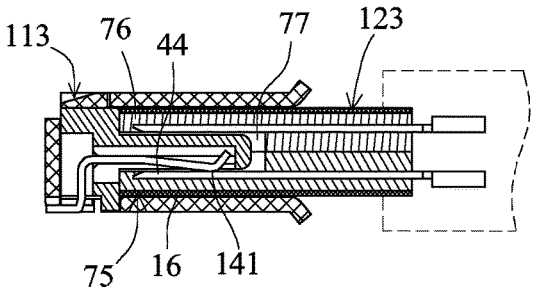
FIG. 33 shows a side cross-sectional combination view according to the eleventh embodiment of the invention.
Figure 34:
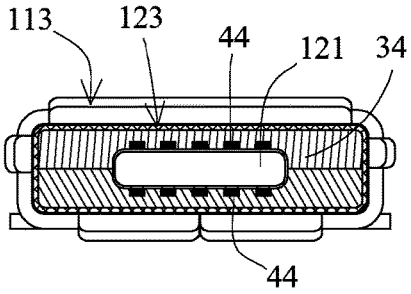
FIG. 34 shows a front cross-sectional combination view according to the eleventh embodiment of the invention

Referring to FIGS. 32 to 34, the twelfth embodiment of the invention provides a bidirectional duplex electrical connection plug 123 and a bidirectional simplex electrical connection socket 113, and is almost the same as the eleventh embodiment except for the differences that this embodiment has a middle dimension design, that is, the height of the contact interface substrate 76 of the bidirectional duplex electrical connection plug 123 ranges between 0.3 mm and 0.9 mm, the fitting slot 77 ranges between about 0.7 mm to 1.0 mm, the overall height ranges between about 1.3 mm and 2.8 mm, a height of the tongue 121 of the bidirectional simplex electrical connection socket 113 ranges between about 0.65 mm and 0.9 mm, the heights of the two symmetrical spaces of the top and bottom surfaces of the tongue 121 range between 0.35 mm and 0.95 mm, and the height of the connection slot 16 ranges between 1.35 mm and 2.85 mm, so that it can be easily manufactured in a slim and light design.

The two contact interfaces have the same contact interface, and the two contact interfaces have the connection points with the circuit serial numbers arranged reversely.

The height of the contact interface substrate 76 of the bidirectional duplex electrical connection plug 123 of this embodiment is about 0.55 mm, the fitting slot 77 is about 0.7 mm, the overall height is about 1.8 mm, a height of the tongue 121 of the bidirectional simplex electrical connection socket 113 is about 0.65 mm, the heights of the two symmetrical spaces of the top and bottom surfaces of the tongue 121 are about 0.6 mm, and the height of the connection slot 16 is about 1.85 mm.

Figure 35:
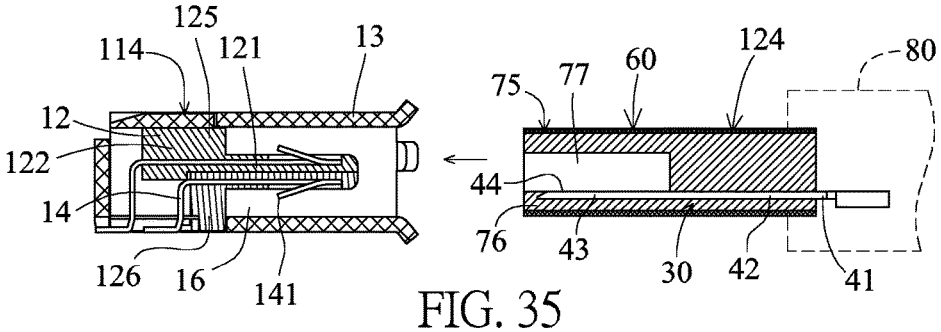
FIG. 35 shows a side cross-sectional exploded view according to an eleventh embodiment of the invention.
Figure 36:
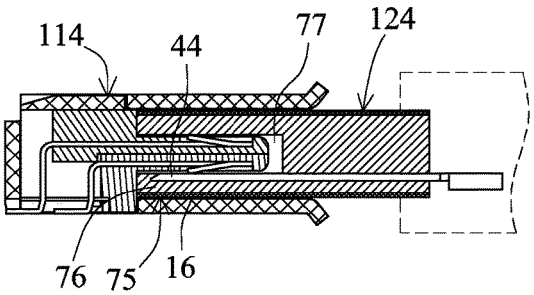
FIG. 36 shows a side combination view according to the eleventh embodiment of the invention.

Referring to FIGS. 35 and 36, the thirteenth embodiment of the invention provides a bidirectional simplex electrical connection plug 124 and a bidirectional duplex electrical connection socket 114, and is almost the same as the twelfth embodiment except for the differences that the bidirectional simplex electrical connection plug 124 of this embodiment is only provided with one row of first terminals. So, only a contact interface substrate 76 is provided with one row of contacts 44, the bidirectional duplex electrical connection socket 114 is provided with two rows of first terminals 14, the insulated seat 12 is provided with a base seat 122 and a tongue 121, the front end of the base seat 122 is projectingly provided with the tongue 121, the thickness of the base seat 122 is larger than that of the tongue 121, each of the top and bottom surfaces of the tongue 121 is provided with one row of contacts 141, the insulated seat 12 is formed by stacking the first seat 125 and the second seat 126 together vertically, and the first and second seats 125 and 126 are embedded into and injection molded with the one row of first terminals 14, respectively.

Figure 37:
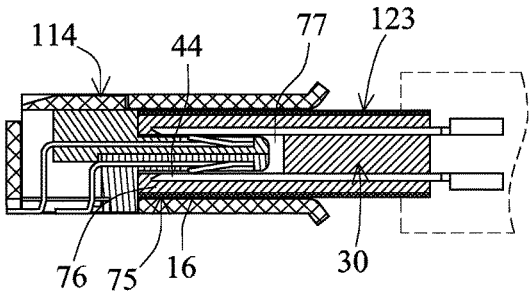
FIG. 37 shows a side cross-sectional combination view according to the eleventh embodiment of the invention.
Figure 38:
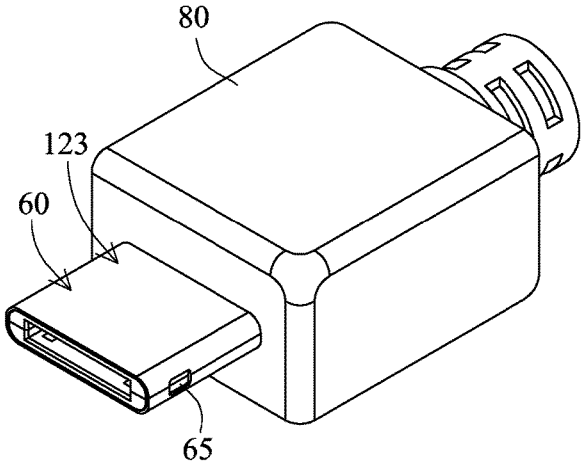
FIG. 38 is a pictorial view showing the plug according to the 15th embodiment of the invention.
Figure 39:
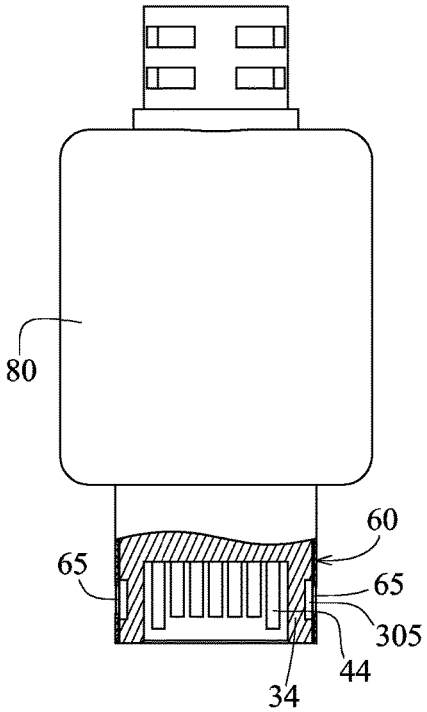
FIG. 39 is a top cross-sectional view showing the plug according to the 15th embodiment of the invention.
Figure 40:
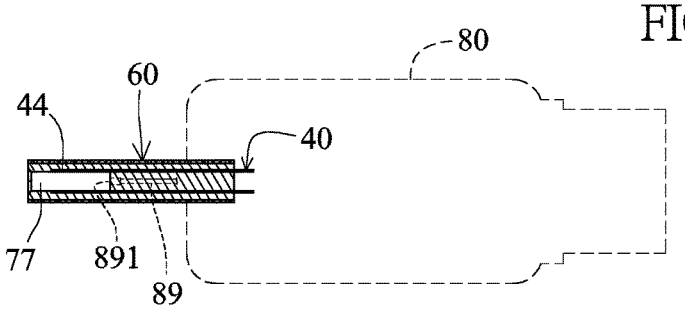
FIG. 40 is a side cross-sectional view showing the plug according to the 15th embodiment of the invention.
Figure 41:
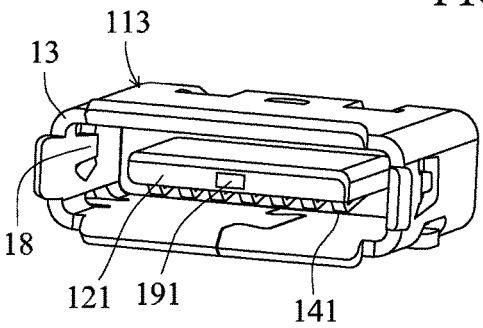
FIG. 41 is a pictorial view showing the socket according to the 15th embodiment of the invention.
Figure 42:
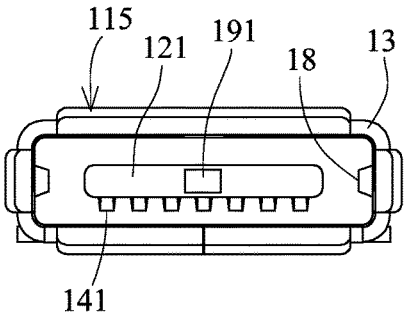
FIG. 42 is a front view showing the socket according to the 15th embodiment of the invention.
Figure 43:
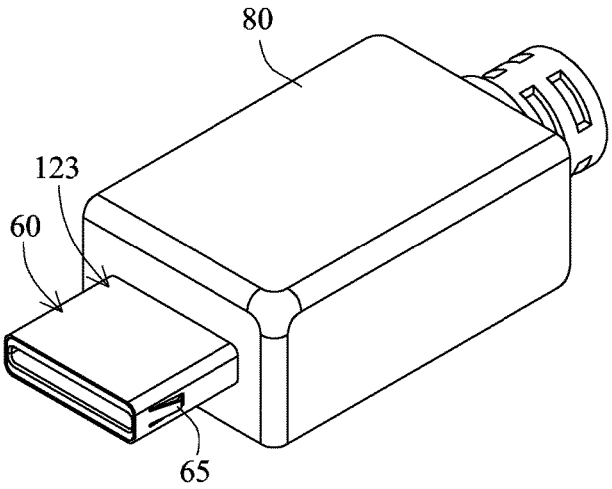
FIG. 43 is a pictorial view showing the plug according to the 16th embodiment of the invention.
Figure 44:
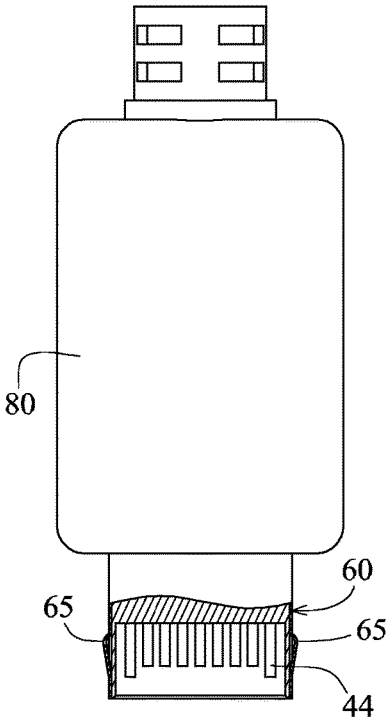
FIG. 44 is a top cross-sectional view showing the plug according to the 16th embodiment of the invention.
Figure 45:
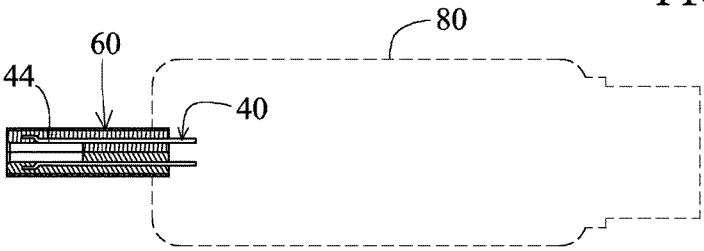
FIG. 45 is a side cross-sectional view showing the plug according to the 16th embodiment of the invention.
Figure 46:
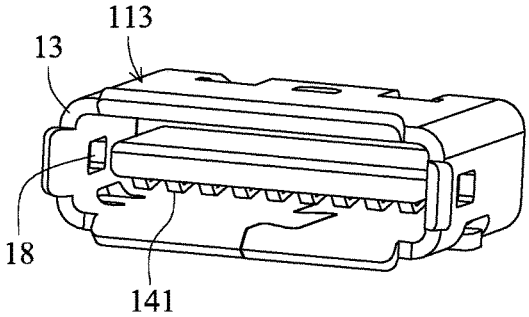
FIG. 46 is a pictorial view showing the socket according to the 16th embodiment of the invention.

Referring to FIG. 37, the 14th embodiment of the invention is similar to the above-mentioned embodiment and is the bidirectional duplex electrical connection plug 123 docking with a bidirectional duplex electrical connection socket 114, and the insulated seat 30 of the bidirectional duplex electrical connection plug 123 is integrally embedded into and injection molded with the two rows of first terminals, so that the doubled transmission rate can be achieved, the plug and the two contact interfaces of the socket have the same contact interface and the two contact interfaces have the connection points with the circuit serial numbers arranged reversely.

Referring to FIGS. 38 to 42, the 15th embodiment of the invention provides a bidirectional duplex low-height electrical connection plug 123 and a bidirectional simplex electrical connection socket 113, and is almost the same as the twelfth embodiment except for the differences that the contact interface of the bidirectional duplex electrical connection plug 123 of this embodiment has seven elastically non-movable contacts 44, and at least one optical fiber cable 89. The optical fiber cable 89 has a connection point 891 at the inner end of the fitting slot 77. Each of the left and right sides of the metal housing 60 has an engaging portion 65. The engaging portion 65 is an engagement hole, and each of the two sidewalls 34 of the insulating seat also correspondingly has a slot 305 to provide the larger engaging depth. The contact interface of the electrical connection socket has seven vertically elastically movable contacts 141, and at least one optical fiber cable. The optical fiber cable has a connection point 191 at the front end of the tongue 121 to match with the connection point 891 of the electrical connection plug. Each of the left and right sides of the metal housing 13 is inwardly projecting provided with an engaging portion 18. The engaging portion 18 is a resilient fastener. The engaging portion 18 can engage with the engaging portion 65 of the plug. Because the engaging portion 18 engages with the engaging portion 65 by the larger depth, the engaging snap or hand feeling is provided when the plug is inserted into the socket.

Referring to FIGS. 43 to 46, the 16th embodiment of the invention provides a bidirectional duplex electrical connection plug 123 and a bidirectional simplex electrical connection socket 113, and is almost the same as the twelfth embodiment except for the differences that the contact interface of the bidirectional duplex electrical connection plug 123 of this embodiment is provided with nine elastically non-movable contacts 44, and each of the left and right sides of the metal housing 60 projects outwards to provide an engaging portion 65. The engaging portion 65 is a resilient snap. The contact interface of the electrical connection socket 113 is provided with nine vertically elastically movable contacts 141. Each of the left and right sides of the metal housing 13 is provided with an engaging portion 18. The engaging portion 18 is an engagement hole. The engaging portion 18 may engage with the engaging portion 65 of the plug.

Figure 47:
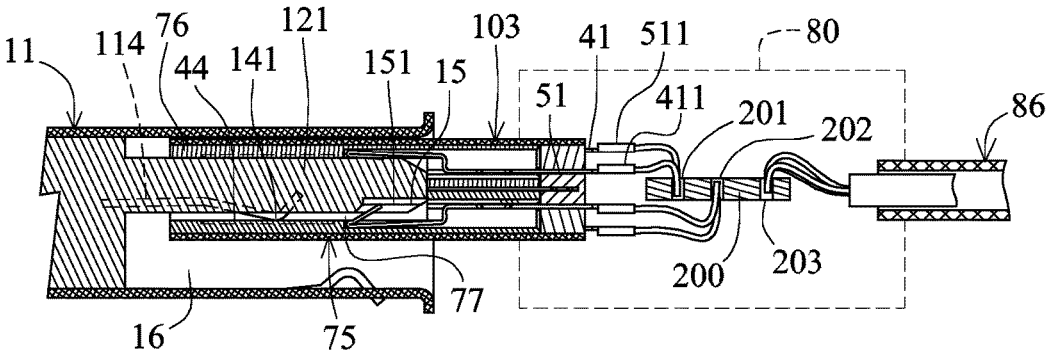
FIG. 47 is a side cross-sectional combination view according to the 17th embodiment of the invention.
Figure 48:
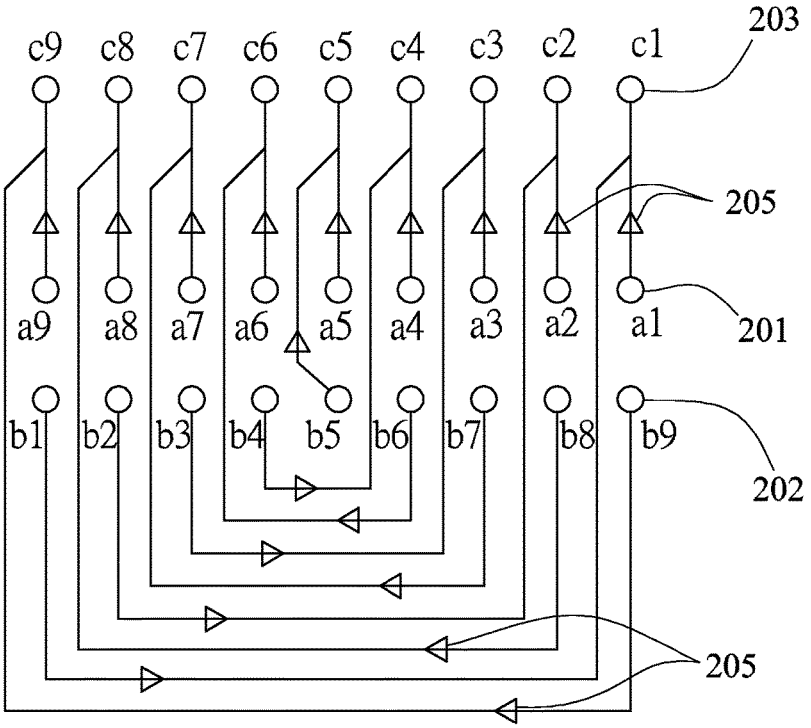
FIG. 48 is a schematic circuit diagram according to the 17th embodiment of the invention.
Figure 99:
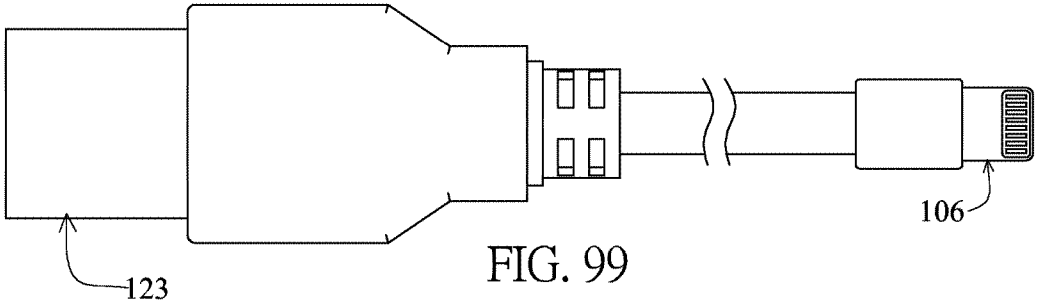
FIG. 99 is a top cross-sectional view according to the 40th embodiment of the invention.

Referring to FIGS. 47 and 48, the 17th embodiment of the invention provides a bidirectional duplex USB 3.0 electrical connection plug 103 and a biased USB 3.0 electrical connection socket 11, and is almost the same as the tenth embodiment except for the differences that the inside of the housing 80 of this embodiment is provided with a circuit board 200, the top of the circuit board 200 is provided with three rows of nine electrical connection to holes 201, 202 and 203, the one row of electrical connection holes 201 are a1 to a9, the contacts 44 of the contact interface substrate 76 are connected from the connection points with the circuit serial numbers 1 to 9 to a1 to a9, respectively, the one row of electrical connection holes 202 are b1 to b9, and the contacts 44 of the another contact interface substrate 76 are connected from the connection points with the circuit serial numbers 1 to 9 to b1 to b9, respectively. As shown in FIG. 99, each of the one row of electrical connection holes 201 (a1 to a9) and the one row of electrical connection holes 202 (b1 to b9) is connected to a signal circuit processing control element 205, and the holes are then sequentially reversely cascaded to form one set of circuits connected to the one row of electrical connection holes 203 (c1 to c9), and the one row of electrical connection holes 201 (c1 to c9) are further electrically connected to one set of wires. So, only one set of nine electric wires are disposed in the connection cable 86.

With the above-mentioned configuration, each signal circuit processing control element 205 may have the anti-current flow or anti-short-circuit or circuit safety protection to achieve the circuit safety protection effect.

Because the above-mentioned bidirectional duplex plug is provided with two contact interfaces, in addition to the provision of the signal circuit processing control element mentioned hereinabove, the Schottky diode anti-short-circuit or anti-current flow may also be used to provide the circuit safety protection. However, there may also be many methods, such as the provision of the anti-current flow electrical element or anti-short-circuit electrical element or circuit safety protection element or safety circuit provision means, to achieve the circuit safety protection effect.

In addition, the bidirectional duplex electrical connection socket of the invention is also provided with two contact interfaces, so the signal circuit processing control element or anti-current flow electrical element, anti-short-circuit electrical element, circuit safety protection element or safety circuit provision means as mentioned hereinabove may also be provided to achieve the circuit safety protection effect.

Figure 49:
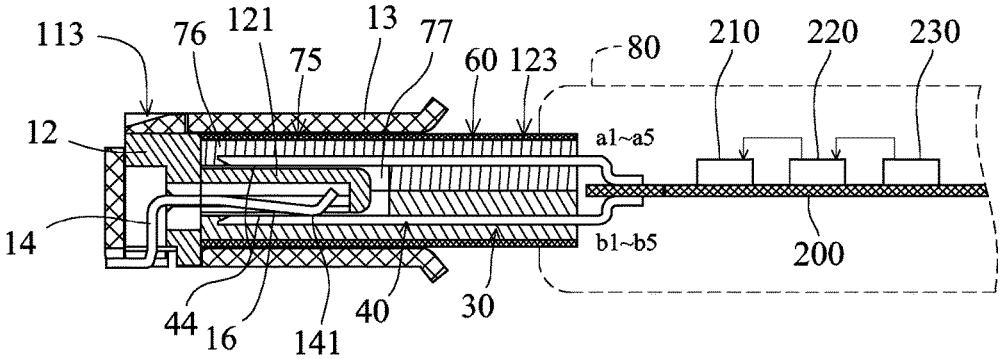
FIG. 49 is a side cross-sectional combination view according to the 18th embodiment of the invention.

Referring to FIGS. 49 to 59, the 18th embodiment of the invention provides a bidirectional duplex electrical connection plug 123 and a bidirectional simplex electrical connection socket 113, and is almost the same as the twelfth embodiment, as shown in FIG. 49, except for the differences that in the housing 80 of the bidirectional duplex electrical connection plug 123 of this embodiment is provided with a circuit board 200, the top of the circuit board 200 is provided with an interpretation system, the interpretation system comprises a detection device 230, a switch control device (being one set of five circuit switches 210), and a control chip 220, the one row of contacts 44 (connection points with the circuit serial number a1 to a5) of the contact interface of the upper contact interface substrate 76 are electrically connected to the top surface of the circuit board 200, the pins of the one row of terminals 40 are bonded to the top surface of the circuit board 200, the one row of contacts 44 (connection points with the circuit serial number b1 to b5) of the contact interface of the lower contact interface substrate 76 electrically connected to the bottom surface of the circuit board 200, the pins of the one row of terminals 40 bonded to the bottom surface of the circuit board 200, the contact interfaces of the two contact interface substrates 76 have the same contact interface and have the connection points with the circuit serial numbers arranged reversely, the contact interfaces of the two contact interface substrates 76 are cascaded to form one set of circuits and one set of circuit switches 210 provides the on/off switching, and the control chip 220 can control the one set of circuit switches 210 to operate through the instruction of the detection device 230.

Figure 51:
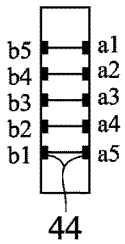
FIG. 51 is a side schematic view showing the two serially connected contact interfaces of the plug according to the 18th embodiment of the invention.
Figure 50:
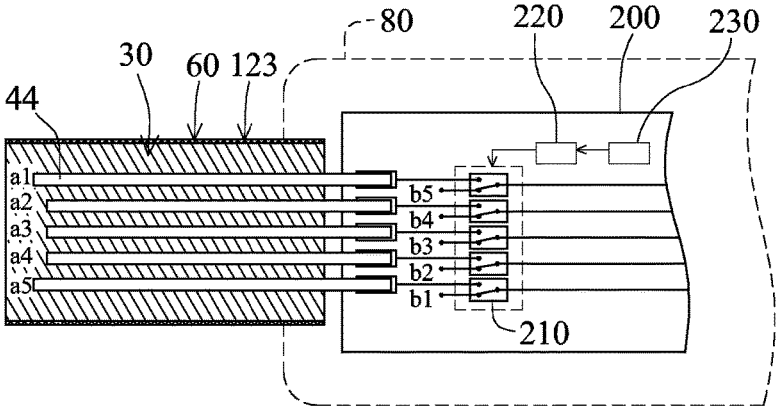
FIG. 50 is a top schematic view showing two serially connected contact interfaces of the plug according to the 18th embodiment of the invention.

Referring to FIGS. 50 and 51 showing the first cascading manner of this embodiment, the two contact interfaces provide the corresponding upper and lower contacts or the connection points with the reverse corresponding circuit serial numbers electrically connected to the same circuit, as shown in the drawing, a1 and b5 are electrically connected to the same circuit and a circuit switch 210 provides the on/off switching, a2 and b4 are paired, a3 and b3 are paired, a4 and b2 are paired and a5 and b1 are paired. The detection device 230 can detect the inserting orientation of the fitting portion 75 to inform the switch control device (being one set of five circuit switches 210) to operate to make the contact interface be electrically connected to the bidirectional simplex electrical connection socket 113 become ON, and to make the other contact interface, which is not electrically connected to the bidirectional simplex electrical connection socket 113, become OFF. For instance, when the inserting orientation of the fitting portion 75 is shown as FIG. 49, that is, b1 to b5 are electrically connected to the contacts 141 of the socket, the switch control device (being one set of five circuit switches 210) switches to make b1 to b5 become ON, so that a1 to a5 become OFF to prevent the signal or current from flowing reversely to the contact interface of a1 to a5, so that the real anti-current flow is achieved to avoid the poor electric property. On the contrary, if the fitting portion 75 is inserted in the other orientation and is electrically connected to the a1 to a5, the switch control device (being one set of five circuit switches 210) switches a1 to a5 to be ON and b1 to b5 to be OFF. In addition, the bidirectional simplex electrical connection socket 113 is combined with a control circuit and a detection device, the detection device can also detect the inserting orientation of the fitting portion 75 to inform the control circuit to switch the circuit signal of the connection point of the contact interface of the bidirectional simplex electrical connection socket 113 to work in conjunction with the signals of the connection point of enabling the plug to be ON. For instance, if b1 to b5 are ON, then the circuit signal is switched to the serial numbers 1, 2, 3, 4 and 5, if a1 to a5 are ON, then the circuit signal is switched to serial numbers 5, 4, 3, 2 and 1.

Figure 53:
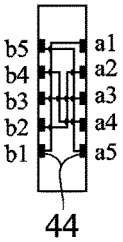
FIG. 53 is a side schematic view showing another two serially connected contact interfaces of the plug according to the 18th embodiment of the invention.
Figure 52:
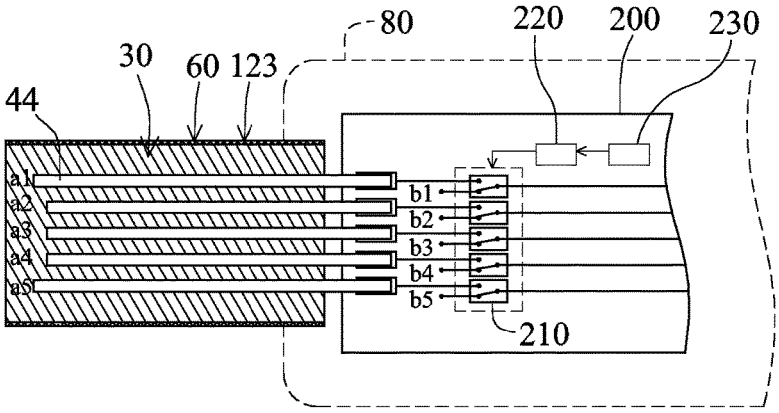
FIG. 52 is a top schematic view showing another two serially connected contact interfaces of the plug according to the 18th embodiment of the invention.

Referring to FIGS. 52 and 53 showing the second cascading manner of this embodiment, the two contact interfaces have the connection points with the same circuit serial numbers electrically connected to the same circuit, as shown in the drawing, wherein a1 and b1 are electrically connected to the same circuit, and a circuit switch 210 provides the on/off switching, a2 and b2 are paired, a3 and b3 are paired, a4 and b4 are paired and a5 and b5 are paired. The detection device 230 can detect the inserting orientation of the fitting portion 75 to inform the switch control device (being one set of five circuit switches 210) to operate to make the contact interface be electrically connected to the bidirectional simplex electrical connection socket 113 become ON, and to make the other contact interface, which is not electrically connected to the bidirectional simplex electrical connection socket 113, become OFF. In this manner, the two contact interfaces have the connection points with the same circuit serial numbers electrically connected to the same circuit, so the bidirectional simplex electrical connection socket 113 needs not to combine with a control circuit to switch the circuit signal of the connection point of the contact interface.

Figures 54, 55, 56, 57:
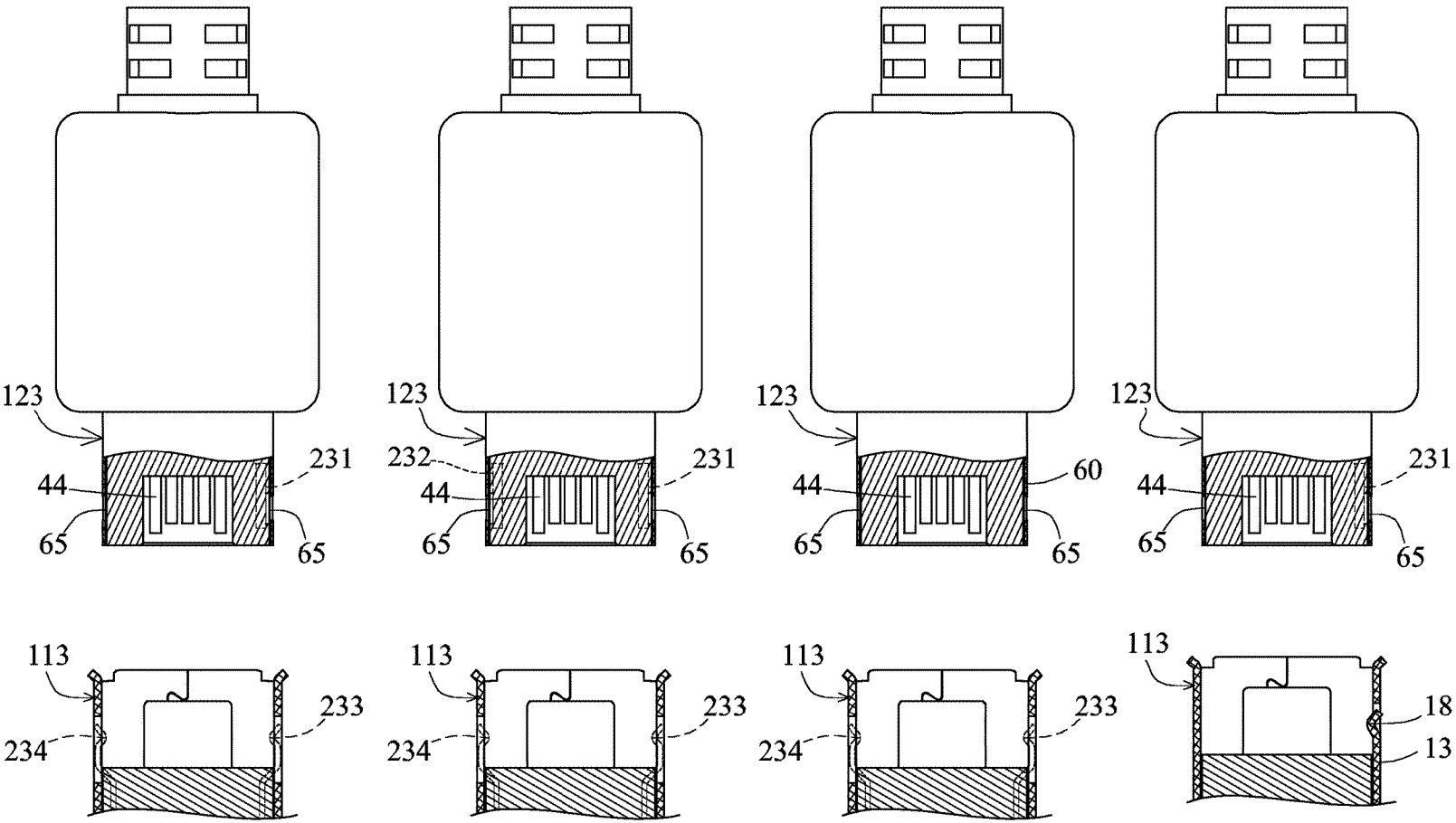
FIG. 54 is a top schematic view showing a first aspect of the detection device according to the 18th embodiment of the invention.
FIG. 55 is a top schematic view showing a second aspect of the detection device according to the 18th embodiment of the invention.
FIG. 56 is a top schematic view showing a third aspect of the detection device according to the 18th embodiment of the invention.
FIG. 57 is a top schematic view showing a fourth aspect of the detection device according to the 18th embodiment of the invention.

Referring to FIG. 54, the first aspect of the detection device 230 of this embodiment is configured such that only the left or right side of the bidirectional duplex electrical connection plug 123 is provided with a detection terminal 231, the left and right sides of the bidirectional simplex electrical connection socket 113 are respectively provided with detection terminals 233 and 234. When the plug is docked with the socket, if the detection terminal 231 is electrically connected to the detection terminal 233, then the detection device 230 detects an inserting orientation of the bidirectional duplex electrical connection plug 123; and if the detection terminal 231 is electrically connected to the detection terminal 234, then the detection device 230 detects the other inserting orientation of the bidirectional duplex electrical connection plug 123, the detection terminals 233 and 234 on the socket may concurrently engage with the engagement hole 65 of the metal housing of the plug to provide the fitting and holding force.

Referring to FIG. 55, the second aspect of the detection device 230 of this embodiment is almost the same as the first aspect except for the differences that the left and right sides of the bidirectional duplex electrical connection plug 123 are respectively provided with detection terminals 231 and 232.

Referring to FIG. 56, the third aspect of the detection device 230 of this embodiment is almost the same as the first aspect except for the difference that the bidirectional duplex electrical connection plug 123 has no detection terminal. The detection terminals 233 and 234 on the socket engage with the engagement hole 65 of the metal housing of the plug to form the ground conduction to detect the inserting orientation of the plug.

Referring to FIG. 57, the fourth aspect of the detection device 230 of this embodiment is almost the same as the first aspect except for the differences that only the left or right side of the metal housing 13 of the bidirectional simplex electrical connection socket 113 is provided with a resilient snap 18 and no detection terminal is provided. The resilient snap 18 of the socket engages with the engagement hole 65 of the metal housing of the plug to form the ground conduction with the detection terminal 231 or no contact is achieved in the other orientation to detect the inserting orientation of the plug.

Figure 58:
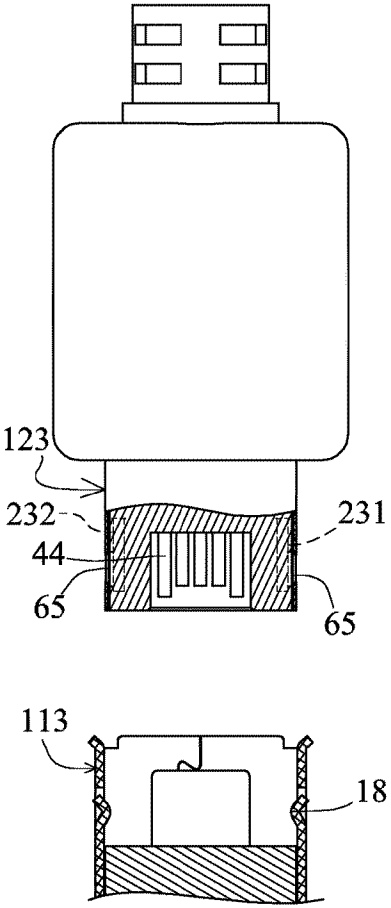
FIG. 58 is a top schematic view showing a fifth aspect of the detection device according to the 18th embodiment of the invention.

Referring to FIG. 58, the fifth aspect of the detection device 230 of this embodiment is almost the same as the second aspect except for the differences that each of the left and right sides of the metal housing 13 of the bidirectional simplex electrical connection socket 113 is provided with a resilient snap 18, and no detection terminal is provided.

Figure 59:
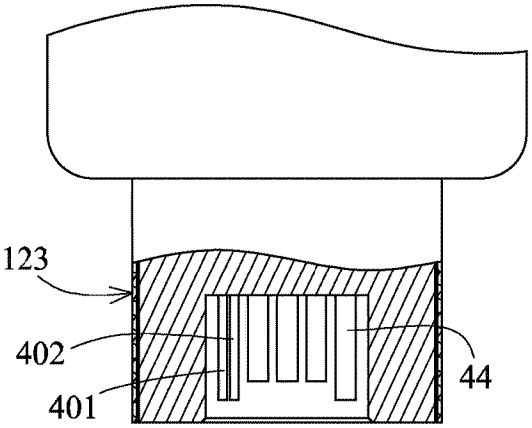
FIG. 59 is a top schematic view showing a sixth aspect of the detection device according to the 18th embodiment of the invention.

Referring to FIG. 59, a first terminal of each of the two contact interfaces of the bidirectional duplex electrical connection plug 123 of the sixth aspect of the detection device 230 of this embodiment is divided into two terminals 401 and 402, so that when any contact interface is electrically connected to the bidirectional simplex electrical connection socket 113, the two terminals 401 and 402 can be electrically connected to each other to form a loop to detect the inserting orientation of the plug. Upon implementation, the grounding elastic sheet of FIG. 66 divided into two terminals is preferred. However, it may also be disposed on another terminal, such as the power terminal or the signal terminal.

The circuits of the embodiments of various detection devices may be provided in conjunction with the software or hardware switches to achieve the switching of associated circuits or the circuit signal switching J according to the inserting orientation of the plug.

Figure 60:
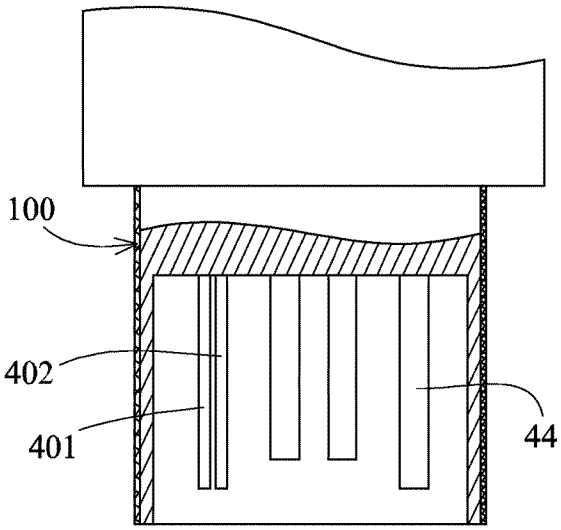
FIG. 60 is a top schematic view showing the detection device according to the 19th embodiment of the invention.

Referring to FIG. 60, the 19th embodiment of the invention is almost the same as the sixth aspect of the detection device 230 of the 18th embodiment, wherein this embodiment is the bidirectional duplex USB 2.0 electrical connection plug 100.

The anti-current flow of the above-mentioned embodiments is described with reference to the plug. On the contrary, if the socket is provided with two contact interfaces, and the plug is only provided with one contact interface, then the safety configuration of the anti-current flow of the socket can be configured in a manner similar to FIGS. 49 to 59, and detailed descriptions thereof will be omitted herein.

Figure 61:
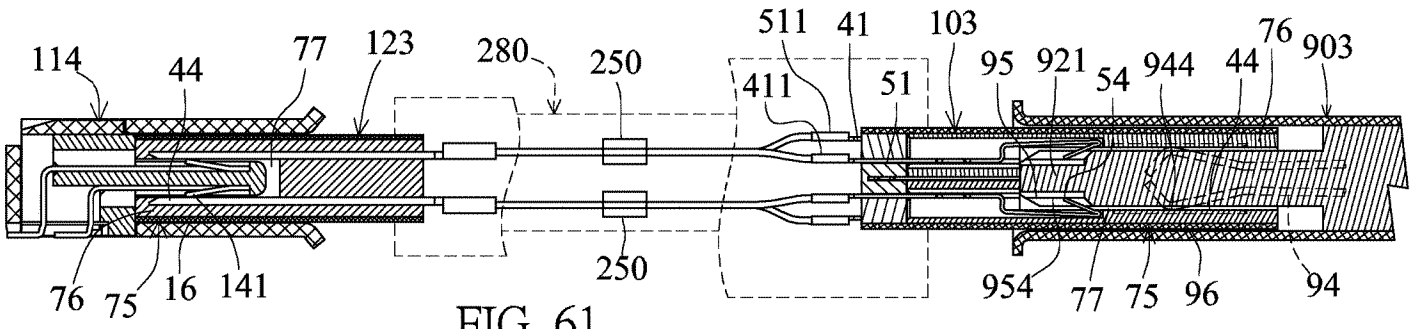
FIG. 61 is a side cross-sectional view according to the 20th embodiment of the invention.

Referring to FIG. 61, the 20th embodiment of the invention is an adapter cable 280, one end of the adapter cable 280 is connected to a bidirectional duplex USB 3.0 electrical connection plug 103, and the other end of the adapter cable 280 is adapted to a bidirectional duplex electrical connection plug 123, the bidirectional duplex USB 3.0 electrical connection plug 103 is inserted into and connected to a bidirectional duplex USB 4.0 electrical connection socket 903, to achieve the double-rate transmission, and the bidirectional duplex electrical connection plug 123 is inserted into and connected to a bidirectional duplex electrical connection socket 114 to achieve the double-rate transmission.

The two contact interfaces of the mutual docking bidirectional duplex plug and socket have the same contact interface, and the two contact interfaces have the connection points with the circuit serial numbers arranged reversely.

The adapter cable of this embodiment needs to be provided with two connection point switching integrated devices 250 to make the two USB 3.0 contact interfaces of the bidirectional duplex USB 3.0 electrical connection plug 103 and the two contact interfaces of the bidirectional duplex electrical connection plug 123 be integrated and switched mutually, that is, the connection points of the contact interfaces of the male and female connection points can be integrated and switched mutually.

Figure 62:
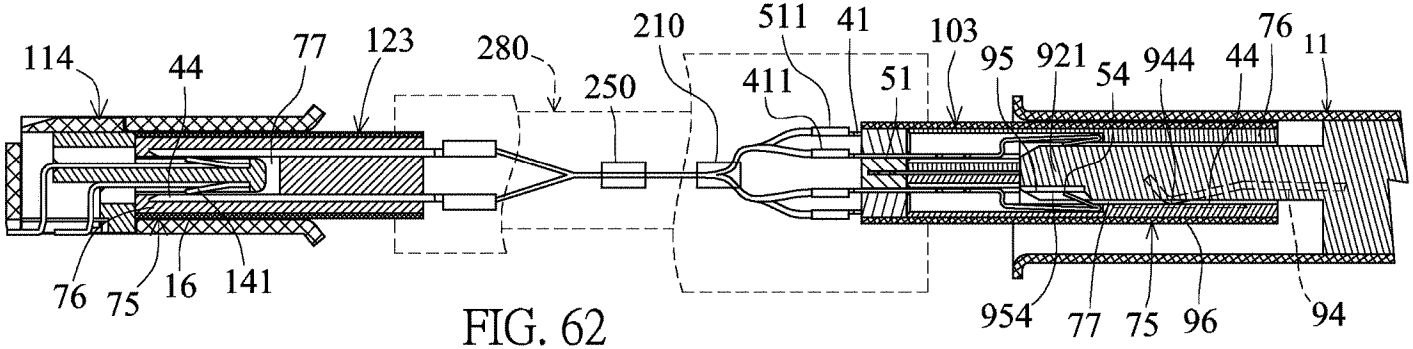
FIG. 62 is a side cross-sectional view according to the 21st embodiment of the invention.

Referring to FIG. 62, the 21st embodiment of the invention is almost the same as the 20th embodiment except for the differences that the bidirectional duplex USB 3.0 electrical connection plug 103 is inserted into and connected to a biased USB 3.0 electrical connection socket 11, the plug and the socket only have one single USB 3.0 contact interface for electrical connection. This provides the dual-orientation convenient for insertion connection but not the double-rate transmission. Thus, the bidirectional duplex USB 3.0 electrical connection plug 103 is provided with a switch control device (one set of nine circuit switches 210) for controlling ON or OFF of the circuits of the two USB 3.0 contact interfaces. The configuration thereof is similar to the 22nd embodiment, wherein a control chip and a detection device make the switch control device control a circuit of a USB 3.0 contact interface electrically connected to the socket to be ON according to the inserting orientation of the bidirectional duplex USB 3.0 electrical connection plug 103, and control the circuit of another USB 3.0 contact interface to be OFF to achieve the real anti-signal-reverse flow.

In addition, the adapter cable of this embodiment only needs to be provided with a connection point switching integrated device 250, that is, the two contact interfaces of the bidirectional duplex electrical connection plug 123 have the connection points with the same circuit serial numbers are electrically connected to the same circuit to form one set of circuits. Then, the connection point switching integrated device 250 is used with a USB 3.0 contact interface, which is electrically connected to the bidirectional duplex USB 3.0 electrical connection plug 103, to perform the connection point integration and mutual switching.

Figure 63:
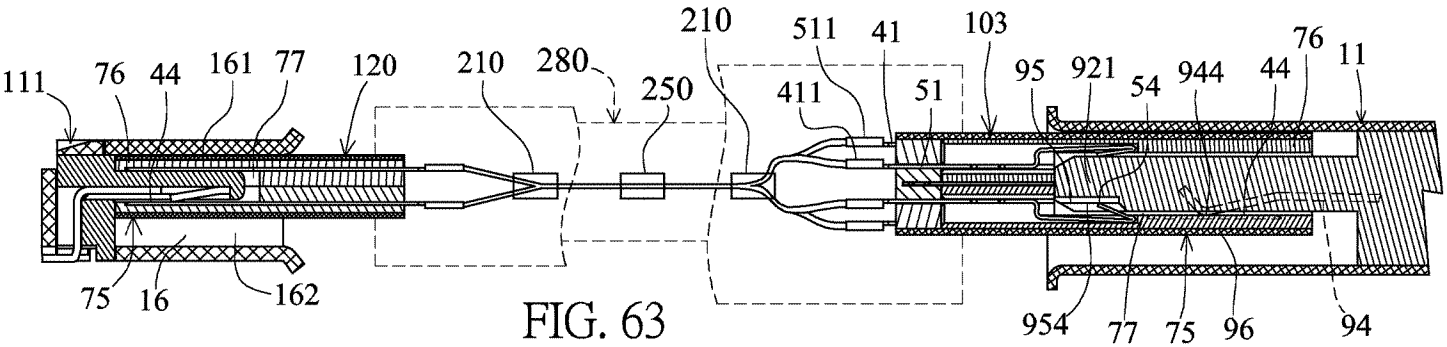
FIG. 63 is a side cross-sectional view according to the 22nd embodiment of the invention.

Referring to FIG. 63, the 22nd embodiment of the invention is almost the same as the 21st embodiment except for the differences that one end of the adapter cable 280 is connected to a bidirectional duplex MICRO USB electrical connection plug 120, and the bidirectional duplex MICRO USB electrical connection plug 120 is docked with a biased MICRO USB electrical connection socket 111. So, the bidirectional duplex MICRO USB electrical connection plug 120 is similarly provided with a switch control device (being one set of five circuit switches 210) for controlling ON or OFF of the circuits of two MICRO USB contact interfaces.

Referring to FIGS. 64 to 69, the 23rd embodiment of the invention provides a bidirectional duplex electrical connection plug 123 and a bidirectional duplex electrical connection socket 114 and is almost the same as the 14th embodiment except for the following differences.

Figure 65:
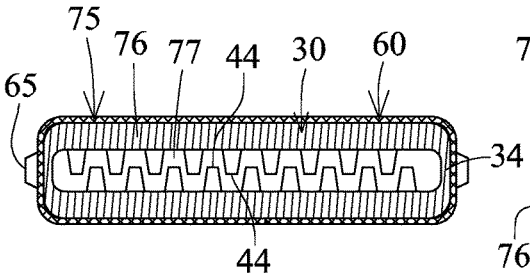
FIG. 65 is a front cross-sectional view showing the plug according to the 23rd embodiment of the invention.
Figure 64:
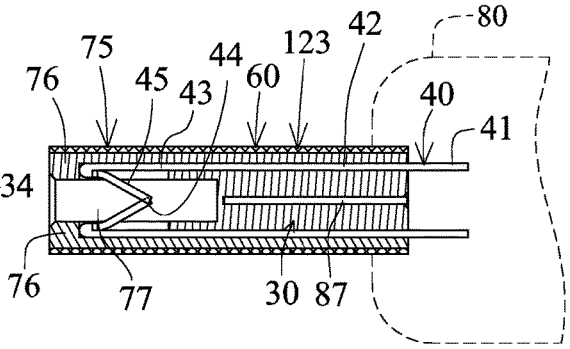
FIG. 64 is a side cross-sectional view showing the plug according to the 23rd embodiment of the invention.

Referring to FIGS. 64 and 65, each contact 44 of the contact interfaces of the two contact interface substrates 76 of the bidirectional duplex electrical connection plug 123 is vertically elastically movable, the front section of the extension 43 of each terminal 40 is bent reversely to form a vertically elastically movable reverse extension sheet 45, the cut surface of the distal end of the reverse extension sheet 45 is the contact 44, the one row of contacts 44 of the two contact interfaces are staggered vertically, that is, each contact 44 of a contact interface corresponds to a location between two neighboring contacts 44 of the other contact interface, the projecting heights of the one row of contacts 44 of the two contact interfaces exceed the center height of the fitting slot 77. However, the two rows of contacts 44 do not overlap vertically, and cannot touch each other to cause the short-circuit condition. In addition, the base seat of the rear section of the insulated seat 30 is provided with a horizontal extending metal partition plate 87 to reduce the mutual electric interference between the two rows of first terminals 40 and to be beneficial to the high-speed transmission.

Figure 68:
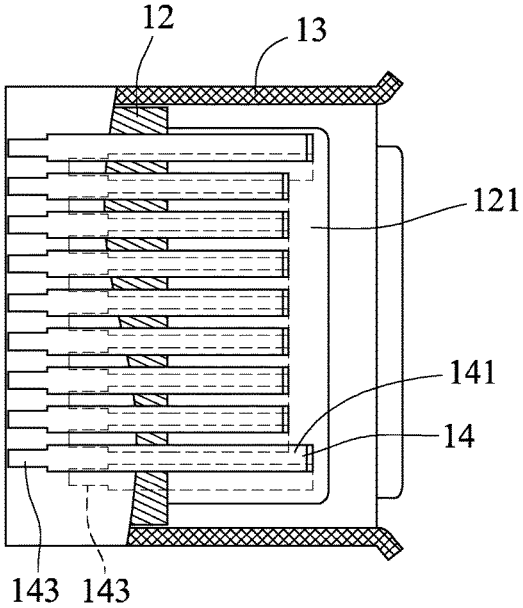
FIG. 68 is a top cross-sectional view showing the socket according to the 23rd embodiment of the invention.
Figure 66:
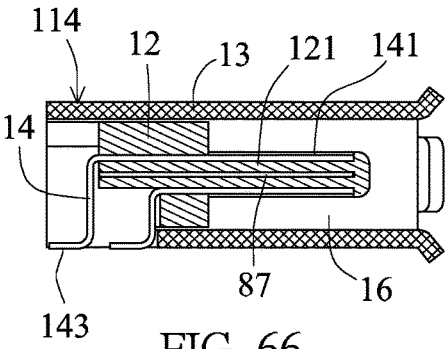
FIG. 66 is a side cross-sectional view showing the socket according to the 23rd embodiment of the invention.
Figure 67:
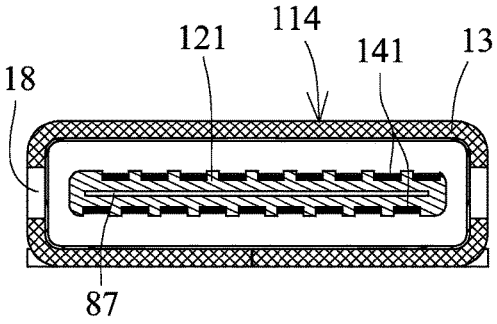
FIG. 67 is a front cross-sectional view showing the socket according to the 23rd embodiment of the invention.

Referring to FIGS. 66 to 68, the contacts 141 of the one row of first terminals 14 of the contact interfaces of the top and bottom surfaces of the tongue 121 of the bidirectional duplex electrical connection socket 114 are not vertically elastically movable, the two rows of first terminals 14 are staggered vertically (that is, one row of first terminals 14 vertically correspond the locations between neighboring two terminals of the other row of first terminals 14), the contact interface have connection points with the circuit serial numbers arranged reversely (that is, the contacts 141 and the pins 143 of the two rows of first terminals 14 are staggered vertically), and the pins 143 of the two rows of first terminals 14 are arranged in a front row and a rear row. In addition, a horizontal extending metal partition plate 87 is provided from the rear section of the insulated seat 12 to the tongue 121 to reduce the mutual electric interference between the two rows of first terminals 14 and to be beneficial to the high-speed transmission.

Figure 69:
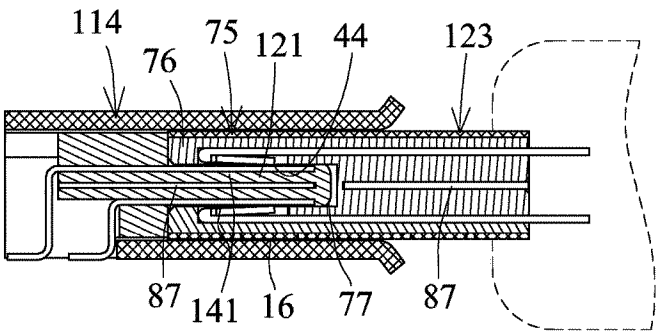
FIG. 69 is a side cross-sectional combination view according to the 23rd embodiment of the invention.

Referring to FIG. 69, with the above-mentioned structure, the bidirectional duplex electrical connection plug 123 can be inserted into and connected to the bidirectional duplex electrical connection socket 114 in a dual-orientation manner to achieve the double-rate transmission.

The two rows of first terminals of the plug and the socket of this embodiment are configured to be staggered. With the structure type, two rows of first terminals can be integrally embedded into and injection molded with the insulated seat concurrently to simply the manufacturing processes. Detailed descriptions can be found in application serial no. 201220230526.5, and detailed descriptions thereof will be omitted herein.

Of course, the two rows of first terminals of the plug and the socket are configured to be staggered. The insulated seat still can be divided into upper and lower seats each is embedded and injection molded with one row of first terminals.

Figure 70:
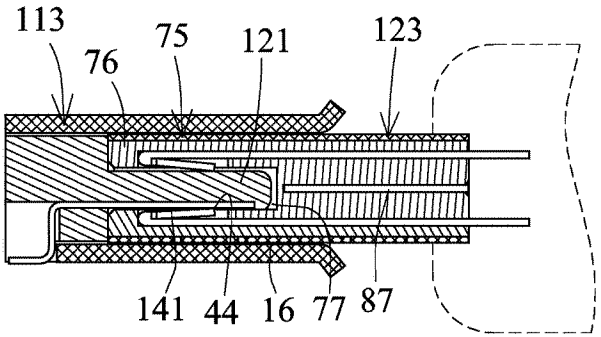
FIG. 70 is a side cross-sectional combination view according to the 24th embodiment of the invention.

Referring to FIG. 70, the 24th embodiment of the invention provides a bidirectional duplex electrical connection plug 123 and a bidirectional simplex electrical connection socket 113, and is almost the same as the 31st embodiment except for the difference that only one surface of the bidirectional simplex electrical connection socket 113 is provided with the contact interface.

Figure 71:
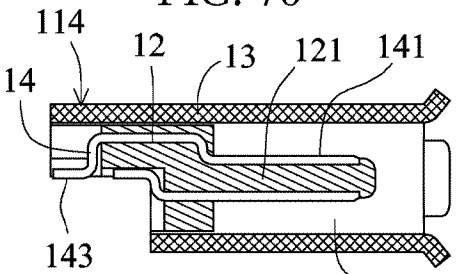
FIG. 71 is a side cross-sectional view showing the socket according to the 25th embodiment of the invention.
Figure 76:
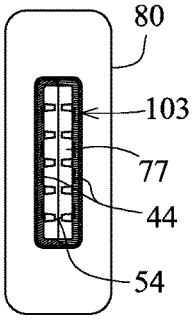
FIG. 76 is a front cross-sectional view showing a plug on one end according to the 29th embodiment of the invention.
Figure 75:
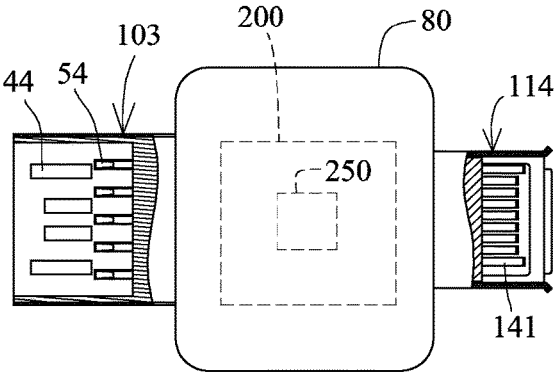
FIG. 75 is a top cross-sectional view according to the 29th embodiment of the invention.
Figure 77:
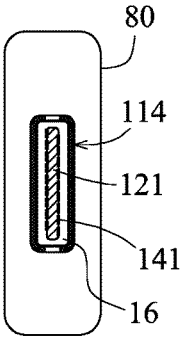
FIG. 77 is a front cross-sectional view showing a socket on the other end according to the 29th embodiment of the invention.
Figure 78:
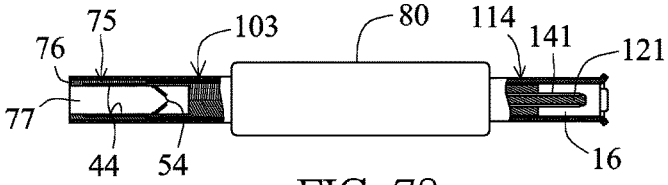
FIG. 78 is a side cross-sectional view according to the 29th embodiment of the invention.
Figure 80:
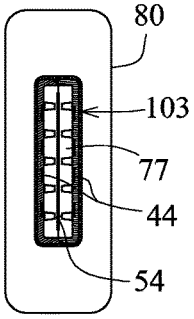
FIG. 80 is a front cross-sectional view showing a plug on one end according to the 30th embodiment of the invention.
Figure 79:
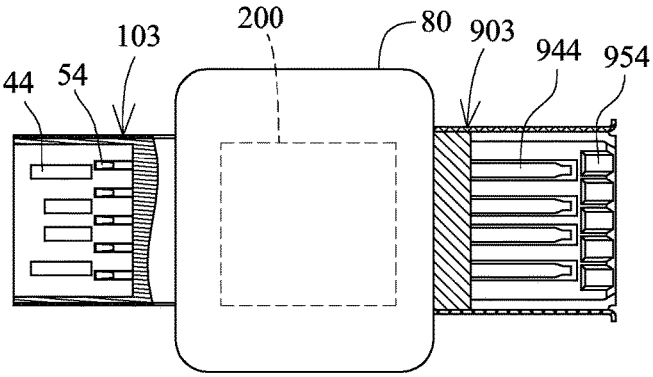
FIG. 79 is a top cross-sectional view according to the 30th embodiment of the invention.
Figure 81:
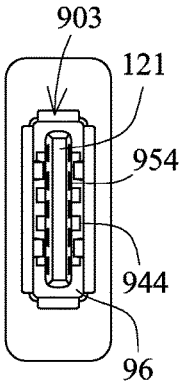
FIG. 81 is a front cross-sectional view showing a socket on the other end according to the 30th embodiment of the invention.
Figure 82:
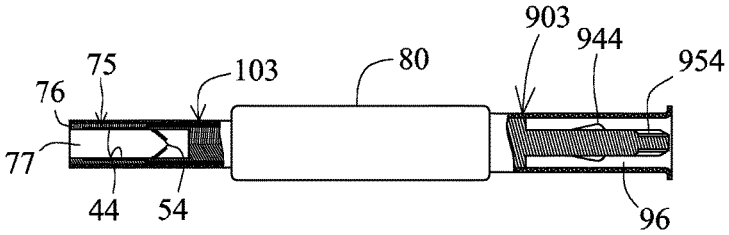
FIG. 82 is a side cross-sectional view according to the 30th embodiment of the invention.

Referring to FIG. 71, the 25th embodiment of the invention provides a bidirectional duplex electrical connection socket 114 and is almost the same as the 31st embodiment except for the differences that has a plate-depressed design, and that the pins 143 of the two rows of first terminals 14 are lifted up to be higher than the bottom portion of the insulated seat 12.

Figure 72:
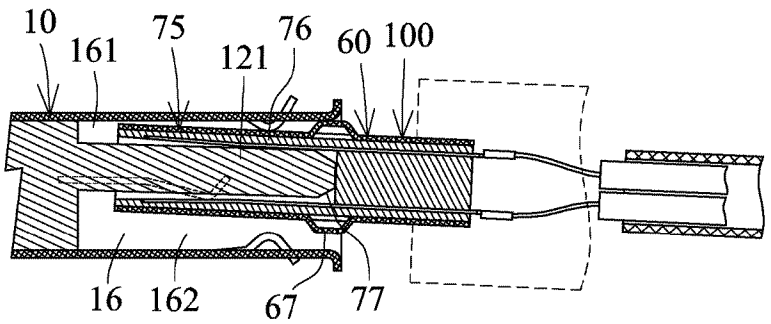
FIG. 72 is a side cross-sectional view showing a used state according to the 26th embodiment of the invention.

Referring to FIG. 72, the 26th embodiment of the invention provides a bidirectional duplex USB 2.0 electrical connection plug 100 and is almost the same as the first embodiment except for the differences that the rear sections of the two contact interface substrates 76 are provided with projections and larger than the height of the small space 161 of the biased USB 2.0 electrical connection socket 10, while the front sections of the two contact interface substrates are not larger than the height of the small space 161. That is, the top and bottom surfaces of the metal housing 60 corresponding to the inner section of the fitting slot 77 are provided with outward projecting projections 67. Thus, when the fitting portion 75 is inserted into the connection slot 16 of the biased USB 2.0 electrical connection socket 10, the gap between the projection 67 and the large space 162 can be decreased. Thus, the space for the improperly forced fitting portion 75 to rotate downward is smaller to prevent the tongue 121 from being broken. Because the tongue 121 is slightly bent downward upon being pressed by the resilient snap and plug, the height of the outer section of the small space 161 is increased and can be just pressed into the projection 67. In addition, the insulating layers of the two contact interface substrates 76 are provided with inclined surfaces inclined backward from the front end to gradually approach each other. That is, the insulating layers of the two contact interface substrates 76 have the gradually reduced heights toward the front ends. Thus, the force applied to the rear section of the tongue 121 can be reduced.

The projection may be configured to range between 0.4 mm and 0.55 mm, and is preferably configured to be 0.55 mm, and the heights of the two contact interface substrates are about 0.7 mm. Thus, the maximum height of the fitting portion 75 is 4.5 mm substantially the same as the height of the biased USB 2.0 electrical connection plug, so that the safety in use can be ensured.

Figure 73:
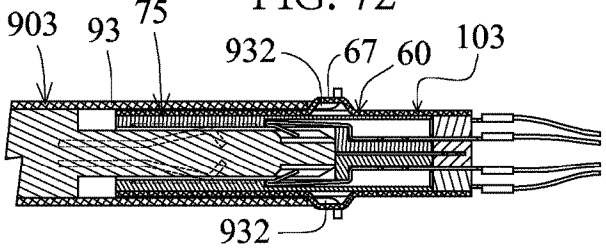
FIG. 73 is a side cross-sectional view showing a used state according to the 27th embodiment of the invention.

Referring to FIG. 73, the 27th embodiment of the invention provides a bidirectional duplex USB 4.0 electrical connection socket 903 and is almost the same as the tenth embodiment except for the differences that the front section of the metal housing is provided with a notch 932 to provide the spaces for the projection 67 of the bidirectional duplex USB 3.0 electrical connection plug 103.

Figure 74:
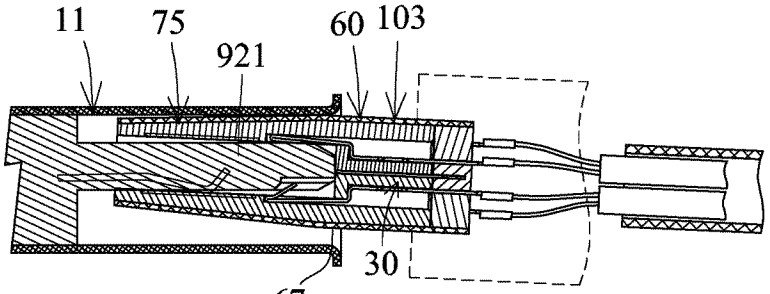
FIG. 74 is a side cross-sectional view showing a used state according to the 28th embodiment of the invention.

Referring to FIG. 74, the 28th embodiment of the invention provides a bidirectional duplex USB 3.0 electrical connection plug 103 and is almost the same as the 27th embodiment except for the differences that the rear sections of the insulated seat 30 and the metal housing 60 are higher than the front sections and the front sections of both have tapered shapes each having a lower front portion and a higher rear portion.

Referring to FIGS. 75 to 78, the 29th embodiment of the invention provides an adapter and is almost the same as the 28th embodiment except for the differences that this embodiment uses the circuit board as the transmission medium, the adapter is provided with a housing 80, inside the housing 80 is provided with a circuit board 200, the top of the circuit board 200 is provided with at least one connection point switching integrated device 250, one end of the adapter is provided with a bidirectional duplex USB 3.0 electrical connection plug 103, the other end is provided with a bidirectional duplex electrical connection socket 114, the bidirectional duplex USB 3.0 electrical connection plug 103 and the bidirectional duplex electrical connection socket 114 are electrically connected to the circuit board 200 and both of them achieve the connection point integration and mutual switching through the connection point switching integrated device 250.

Referring to FIGS. 79 to 82, the 30th embodiment of the invention provides an adapter and is almost the same as the 29th embodiment except for the differences that one end of the adapter is provided with a bidirectional duplex USB 3.0 electrical connection plug 103, and the other end of the adapter is provided with a bidirectional duplex USB 4.0 electrical connection socket 903. Because the contact interfaces of the electrical connectors of two ends of the adapter are the USB 3.0 contact interfaces, both of them need not to use the connection point switching integrated device 250 to achieve the connection point switching.

Figure 83:
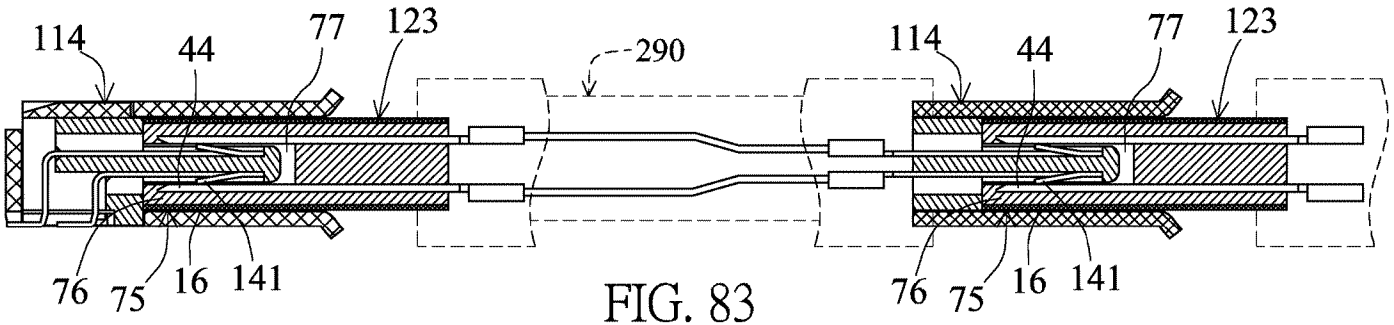
FIG. 83 is a side cross-sectional view according to the 31st embodiment of the invention.
Figure 86:
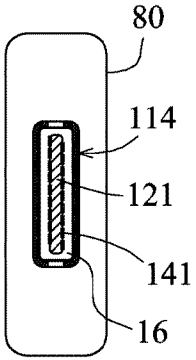
FIG. 86 is a front cross-sectional view showing a socket on the other end according to the 32nd embodiment of the invention.
Figure 84:
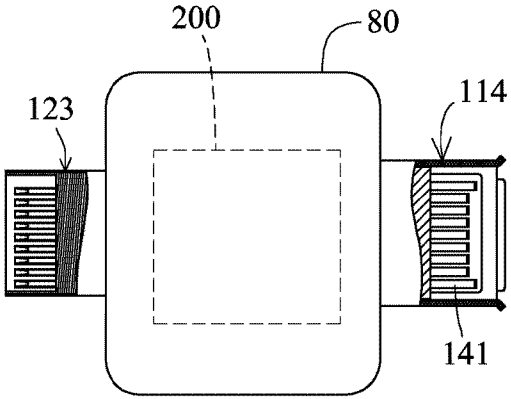
FIG. 84 is a top cross-sectional view according to the 32nd embodiment of the invention.
Figure 85:
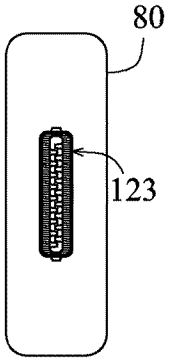
FIG. 85 is a front cross-sectional view showing a plug on one end according to the 32nd embodiment of the invention.
Figure 87:
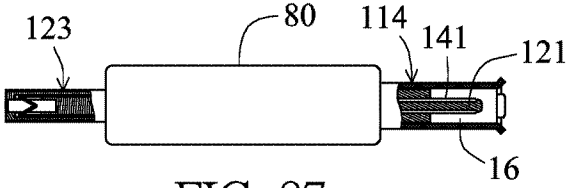
FIG. 87 is a side cross-sectional view according to the 32nd embodiment of the invention.
Figure 88:
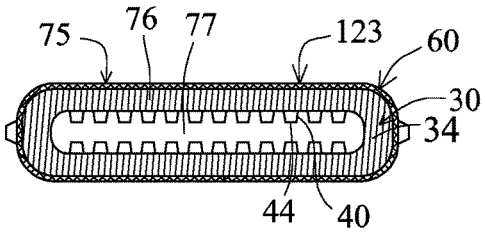
FIG. 88 is a front cross-sectional view according to the 33rd embodiment of the invention.
Figure 89:
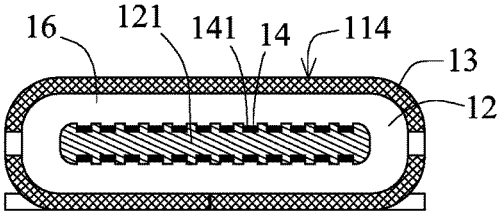
FIG. 89 is a front cross-sectional view according to the 33rd embodiment of the invention.
Figure 91:
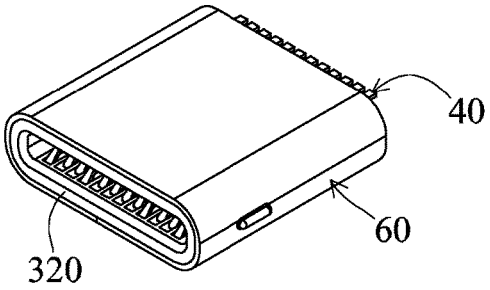
FIG. 91 is a pictorially assembled view according to the 34th embodiment of the invention.
Figure 90:
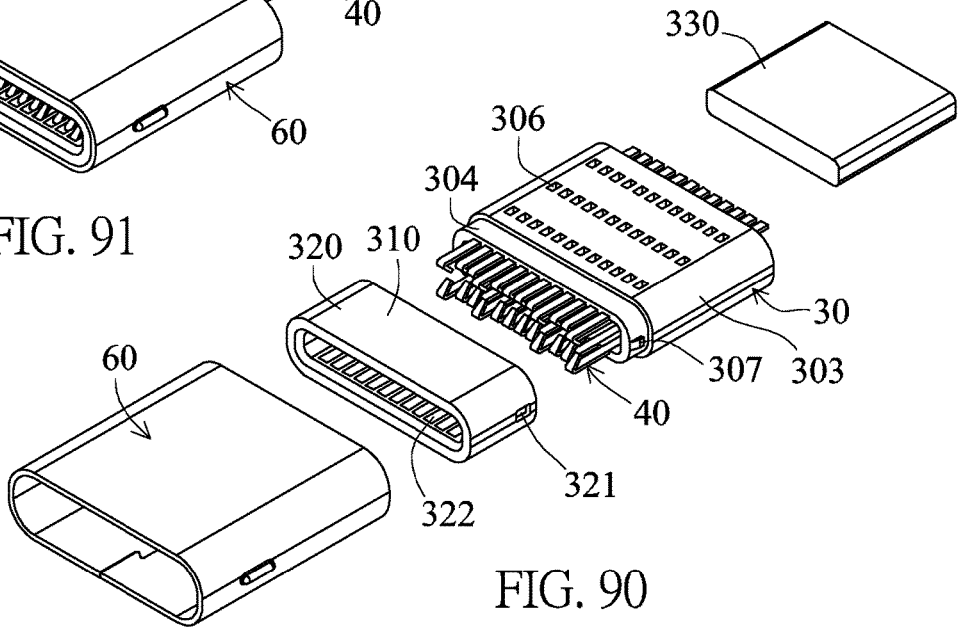
FIG. 90 is a pictorially exploded view according to the 34th embodiment of the invention.
Figure 92:
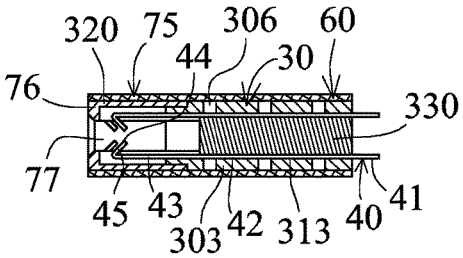
FIG. 92 is a side cross-sectional view according to the 34th embodiment of the invention.
Figure 93:
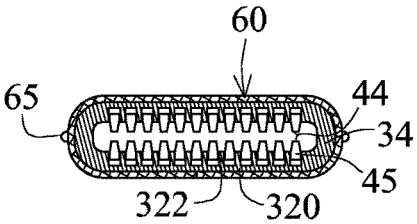
FIG. 93 is a front cross-sectional view according to the 34th embodiment of the invention.

Referring to FIG. 83, the 31st embodiment of the invention provides a transmission cable 290. One end of the transmission cable is connected to a bidirectional duplex electrical connection socket 114, and the other end of the transmission cable is connected to a bidirectional duplex electrical connection plug 123 is almost the same as the 20th embodiment and also relates to bidirectional duplex male-female docking, so that it can be bidirectionally inserted into and connected together with the double-rate transmission. However, this embodiment provides a transmission cable, two contact interfaces of the connector of two ends of the transmission cable are the same as have the same number of connection points. Both of them can have the connection points directly electrically connected together in a one-by-one manner to perform the transmission without the connection point switching integrated device for providing the connection point switching.

The a bidirectional duplex plug and two contact interfaces of the socket of this embodiment mutual docking with each other have the same contact interface and have two contact interfaces having connection points with the circuit serial numbers arranged reversely.

Referring to FIGS. 84 to 87, the 32nd embodiment of the invention provides a transmitter and is almost the same as the 31st embodiment except for the differences that this embodiment uses the circuit board as the transmission medium, that is, the adapter is provided with a housing 80, inside the housing 80 is provided with a circuit board 200, and the bidirectional duplex electrical connection socket 114 and the bidirectional duplex electrical connection plug 123 of two ends of the transmitter are electrically connected to the circuit board 200.

Referring to FIGS. 131 and 132, the 33rd embodiment of the invention provides a bidirectional duplex electrical connection plug 123 and a bidirectional duplex electrical connection socket 114 mutual docking with each other, and is almost the same as the embodiment except for the differences that the external shape of fitting portion 75 of the bidirectional duplex electrical connection plug 123 of this embodiment have two arced sides, the contacts 44 of the two rows of first terminals 40 are vertically aligned, the shape of the connection slot 16 of the bidirectional duplex electrical connection socket 114 have two arced sides, and the contacts 141 of the two rows of first terminals 14 are vertically aligned.

The height of the contact interface substrate 76 of the bidirectional duplex electrical connection plug 123 ranges between 0.65 mm and 0.9 mm, the fitting slot 77 ranges between 0.85 mm and 1.0 mm, the overall height ranges between about 2.2 mm and 2.8 mm, the height of the tongue 121 of the bidirectional duplex electrical connection socket 114 ranges between about 0.75 mm and 0.9 mm, the heights of the two symmetrical spaces of the top and bottom surfaces of the tongue 121 range between 0.7 mm and 0.95 mm, and the height of the connection slot 16 ranges 2.25 mm and 2.85 mm, so that it can be easily manufactured in a slim and light design.

The height of the contact interface substrate 76 of the connection plug 123 of the bidirectional duplex C-TYPE USB electrical of this embodiment is about 0.75 mm, the fitting slot 77 is about 0.9 mm, the overall height is about 2.4 mm, the height of the tongue 121 of the bidirectional simplex C-TYPE USB electrical connection socket 113 is about 0.83 mm, the heights of the two symmetrical spaces of the top and bottom surfaces of the tongue 121 are about 0.83 mm, and the height of the connection slot 16 is about 2.5 mm.

Referring to FIGS. 90 to 93, the 34th embodiment of the invention provides a bidirectional duplex electrical connection plug and is almost the same as the 33rd embodiment except for the differences that: the insulated seat 30 comprises a base seat 303, a fitting member 320 and a insulation plug block 330. The extensions 43 of the two rows of first terminals 40 are elastically movable, the reverse extension sheet 45 is shorter and not elastically movable, the two rows of first terminals 40 are integrally embedded into and injection molded with the base seat, the base seat 303 forms a hollow chamber 313, the fixing portions 42 of each one row of first terminals 40 of the two contact interfaces are respectively arranged on and fixed to the top and bottom surfaces of the hollow chamber 313, the extensions 43 of each one row of first terminals 40 of the two contact interfaces extend out of and in front of the base seat 303, each of the top and bottom surfaces of the base seat 303 is formed with three rows of concave holes 306, each concave hole 306 corresponds to the fixing portion 42 of a first terminal 40, the front end of the base seat 303 is provided with the jointing portion 304, and each of the left and right sides of the jointing portion 304 is provided with an engagement block 307.

In addition, the lengths of the extensions 43 of the each one row of first terminals 40 are different, some extensions 43 of the first terminals 40 are longer.

The fitting member 320 is fitted with the jointing portion 304 of the front end of the base seat 303 and covers the extensions 43 of the two rows of the first terminals 40, the fitting member 320 has two arced sides approaching the rectangular fitting frame mouth, the top and bottom surfaces thereof are two connection plates 310 respectively forming the insulating layers of the two contact interface substrates 76, the fitting slot 77 is formed inside the fitting frame mouth, the inner top and bottom surfaces thereof are provided with separated separation columns to form the separated slots 322 for separating the extensions 43 of the two rows of first terminals 40 of the two contact interfaces, each of two sides of the rear end thereof is provided with an engagement hole 321 engaging with the engagement block 307 of the base seat 303.

The insulation plug block 330 is fitted with the hollow chamber 313 of the base seat 303, the front end of the insulation plug block 330 is formed with a position restricting surface capable of resting against the tongue of the electrical connection socket to provide the restricting function.

Figure 94:
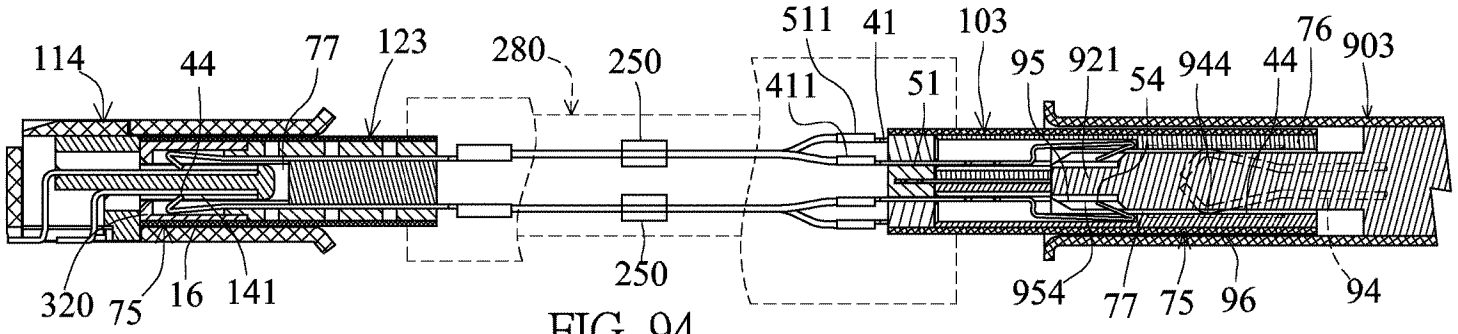
FIG. 94 is a side cross-sectional view according to the 35th embodiment of the invention.

Referring to FIG. 94, the 35th embodiment of the invention provides an adapter cable 280 and is almost the same as the 20th embodiment except for the differences that the bidirectional duplex electrical connection plug 123 connected to one end of the adapter cable 280 of this embodiment is similar to the 34th embodiment, wherein the contacts 44 of the two rows of first terminals 40 are elastically movable, and the contact 141 of a bidirectional duplex electrical connection socket 114 inserted into and connected to the adapter cable is elastically non-movable.

Figure 95:
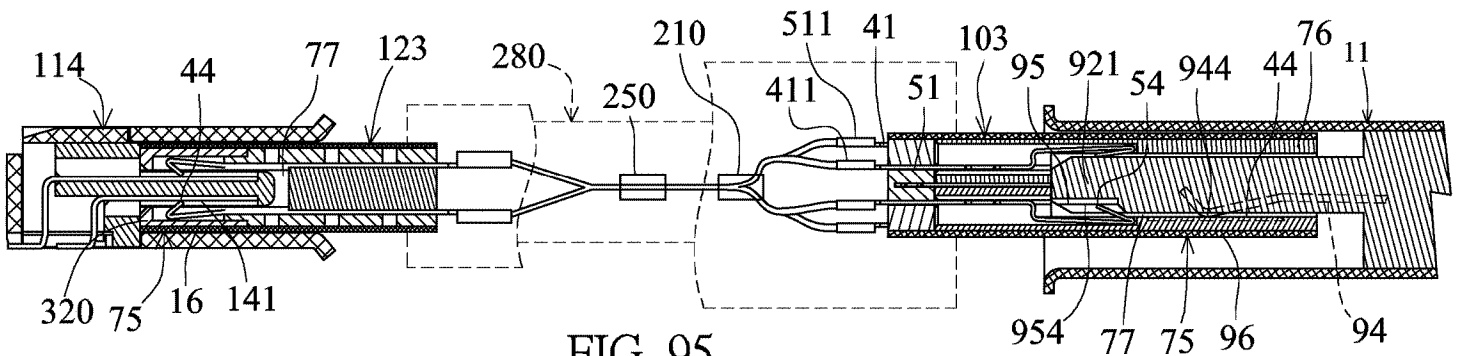
FIG. 95 is a side cross-sectional view according to the 36th embodiment of the invention.
Figure 96:
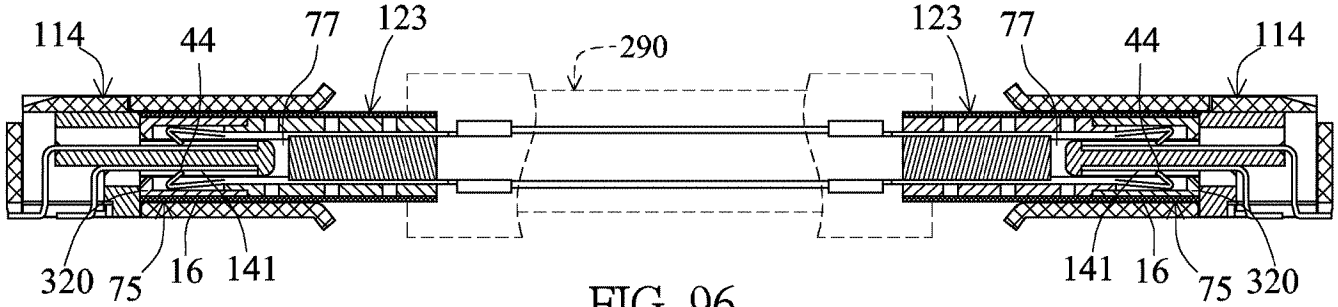
FIG. 96 is a side cross-sectional view according to the 37th embodiment of the invention.

Referring to FIG. 95, the 36th embodiment of the invention provides an adapter cable 280 and is almost the same as the 21st embodiment except for the differences that the bidirectional duplex electrical connection plug 123 connected to one end of the adapter cable 280 of this embodiment is similar to the 34th embodiment, the contacts 44 of the two rows of first terminals 40 are elastically movable, and the contact 141 of a bidirectional duplex electrical connection socket 114 inserted into and connected to the adapter cable is elastically non-movable. Referring to FIG. 96, the 37th embodiment of the invention provides a transmission cable 290 and is almost the same as the 21st embodiment except for the differences that the bidirectional duplex electrical connection plug 123 connected to one end of the transmission cable 290 of this embodiment is similar to the 34th embodiment, the contacts 44 of the two rows of first terminals 40 are elastically movable, and the contact 141 of a bidirectional duplex electrical connection socket 114 inserted into and connected to the adapter cable is elastically non-movable.

Figure 97:
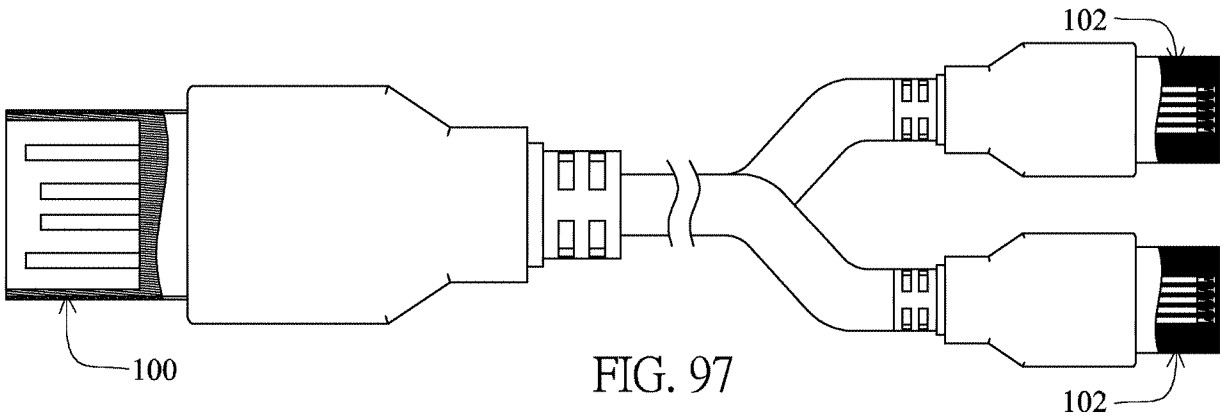
FIG. 97 is a top cross-sectional view according to the 38th embodiment of the invention.
Figure 97A:
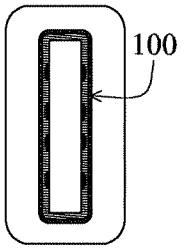
FIG. 97A is a front cross-sectional view showing a plug on one end according to the 38th embodiment of the invention.

Referring to FIGS. 97 and 97A, the 38th embodiment of the invention provides an adapter cable. One end of the adapter cable is connected to a bidirectional duplex USB 2.0 electrical connection plug 100, and the other end of the adapter cable is adapted to the two bidirectional duplex MICRO USB electrical connection plugs 102.

Figure 98:
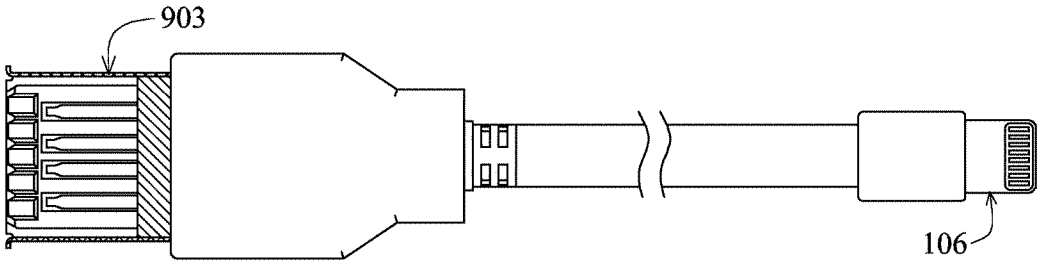
FIG. 98 is a top cross-sectional view according to the 39th embodiment of the invention.
Figure 98A:
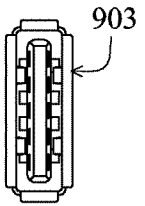
FIG. 98A is a front cross-sectional view showing a plug on one end according to the 39th embodiment of the invention.

Referring to FIGS. 98 and 98A, the 39th embodiment of the invention provides an adapter cable. One end of the adapter cable is connected to a bidirectional duplex USB 4.0 electrical connection socket 903, and the other end of the adapter cable is adapted to an APPLE bidirectional duplex electrical connection plug 106.

Figure 99A:
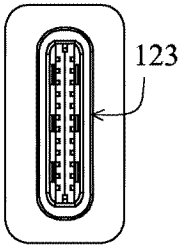
FIG. 99A is a front cross-sectional view showing a plug on one end according to the 40th embodiment of the invention.

Referring to FIGS. 99 and 99A, the 40th embodiment of the invention provides an adapter cable. One end of the adapter cable is connected to the bidirectional duplex electrical connection plug 123 of the 34th embodiment, and the other end of the adapter cable is adapted to an APPLE bidirectional duplex electrical connection plug 106.

Figure 100:
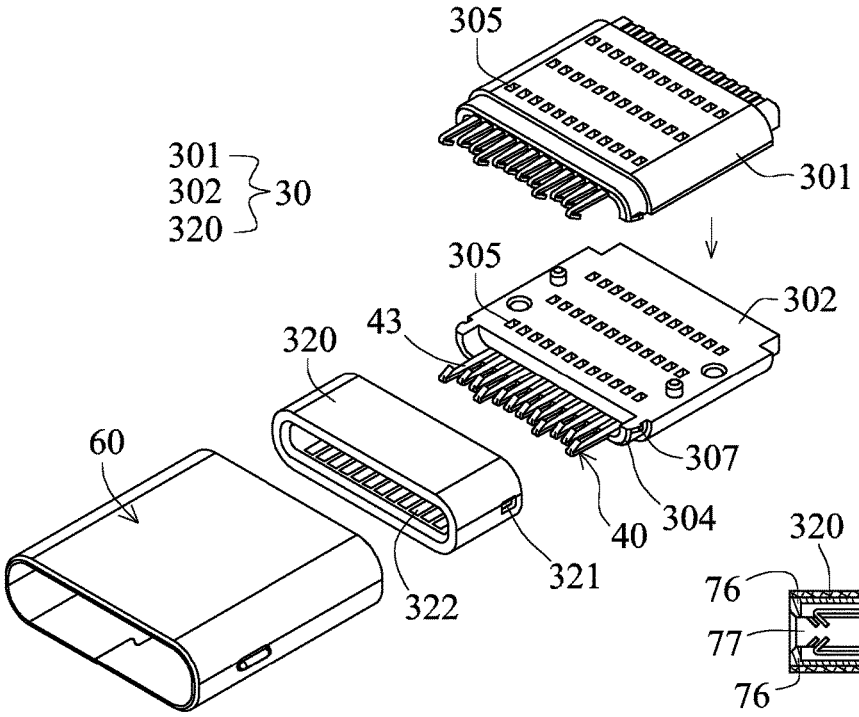
FIG. 100 is a pictorially exploded view according to the 41st embodiment of the invention.
Figure 101:
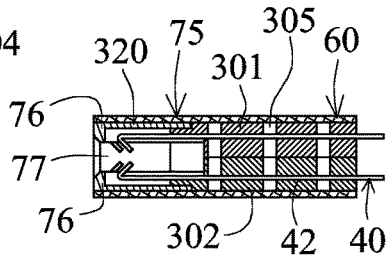
FIG. 101 is a side cross-sectional view according to the 41st embodiment of the invention.

Referring to FIGS. 100 and 101, the 41st embodiment of the invention provides a bidirectional duplex electrical connection plug and is almost the same as the 34th embodiment except for the differences that: the base seat of the insulated seat 30 is formed by an upper seat 301 and a lower seat 302 stacked vertically, and the upper seat 301 and the lower seat 302 are integrally embedded into and injection molded with the one row of first terminals 40, respectively. Each of the upper seat 301 and the lower seat 302 is formed with three rows of perforating holes 305, each perforating hole 305 corresponds and passes through to the fixing portion 42 of a first terminal 40 (that is, some fixing portions 42 of the two rows of first terminals 40 are respectively embedded into the upper and lower seats 301 and 302), and each perforating hole 305 is formed with a concave hole on the top and bottom surfaces of the upper and lower seats.

In addition, the jointing portion 304 of the front end of the base seat is a hollow frame body, which is formed by stacking the inverse-U shaped frame body and the U-shaped frame body together so that the extensions 43 of the two rows of first terminals 40 may have the shorter elastically movable arm of force, and that the contact 44 has the larger normal force.

Figure 102:
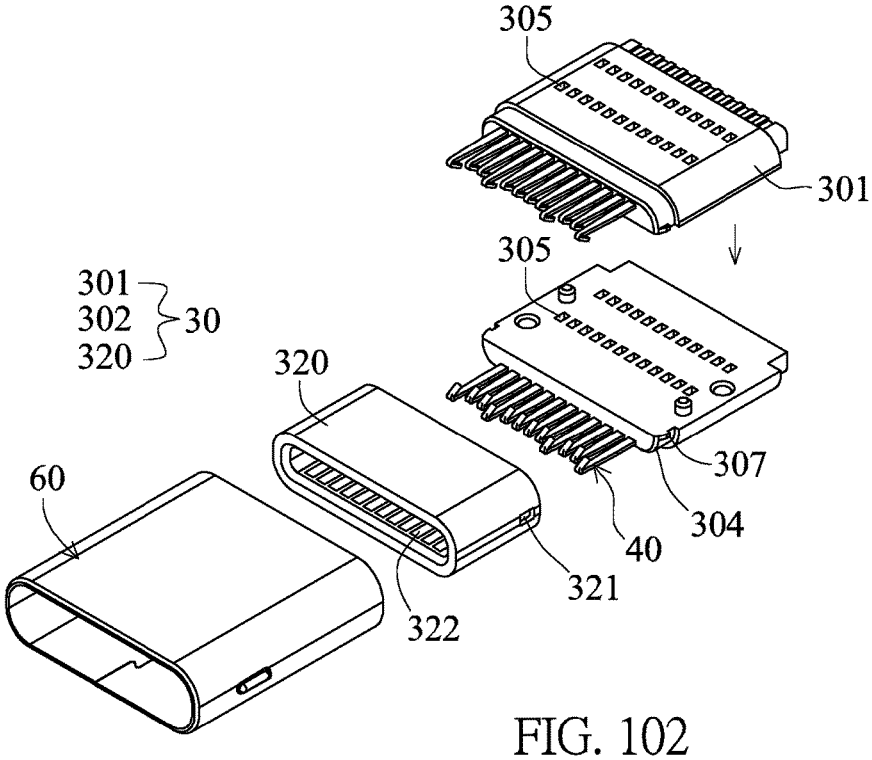
FIG. 102 is a pictorially exploded view according to the 42nd embodiment of the invention.
Figures 103, 103A, 104:
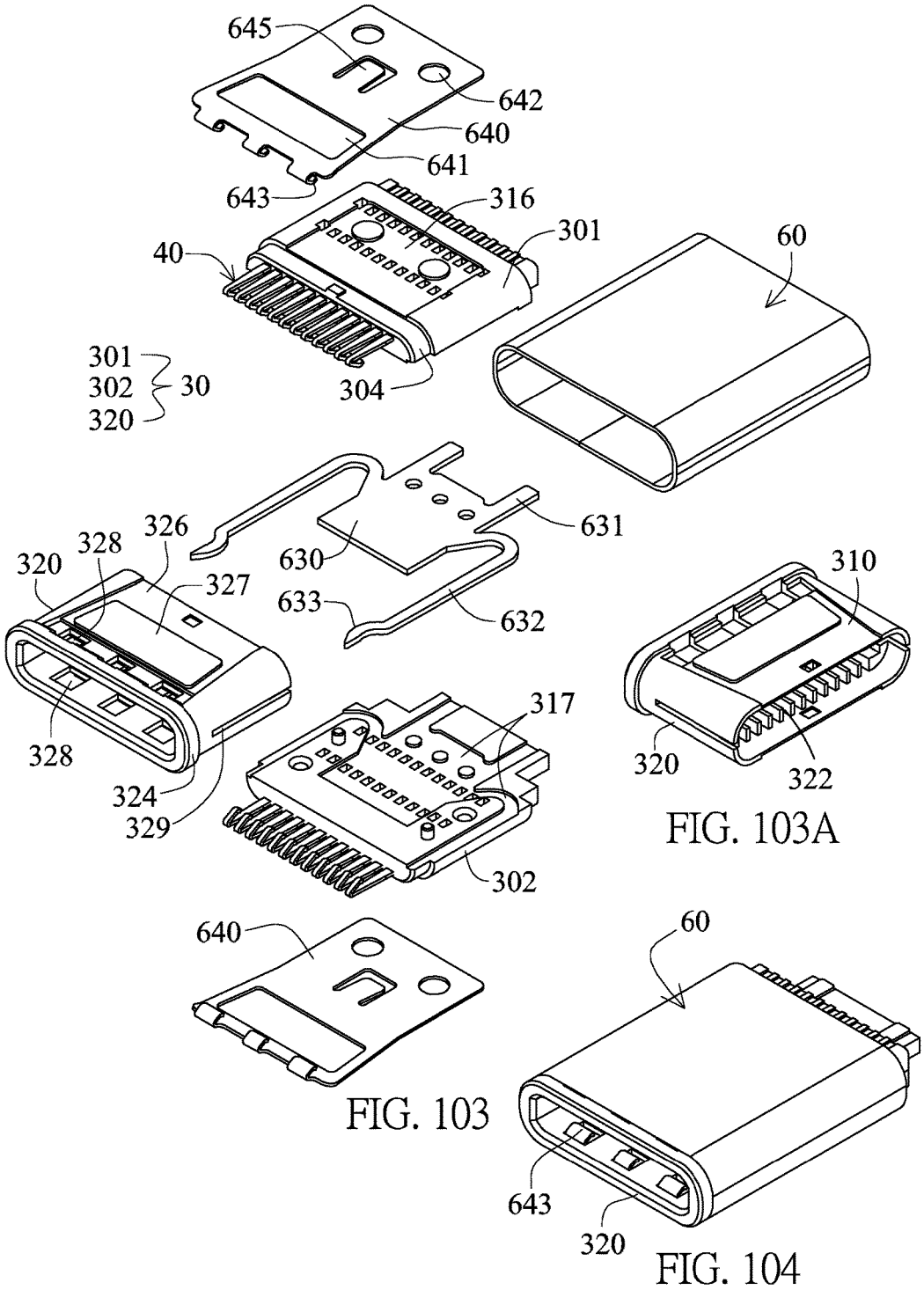
FIG. 103 is a pictorially exploded view showing the plug according to the 43rd embodiment of the invention.
FIG. 103A is a pictorial view showing the fitting member of the plug according to the 43rd embodiment of the invention.
FIG. 104 is a pictorially assembled view showing the plug according to the 43rd embodiment of the invention.
Figure 105:
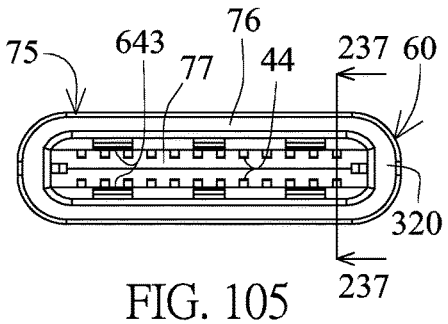
FIG. 105 is a stereoscopic front view showing the plug according to the 43rd embodiment of the invention.
Figure 106:
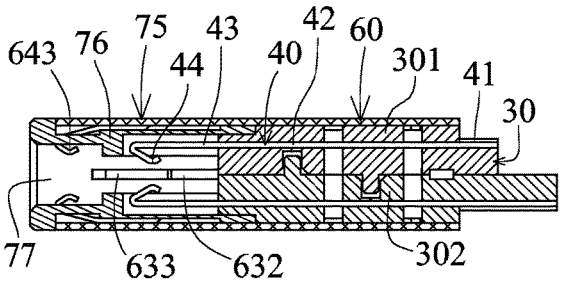
FIG. 106 is a side cross-sectional view showing the plug according to the 43rd embodiment of the invention.
Figure 107:
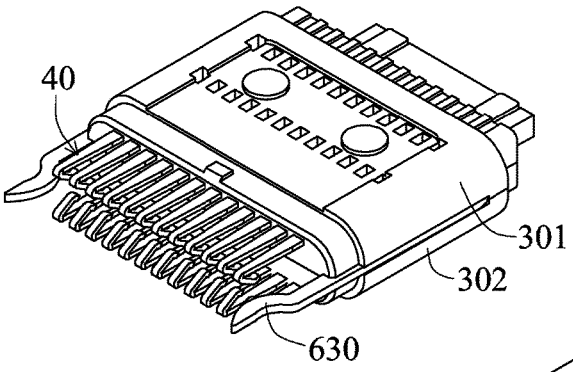
FIG. 107 is a pictorially assembled view showing the upper seat, the metal partition plate and the lower seat of the plug according to the 43rd embodiment of the invention.
Figure 108:
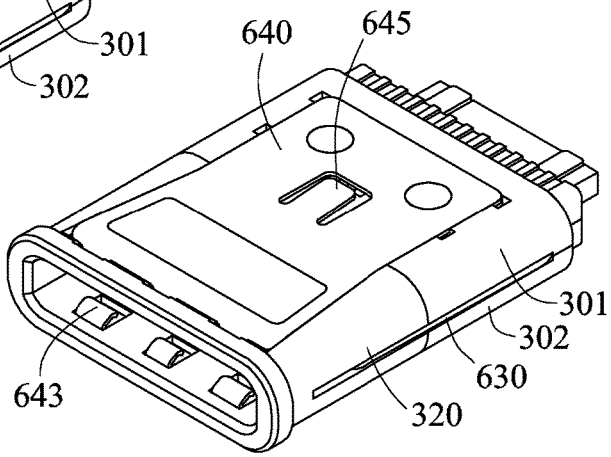
FIG. 108 is a pictorially assembled view showing the plug according to the 43rd embodiment of the invention (when the metal housing is not assembled).
Figures 109, 110:
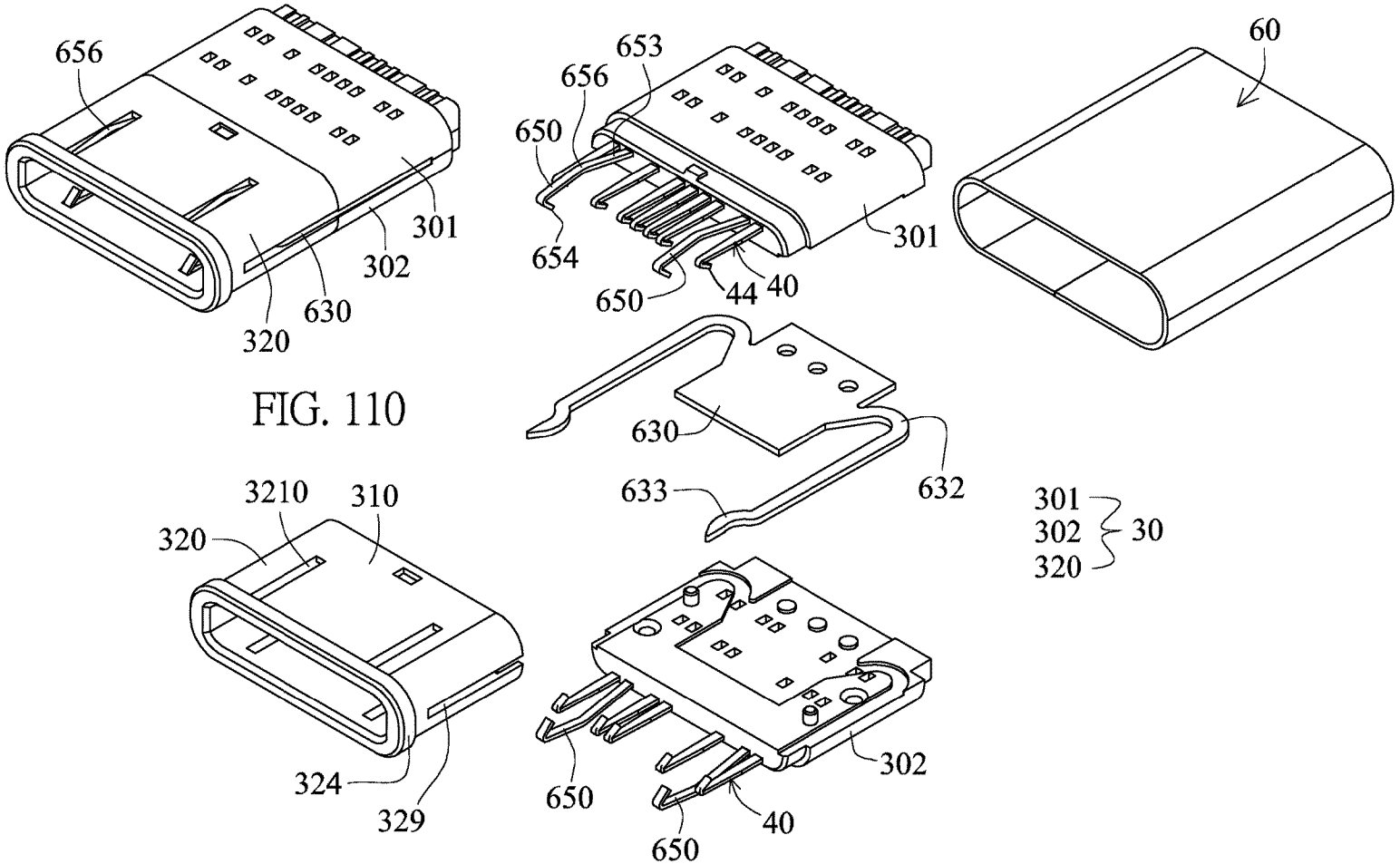
FIG. 109 is a pictorially exploded view according to the 44th embodiment of the invention.
FIG. 110 is a pictorially assembled view according to the 44th embodiment of the invention.
Figure 111:
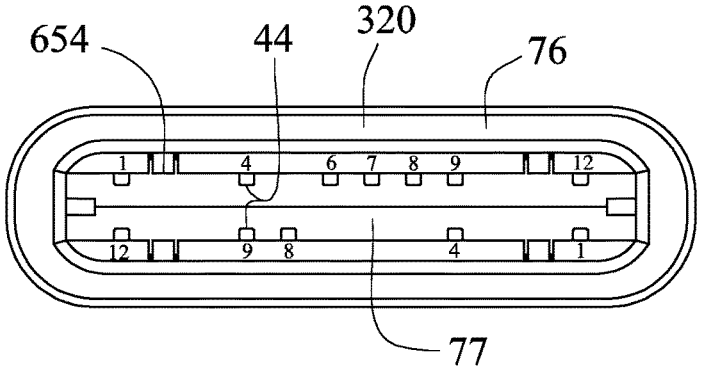
FIG. 111 is a front view according to the 44th embodiment of the invention.
Figure 112:
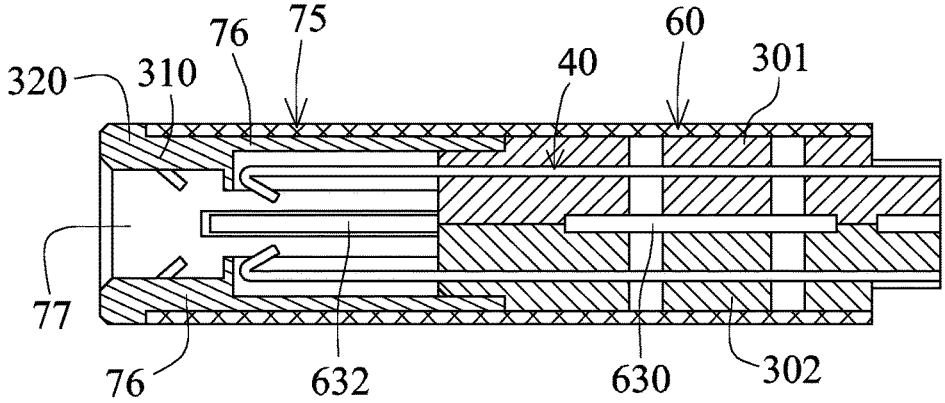
FIG. 112 is a side cross-sectional view according to the 44th embodiment of the invention.
Figure 113:
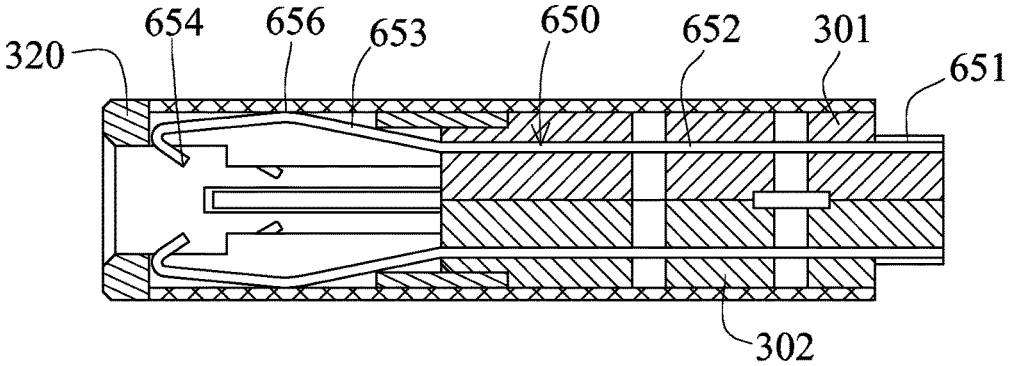
FIG. 113 is a side cross-sectional view according to the 44th embodiment of the invention.

Referring to FIG. 102, the 42nd embodiment of the invention provides a bidirectional duplex electrical connection plug and is almost the same as the 41st embodiment except for the differences that the jointing portion 304 of the front end of the base seat of the insulated seat 30 is physical, so that the length of the fitting member 320 needs to be longer than that of the 41st embodiment. In addition, the extensions 43 of the two rows of first terminals 40 also need the longer elastically movable arm of force, so that the extensions 43 of the two rows of first terminals 40 have the better resilience, but the normal force of the contact 44 is decreased.

Referring to FIGS. 103 to 108, the 43rd embodiment of the invention provides a bidirectional duplex C-TYPE USB electrical connection plug and is almost the same as the 42nd embodiment except for the differences that this embodiment is further provided with two grounding elastic sheets 640 and a metal partition plate 630.

Each of outer sides of the upper and lower seats 301 and 302 of the base seat of the insulated seat 30 is provided with a concave surface 316 and two convex circles, and each of the inner surfaces is provided with a concave surface 317 and three convex circles.

Each of the two connection plates 310 of the fitting member 320 is provided with a concave surface 326. Inside the concave surface 326 is provided with a relatively projecting convex surface 327. The front section of the concave surface 326 is provided with three openings 328, each of left and right sides is provided with a notch 329, the front end of the fitting member 320 is provided with a projecting ring 324, and the projecting ring 324 relatively projects beyond the convex surface 327 and is flush with the metal housing 60. In addition, the fitting slot 77 formed in the fitting member 320 have the front section and the rear section lower than the front section.

The metal partition plate 630 is assembled with the concave surfaces 317 of the inner surfaces of the upper and lower seats 301 and 302 and positioned between the upper and lower seats 301 and 302. The rear end of the metal partition plate 630 is integrally provided with two pins 631, and each of the left and right sides is integrally provided with a resilient snap 632. The resilient snaps are provided with projections 633 disposed on the left and right sides of the fitting slot 77. The two resilient snaps 632 contact the metal housing 60 and stretches into the fitting slot 77 from the notches 329 of the left and right sides of the fitting member 320.

The two grounding elastic sheets 640 are assembled with and locked to the concave surfaces 316 of outer sides of the upper and lower seats 301 and 302 and the concave surfaces 326 of the top and bottom surfaces of the fitting member 320, respectively. The grounding elastic sheet 640 is in the form of a plate sheet, the front section thereof is provided with an opening 641 engaging with the convex surface 327 of the fitting member 320, and the rear section thereof is provided with two openings 642 engaging with two convex circles of the concave surfaces 316 of outer sides of the upper and lower seats 301 and 302. The middle section thereof is provided with a projecting elastic sheet 645 resiliently resting against the metal housing 60. The front end thereof is provided with three projecting and vertically elastically movable contacts 643. Three contacts 643 of the two grounding elastic sheets 640 respectively pass through the three openings 328 of the top and bottom surfaces of the fitting member 320 and project beyond the front section of the insulating layers of the two contact interface substrates 76 and are disposed on the front section of the fitting slot 77. The contact 44 of the contact interface projects beyond the inner surface of the contact interface substrate 76 by a level higher than the contact 643 of the grounding elastic sheet 640.

The plug of this embodiment can bidirectionally dock with a socket to form the same electrical connection, so that the usage is very convenient, and the plug and the socket have the electrical connection of the duplex contact interface, and the double-rate transmission or charging effect can further be achieved.

Each of the two rows of first terminals 40 of the plug of this embodiment have 12 terminals continuously and separated arranged, so that the plug is a full-function type plug having the charging, data transmission and audio/video transmission functions.

Referring to FIGS. 109 to 113, the 44th embodiment of the invention provides a bidirectional duplex C-TYPE USB electrical connection plug and is almost the same as the 43rd embodiment except for the differences that the one row of first terminals 40 of the upper and lower seats 301 and 302 of the base seat of the insulated seat 30 of this embodiment are not equally spaced, and have the needle-jumping arrangement. As shown in FIG. 205, the numbers of the contacts of the two contact interfaces are not the same, the upper row has seven connection points with the circuit serial numbers 1, 4, 6, 7, 8, 9, 12, the lower row has five connection points with the circuit serial numbers 12, 9, 8, 4, 1. The contact interface with the fewer contacts completely corresponds to the contact interface with the more contacts and both have the connection points with the circuit serial numbers arranged reversely, that is, the contact interface with the more contacts completely contains the contact interface with the fewer contacts.

The contacts 44 of the two contact interfaces have the connection points with the circuit serial numbers 1, 4, 8, 9, 12 pertain to the charging contact interface, and the contacts 44 added to the upper row have the connection points with the circuit serial numbers 6 and 7 pertain to the contact interface for USB 2.0 data transmission.

Because the one row of first terminals 40 of the upper and lower seats 301 and 302 have the needle-jumping arrangement and are not equally spaced, two grounding elastic sheets 650 may be embedded into and disposed at each of the needle-jumping positions. The grounding elastic sheet 650 is provided with a pin 651, a fixing portion 652 and an extension 653. The fixing portion 652 is fixed to the upper and lower seats 301 and 302. The extension 653 is vertically elastically movable and provided with a fulcrum 656 resting against the metal housing 60. The extension 653 in front of the fulcrum 656 does not rest against the metal housing 60 and is provided with a projecting contact 654 projecting toward the fitting slot 77. When the contact 654 is pressed to move toward the metal housing 60 elastically, the action of the fulcrum 656 makes the contact 654 have the larger normal force.

Each of the two connection plates 310 of the fitting member 320 is provided with two openings 3210 to provide the spaces for the fulcrum 656 of the grounding elastic sheet 650 projectingly resting against the metal housing 60.

Each of the upper and lower two grounding elastic sheets 650 and the one row of terminals 40 are formed by pressing the same metal sheet. So, the fixing portions 652 of the two grounding elastic sheets 650 and the fixing portions 42 of the one row of terminals 40 are at the same height.

The two rows of first terminals of the 43rd embodiment are arranged in the equally spaced manner, without needle-jumping arrangement. So, the one row of contacts 44 have the connection points with the circuit serial numbers 1 to 12 arranged in the equally spaced and continuous manner and have the full-needle function design. However, the contacts 44 of the two contact interfaces of this embodiment have the needle-jumping design and are not arranged in the equally spaced and continuous manner, or even comprise the USB 2.0 data transmission and charging function and are not the full-needle and full-function design. However, the two contact interfaces of the two embodiments have the connection points with the same circuit serial numbers have the same arrangement positions. So, the plugs of the two embodiments can dock with a bidirectional duplex C-TYPE USB electrical connection socket.

Figure 114:
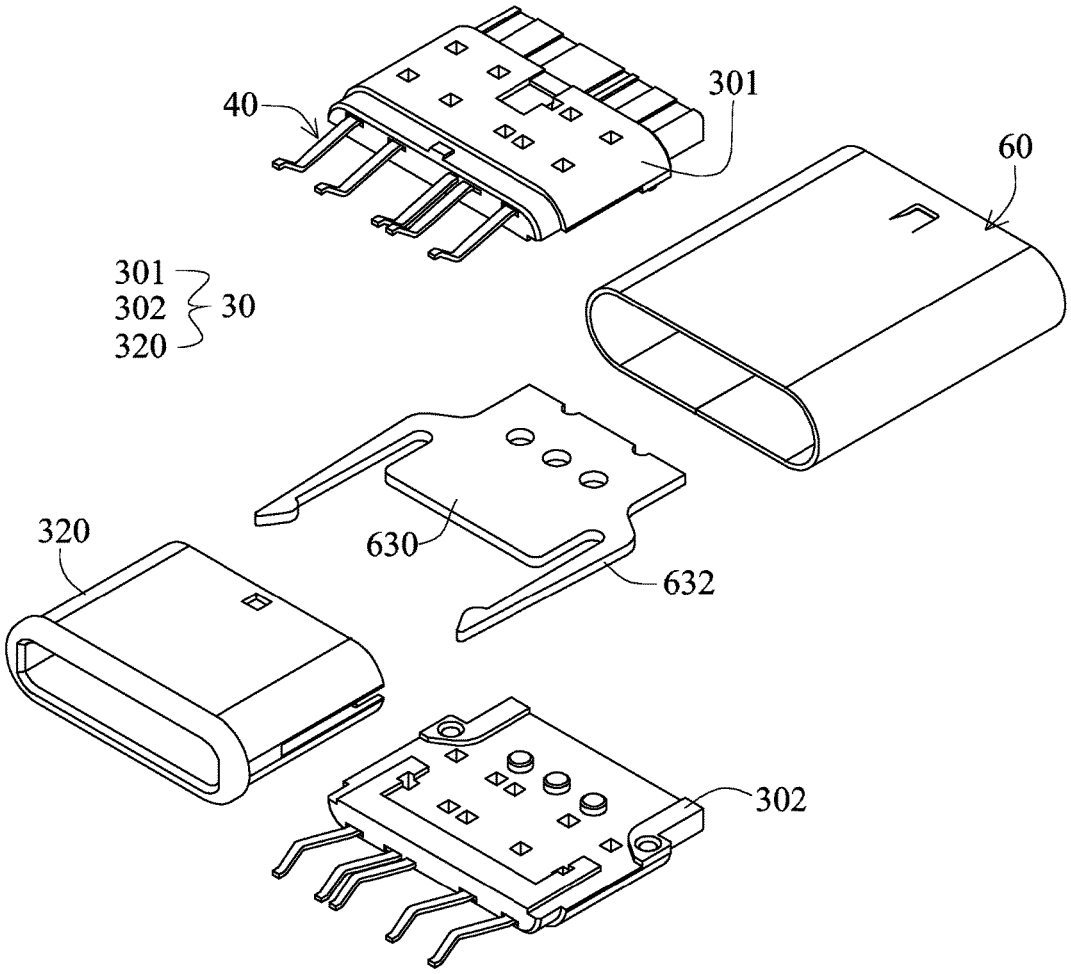
FIG. 114 is a pictorially exploded view according to the 45th embodiment of the invention.
Figure 115:
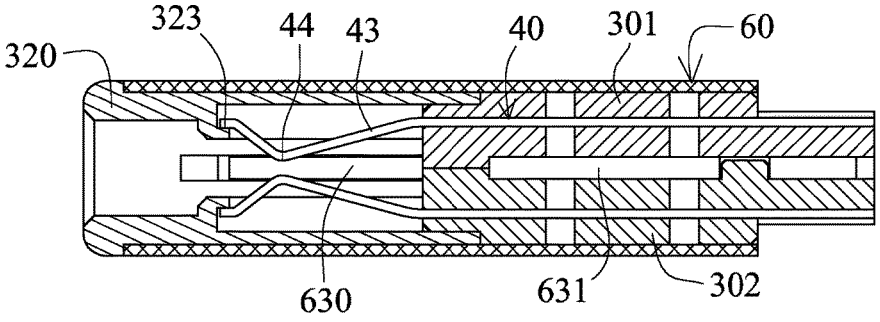
FIG. 115 is a side cross-sectional view according to the 45th embodiment of the invention.

Referring to FIGS. 114 and 115, the 45th embodiment of the invention provides a bidirectional duplex C-TYPE USB electrical connection plug and is almost the same as the 44th embodiment, and is also the charging-type plug except for the differences that inside the fitting member 320 of this embodiment is provided with a position restricting surface 323, the plate surface of the extensions 43 of the two rows of first terminals 40 is curved to project beyond the contact 44, and the front end of the extension 43 rest against the position restricting surface 323 in an overpressure manner.

Figure 116:
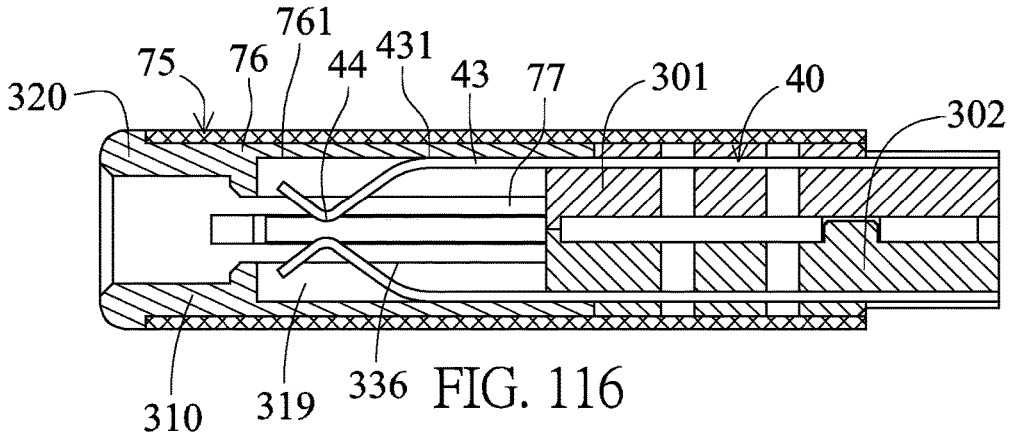
FIG. 116 is a side cross-sectional view according to the 46th embodiment of the invention.

Referring to FIG. 116, the 46th embodiment of the invention provides a bidirectional duplex C-TYPE USB electrical connection plug and is almost the same as the 43rd embodiment, wherein the 44th embodiment and the 45th embodiment may be of the full-function type, data transmission charging-type or charging-type.

Figure 117:
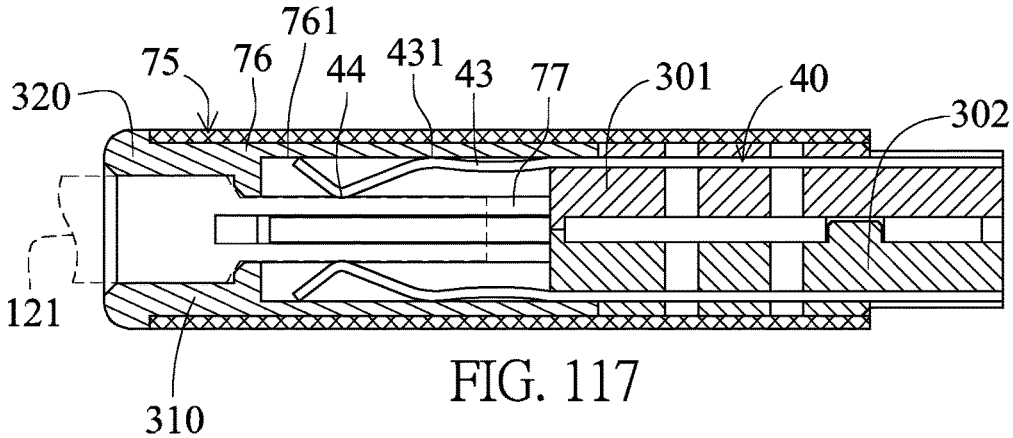

The differences reside in that the insulating layer of the contact interface substrate 76 of this embodiment is a connection plate 310, the inner surface of the connection plate 310 is a connection surface 336, the fitting slot 77 is disposed between two connection surfaces 336, the connection plate 310 is provided with the elastic movement slot 319 depressed from the connection surface 336, the connection plate 310 is provided with a resting surface 761, a bottom surface of the elastic movement slot 319 having an insulating layer structure is separated from the metal housing, and a bottom surface of the elastic movement slot 319 is the resting surface 761, the extension 43 disposed on an inner end of each of the contacts 44 of the one row of first terminals 40 of the contact interface is provided with a fulcrum 431 resting against the resting surface 761, the extension 43 disposed on an inner end of the fulcrum 431 is in flat surface contact with the resting surface 761, and the extension 43 disposed on an outer end of the fulcrum 431 does not rest against the resting surface 761. Referring to FIG. 117, when the fitting slot 77 is combined with the tongue 121 of the socket and the contact 44 is pressed to move toward the resting surface 761 elastically, the action of the fulcrum 431 makes the contact 44 have the larger normal force, while the extension 43 disposed on an inner end of the fulcrum 431 moves elastically and reversely, so that the good resilience is possessed.

Figure 118:
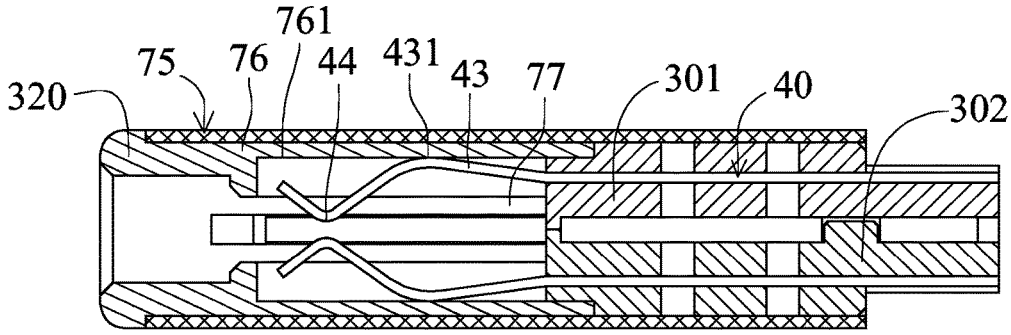

Referring to FIG. 118, the 47th embodiment of the invention provides a bidirectional duplex C-TYPE USB electrical connection plug and is almost the same as the 46th embodiment except for the differences that the extension 43 disposed on an inner end of the fulcrum 431 of each of the one row of first terminals 40 of the contact interface of this embodiment is not in flat surface contact with the resting surface 761.

Figure 119:
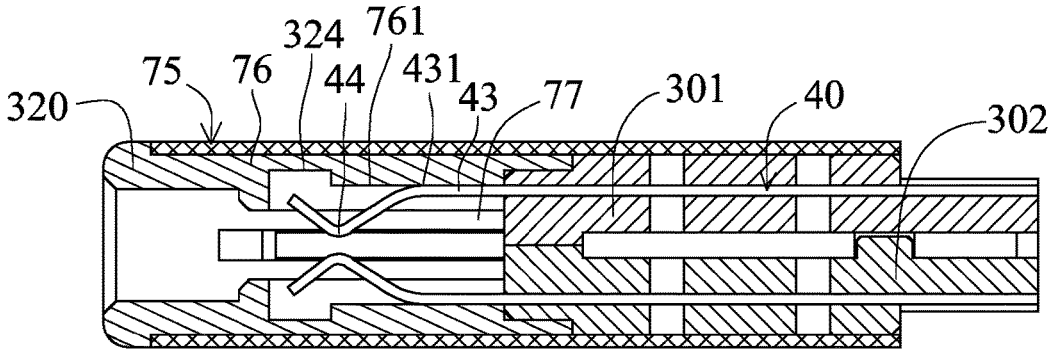

Referring to FIG. 119, the 48th embodiment of the invention provides a bidirectional duplex C-TYPE USB electrical connection plug and is almost the same as the 47th embodiment except for the differences that the resting surface 761 of this embodiment is closer to the fitting slot 77. Thus, the insulating layer of the contact interface substrate 76 needs to be provided with a concave portion 324 to provide the space for the front end of the extension 43 of the first terminal 40.

Figure 119A:
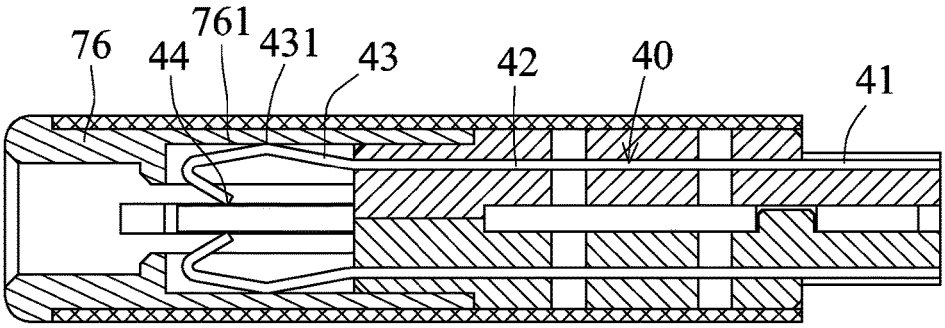

Referring to FIG. 119A, the 49th embodiment of the invention provides a bidirectional duplex C-TYPE USB electrical connection plug and is almost the same as the 47th embodiment except for the differences that the distal end of the extension 43 of the first terminal 40 of this embodiment is bent reversely and inwards, and that the cut surface of distal end forms the contact 44.

In addition, the bidirectional electrical connectors on two ends of either the adapter cable or the adapter may be sockets or plugs, may have one single contact interface or dual contact interfaces, and the contact interfaces of both of them are provided with elastically non-movable contacts or are fully the elastically non-movable contacts.

The above-mentioned various embodiments substantially relate to the application where the connection cable or adapter cable is inserted into and connected to the plug. However, the invention still can be applied to many other electronic devices, such as a plug to be inserted for connection, wherein the plug may be a mobile disk, wireless transceiver, adapted electrical connector, IC controller, electric home apparatus or the like.

In addition, because the bidirectional duplex plug or socket of the invention has two contact interfaces, the Schottky diode anti-short-circuit or anti-current flow are also used to provide the circuit safety protection. However, there may also be many methods, such as the provision of the anti-current flow electrical element or anti-short-circuit electrical element or circuit safety protection element or safety circuit provision means, to achieve the circuit safety protection effect. The anti-short-circuit or anti-current flow circuit protection and circuit safety protection are provided in application serial no. 201120320657.8 and 201020547846.4, and detailed descriptions thereof will be omitted.

In addition, TW201315149 has mentioned the associated circuit and structure of the electronic circuit control protection device of the dual-orientation plug with the reverse detecting and sensing of the orientation; TW201333744 has mentioned the circuit protection and associated circuit and structure relating to the dual-orientation plug connector applied to the dual-orientation plug adapter and circuit protection/detection sensing orientation circuit control system of the electronic device adapter; TW201411329 has mentioned the dual-orientation plug connector used in the adapter of a portable electrical element, wherein two connectors are connected to any one distal end of the adapter cable, one of the two connectors can accommodate the circuits and structures of the identification element and the electric power control element; TW201332232 has mentioned the circuit detection control means and associated protection circuit and structure of the dual-orientation plug; TW201223007 and CN103140995 have also mentioned the orientation detection and safety protection electronic circuits for the bidirectional plug structure.

The technological characteristics of the above-mentioned published patents may be applied to the invention, and detailed descriptions thereof will be omitted.

Figure 121:
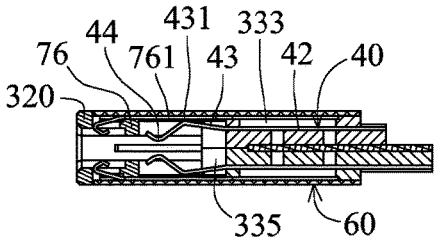
Figure 120:
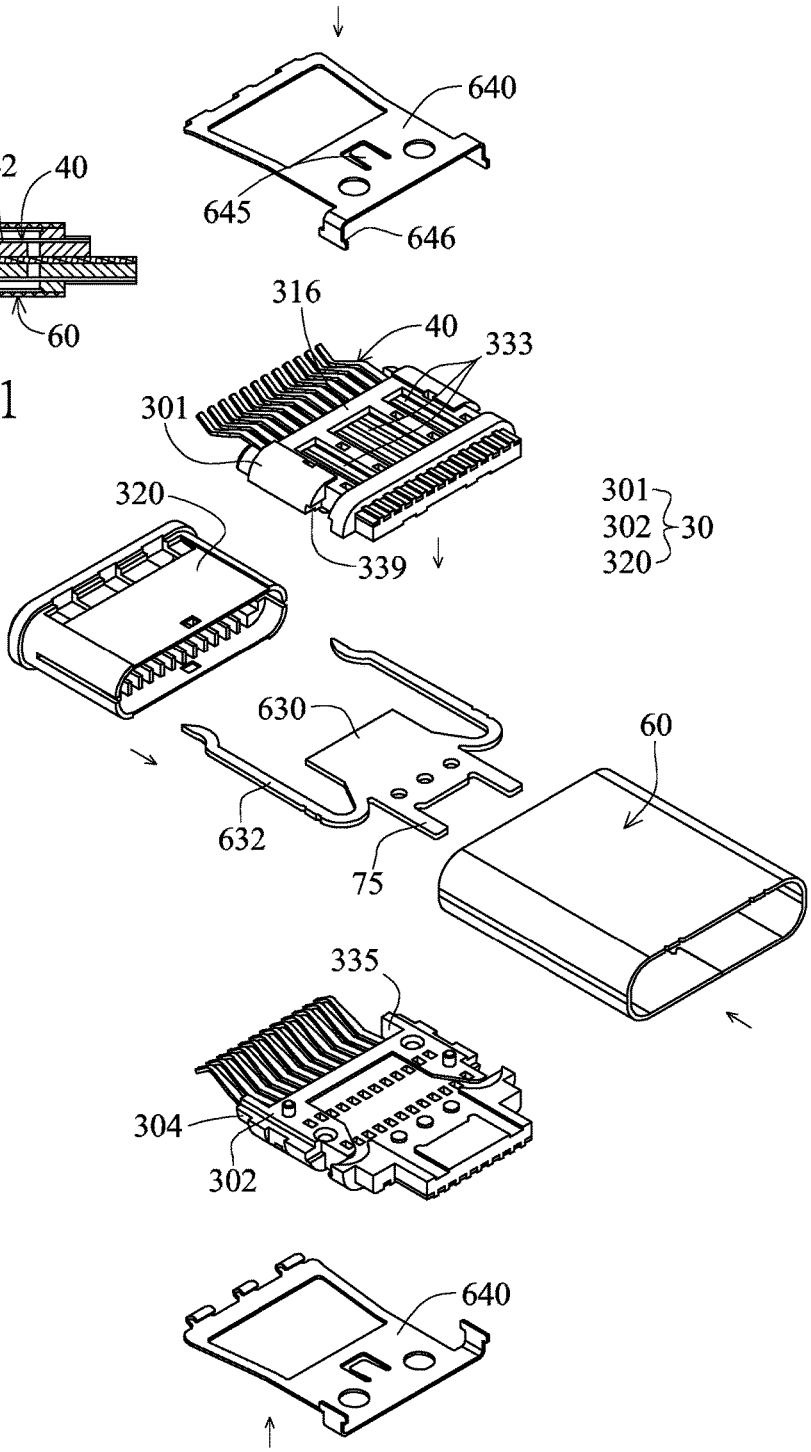

Referring to FIGS. 120 and 121, the 50th embodiment of the invention provides a bidirectional duplex C-TYPE USB electrical connection plug and is almost the same as the 42nd embodiment and the 47th embodiment except for the differences that the concave surface 316 of the outer side of each of the upper and lower seats 301 and 302 of the base seat of the insulated seat 30 of this embodiment is provided with an opening 333, the opening 333 is partitioned into three regions and can expose most of the fixing portions 42 of the multiple terminals 40. Thus, the better electric effect is obtained.

The jointing portion 304 of the base seat only leave two arced sides and the middle section is in the form of a notch 335, so that the extensions 43 of the two rows of terminals 40 are longer to have the good resilience.

The two sides of the upper and lower seats 301 and 302 are provided with two locking portions 339 for upward restricting and downward restricting, respectively. Each of two sides of the rear sections of the two grounding elastic sheets 640 is bent projectingly to provide an engaging-connecting portion 646. The projecting direction of the engaging-connecting portion 646 is reverse to the elastic sheet 645, the engaging-connecting portions 88 of the two grounding elastic sheets 640 respectively engage with the locking portions 339 of the upper and lower seats 301 and 302 to provide the upward restricting and downward restricting, respectively.

Figure 123:
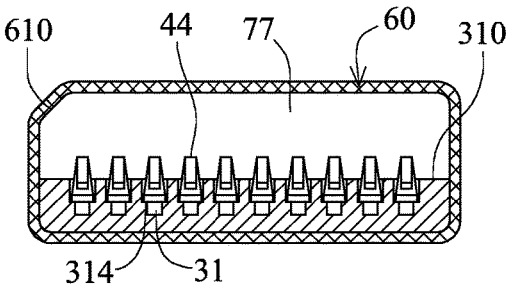
Figure 122:
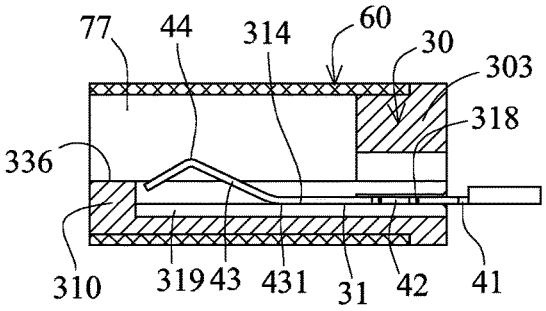
Figure 124:
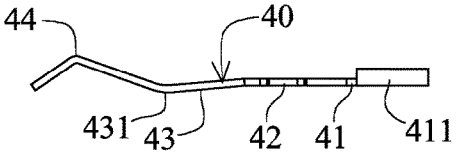

Referring to FIGS. 122 to 124, the 51st embodiment of the invention provides a simplex electrical connection plug comprising an insulated seat 30, one row of first terminals 40 and a metal housing 60.

The insulated seat 30 is provided with a base seat 303, a connection plate 310 and one row of first terminal slots 31. The connection plate 310 extends out of the front end of the base seat 303. The first terminal slot 31 extends to the connection plate 310 form the rear end of the base seat 303, is provided with the locking slot 318 in the base seat 303, and is provided with the elastic movement slot 319 in the connection plate 310, wherein the bottom surface of the elastic movement slot 319 having the insulating layer structure is separated from the metal housing.

The metal housing 60 covers the insulated seat 30. The top and bottom surfaces of the base seat 303 and one surface of the connection plate 310 rest against the metal housing 60. Inside the metal housing 60 forms a fitting slot 77. The other surface of the connection plate 310 is provided with the connection surface 336 facing the fitting slot 77. In addition, the upper left angle of the metal housing 60 has an inclined edge 610 for mistake-proof.

The one row of first terminals 40 are assembled with one row of first terminal slots 31 of the insulated seat 30. The first terminal 40 is provided with a pin 41, a fixing portion 42 and an extension 43. The fixing portion 42 is fixed to the locking slot 318. The extension 43 is connected to one end of the fixing portion 42 and is vertically elastically movable in the elastic movement slot 319 and is bent to provide a contact 44 projecting beyond the connection surface 336 of the connection plate 310. The pin 41 is connected to the other end of the fixing portion 42 and extends out of the rear end of the insulated seat 30, and the pin 41 is provided with clamp portion 411 for clamping wires.

The characteristics of this embodiment reside in that the insulated seat is provided with a resting portion 314, the resting portion 314 is in the form of multiple resting planes, the resting portion 314 is disposed on two sides of each first terminal slot 31 of the connection plate 310, is depressed from the connection surface 336, flush with the locking slot 318 and is higher than the bottom surface of the first terminal slot 31. The extension disposed on the inner end of each of the contacts 431 of the one row of first terminals 40 is provided with a fulcrum 431 resting against the resting portion 314. The extension 43 disposed on an outer end of the fulcrum 431 does not rest against the resting portion 314, so that the elastically movable arm of force of the extension 43 has the middle section fulcrum structure. When the contact 44 is pressed to move toward the resting portion 314 elastically, the extension 43 disposed on an inner end of the fulcrum 431 elastically moves reversely, and the action of the fulcrum 431 makes the contact 44 have the larger normal force. However, because the extension 43 disposed on the inner end of the fulcrum 431 still can elastically move reversely, the good resilience can be achieved. The contact 44 of the embodiment is pressed, the elastically moving state of the extension 43 is shown in FIG. 117.

Referring to FIG. 124, the inner section of the fulcrum 431 of the extension 43 of the first terminal 40 is straight and is bent toward the resting portion 314 at a negative angle relative to the fixing portion 42. Referring to FIG. 122, when the first terminal 40 is assembled with the first terminal slot 31, the extension 43 disposed on the inner end of the fulcrum 431 of the first terminal 40 resiliently rests against the resting portion 314 in an overpressure manner.

Figure 126:
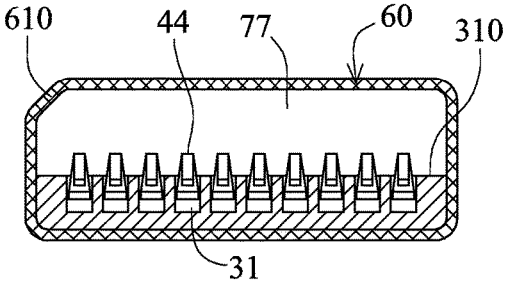
Figure 125:
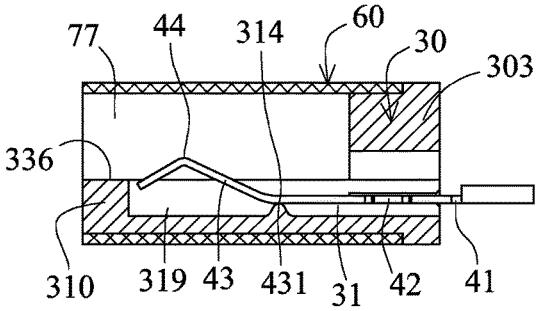

Referring to FIGS. 125 and 126, the 52nd embodiment of the invention provides a simplex electrical connection plug and is almost the same as the 51st embodiment except for the differences that the resting portion 314 are multiple projecting points disposed in each first terminal slot 31 of the connection plate 310.

Figure 127:
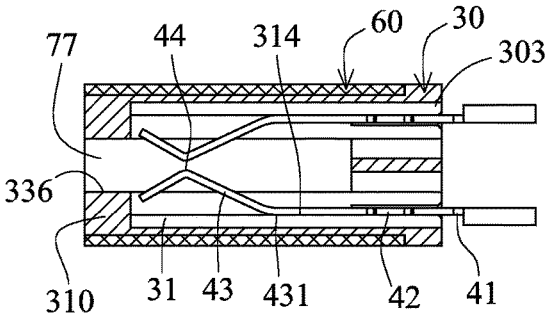

Referring to FIGS. 127 and 128, the 53rd embodiment of the invention provides a bidirectional duplex electrical connection plug and is almost the same as the 51st embodiment except for the differences that there are two connection plates 310 of the insulated seat 30 assembled and provided with two rows of first terminals 40. The fitting slot 77 is disposed between the two connection plates 310. One surface of the two connection plates 310 rests against the metal housing 60 and the other surface of the two connection plates 310 is provided with the connection surface 336 facing the fitting slot 77. Each connection surface 336 of the connection plate 310 projects beyond the contacts 44 of the one row of first terminals 40. The contacts 44 of the two rows of first terminals 40 have the same contact interface and have the connection points with the circuit serial numbers arranged reversely. The top, bottom, left and right portions of the metal housing 60 correspond thereto, so the connector of this embodiment may be bidirectionally inserted into and connected to a socket.

Referring to FIGS. 129 to 131, the 54th embodiment of the invention provides a simplex electrical connection socket and is almost the same as the 51st embodiment except for the difference that the pins 41 of the one row of first terminals 40 are bent to vertically and downwardly extend out of the insulated seat 30.

Referring to FIGS. 132 and 133, the 55th embodiment of the invention provides a simplex electrical connection socket and is almost the same as the 52nd embodiment except for the difference that the pins 41 of the one row of first terminals 40 are bent to vertically and downwardly extend out of the insulated seat 30.

Referring to FIGS. 134 and 135, the 56th embodiment of the invention provides a bidirectional duplex electrical connection socket and is almost the same as the 53rd embodiment except for the differences that the pins 41 of the two rows of first terminals 40 are bent to vertically and downwardly extend out of the insulated seat 30.

Referring to FIGS. 136 and 136A, the 57th embodiment of the invention provides a bidirectional simplex electrical connection socket and is almost the same as the 121st embodiment except for the differences that only one row of first terminals 40 are provided, the connection surface 336 of the connection plate 310 projects beyond the contacts 44 of the one row of first terminals 40 to form a contact interface, and the connection surface of the other connection plate 310 is not provided with the contact interface.

Referring to FIGS. 137 and 138, the 58th embodiment of the invention provides a bidirectional simplex electrical connection plug and is almost the same as the 57th embodiment except for the difference that the pins 41 of the one row of first terminals 40 are the same as the 116 embodiment.

Referring to FIGS. 139 and 140, the 59th embodiment of the invention provides a simplex USB 2.0 electrical connection socket comprising an insulated seat 30, one row of first terminals 40 and a metal housing 60.

The insulated seat 30 is provided with a base seat 303, a connection plate 310 and one row of first terminal slots 31. The connection plate 310 extends out of the upper front end of the base seat 303. The first terminal slot 31 extends to the connection plate 310 from the rear end of the base seat 303, is provided with a locking slot 318 in the base seat 303, and is provided with the elastic movement slot 319 in the connection plate 310, wherein the rear end of the insulated seat 30 is provided with a rear cover 343.

The metal housing 60 covers the insulated seat 30, the top and bottom surfaces of the base seat 303 rest against the metal housing 60, inside the metal housing 60 is formed with a fitting slot 77, the connection plate 310 is in the form of a tongue horizontally extending frontwards to the upper portion of the fitting slot 77, and the bottom surface of the connection plate 310 is the connection surface 336.

The one row of first terminals 40 has four terminals assembled with one row of first terminal slots 31 of the insulated seat 30. The first terminal 40 is provided with a pin 41, a fixing portion 42 and an extension 43. The fixing portion 42 is fixed to the locking slot 318. The extension 43 is connected to the front end of the fixing portion 42, is vertically elastically movable in the elastic movement slot 319 and is bent to provide a contact 44 projecting beyond the connection surface 336 of the connection plate 310. The one row of contacts 44 form the USB 2.0 contact interface. The pin 41 is connected to the rear end of the fixing portion 42 and vertically extends out of the rear end of the insulated seat 30.

The characteristics of this embodiment reside in that the insulated seat is provided with a resting portion 314, the resting portion 314 is in the form of multiple resting planes, and the resting portion 314 is disposed on two sides of each first terminal slot 31 of the connection plate 310, is depressed from the connection surface 336, is flush with the locking slot 318, and is higher than the bottom surface of the first terminal slot 31. The extension disposed on the inner end of each of the contacts 431 of the one row of first terminals 40 is provided with a fulcrum 431 resting against the resting portion 314, and the extension 43 disposed on an outer end of the fulcrum 431 does not rest against the resting portion 314, so that the elastically movable arm of force of the extension 43 has the middle section fulcrum structure. When the contact 44 is pressed to move elastically toward the connection surface 336, the extension 43 disposed on an inner end of the fulcrum 431 elastically moves reversely. The action of the fulcrum 431 makes the contact 44 have the larger normal force. However, because the extension 43 disposed on the inner end of the fulcrum 431 still can elastically move reversely, the good resilience can be achieved.

Referring to FIG. 140, the inner section of the fulcrum 431 of the extension 43 of the first terminal 40 is straight and is bent toward the resting portion 314 at a negative angle relative to the fixing portion 42. Referring to FIG. 139, when the first terminal 40 is assembled with the first terminal slot 31, the extension 43 disposed on the inner end of the fulcrum 431 of the first terminal 40 resiliently rests against the resting portion 314 in an overpressure manner.

Referring to FIG. 141, the 60th embodiment of the invention provides a simplex USB 3.0 electrical connection socket and is almost the same as the 59th embodiment except for the differences that the insulated seat 30 is further provided with one row of five second terminals 50, and the second terminal 50 is provided with an elastically non-movable contact 54 in front of the contact 44 of the first terminal 40. The contacts 44 of the one row of first terminals 40 and the contacts 54 of the one row of second terminals 50 form the USB 3.0 contact interface.

Referring to FIG. 142, the 61st embodiment of the invention provides a simplex USB 3.0 electrical connection socket and is almost the same as the 60th embodiment except for the difference that the front end 432 of the extension of the one row of first terminals 40 rests against the connection plate 310.

Referring to FIGS. 143 to 146, the 62nd embodiment of the invention provides a USB 2.0+eSATA shared socket and is almost the same as the 59th embodiment except for the differences that the insulated seat 30 is further provided with one row of seven second terminals 50, the second terminal 50 is provided with an elastically non-movable contact 54 in flat surface contact with the upper surface of the connection plate 310, the contacts 54 of the one row of second terminals 50 form a eSATA contact interface, the base seat 303 of the insulated seat 30 extends frontwards and is provided with two side portions 351, and the inside of the metal housing 60 and the two side portions 351 form a fitting slot 77 shared by the USB 2.0 plug and eSATA plug. In addition, the locking slots 318 of the one row of first terminal slots 31 are much more depressed from the connection surface 336 than the elastic movement slot 319. In addition, the insulated seat 30 is formed by an inner seat 352 and an outer seat 353, the inner seat 352 is disposed in the outer seat 353, the outer seat 353 is integrally provided with the two side portions 351, and the inner seat 352 is integrally provided with the connection plate 310 disposed in the fitting slot 77.

The characteristics of this embodiment reside in that the insulated seat 30 is provided with a resting portion 314, the resting portion 314 has multiple resting points, the resting portion 314 is disposed on the rear end of the bottom surface of each the first terminal slot 31 of the connection plate 310, and the extension 43 of the first terminal is straight and extends downwards at a bending angle relative to the fixing portion 42. So, the first terminal has a fulcrum 431 resting against the resting portion 314, and the extension 43 disposed on an outer end of the fulcrum 431 does not rest against the resting portion 314, so that the elastically movable arm of force of the extension 43 has the middle section fulcrum structure. When the contact 44 is pressed to move elastically toward the connection surface 336, the extension 43 disposed on an inner end of the fulcrum 431 elastically moves reversely. Referring to FIG. 283, the extension 4 and the fixing portion 42 of the first terminal 40 is bent toward the resting portion 314 at a negative angle. Referring to FIG. 281 when the first terminal 40 is assembled with the first terminal slot 31, the fulcrum 431 of the first terminal 40 resiliently rests against the resting portion 314 in an overpressure manner.

Referring to FIGS. 147 and 148, the 63rd embodiment of the invention provides a simplex USB 3.0 electrical connection plug comprising an insulated seat 30, one row of first terminals 40, one row of second terminals 50 and a metal housing 60.

The insulated seat 30 is provided with a base seat 303, a connection plate 310, one row of first terminal slots 31 and one row of second terminal slots 33. The connection plate 310 extends out of the front end of the base seat 303, the first and second terminal slots 31 and 33 extend to the connection plate 310 from the rear end of the base seat 303 and are provided with the locking slots 318 and 338 in the base seat 303, respectively, the second terminal slot 33 is provided with elastic movement slot 319 in the connection plate 310, and the locking slot 338 of the second terminal slot 33 is higher than the locking slot 318 of the first terminal slot 31.

The metal housing 60 covers the insulated seat 30, the top and bottom surfaces of the base seat 303 and one surface of the connection plate 310 rest against the metal housing 60, inside the metal housing 60 is formed with a fitting slot 77, the other surface of the connection plate 310 is provided with connection surface 336 facing the fitting slot 77, and the locking slot 318 of the first terminal slot 31 and the connection surface 336 of the connection plate 310 have the same high.

The one row of first terminals 40 has four terminals and are assembled with one row of first terminal slots 31 of the insulated seat 30 from rear to front. The first terminal 40 is provided with a pin 41, a fixing portion 42 and an extension 43. The fixing portion 42 is fixed to the locking slot 318. The extension 43 is connected to the front end of the fixing portion 42, extends frontwards to the connection plate 310 in a flush manner, and is provided with an elastically non-movable contact 44 in flat surface contact with the connection surface 336. The pin 41 is connected to the rear end of the fixing portion 42 and has a distal end horizontally extending out of the rear end of the insulated seat 30.

The extensions 43 of the first terminals of two sides of the one row of first terminals 40 are respectively biased outwards to be separated from the extensions 43 of the two first terminals at the middle by the larger distance. Thus, this is beneficial to the signal transmission.

The one row of second terminals 50 has five terminals assembled with the one row of second terminal slots 33 of the insulated seat 30 from front to rear. The second terminal 50 is provided with a pin 51, a fixing portion 52 and an extension 53. The fixing portion 52 is fixed to the locking slot 338. The extension 53 is connected to the front end of the fixing portion 52 and is vertically elastically movable in the elastic movement slot 319 and is bent to provide a contact 54 projecting beyond the connection surface 336 of the connection plate 310. The pin 51 is connected to the rear end of the fixing portion 52 and has a distal end horizontally extending out of the rear end of the insulated seat 30 and is flush with the pin 41 on the same row. The one row of contacts 54 and the one row of contacts 44 form a USB 3.0 contact interface.

The characteristics of this embodiment reside in that the insulated seat 30 is provided with a resting portion 314. The resting portion 314 has multiple resting points. The resting portion 314 is disposed on the bottom surface of each second terminal slot 33 of the base seat 303. The resting portion 314 is higher than the connection surface 336. The extension 53 of the second terminal is straight and extends downwards at a bending angle relative to the fixing portion 52. So, the second terminal 50 has a fulcrum 531 resting against the resting portion 314. The extension 43 disposed on an outer end of the fulcrum 531 does not rest against the resting portion 314, so that the elastically movable arm of force of the extension 53 has the middle section fulcrum structure. When the contact 44 is pressed to move elastically toward the connection surface 336, the extension 43 disposed on an inner end of the fulcrum 431 elastically moves reversely. Referring to FIG. 284, when not being assembled, the extension 53 and the fixing portion 52 of the first terminal 50 are bent toward the resting portion 314 at a negative angle. Referring to FIG. 148, when the second terminal 50 is assembled with second terminal slot 33, the fulcrum 531 of the second terminal 50 resiliently rests against the resting portion 314 in an overpressure manner.

In addition, the fixing heights of the fixing portions 52 of the one row of second terminals 50 and the locking slots 338 of the one row of second terminal slots are higher than the fixing heights of the fixing portions 42 of the one row of first terminals 40 and the locking slots 318 of the one row of first terminal slots. The extensions 53 of the one row of second terminals 50 are curved downwards and extend to be lower than the fixing portion 52. The bottom surfaces 339 of the rear sections of the one row of second terminal slots 33 are higher than the extensions 53 of the one row of second terminals 50. The overall width of the fixing portions 52 of the one row of second terminals is in flat surface contact with the bottom surfaces 339 of the rear sections of the one row of second terminal slots 33. From the rear end of the base seat 303, the one row of second terminal slots 33 do not provide the spaces for the horizontal penetrating slot of the extension 53 of the second terminal 50 communicating with the elastic movement slot 319. That is, the one row of second terminals 50 cannot be frontwardly and horizontally assembled into the one row of second terminal slots 33 from the rear end of the base seat 303. The one row of second terminals 50 of this embodiment are assembled into the one row of second terminal slots 33 from front to rear. Thus, the structure of the base seat 303 of the insulated seat 30 can be strengthened. Referring to FIG. 149, the 64th embodiment of the invention provides a simplex USB 3.0 electrical connection plug and is almost the same as the 63rd embodiment except for the difference that the extensions 43 of the first terminals of two sides of the one row of first terminals 40 are not outside.

Referring to FIG. 150, the 65th embodiment of the invention provides a simplex USB 3.0 electrical connection plug and is almost the same as the 63rd embodiment except for the differences that the extensions 43 of the one row of first terminals 40 are provided with vertical sections 433. Thus, the rear section of the extension 43 and the fixing portion 42 have the low positions and are further separated from the one row of second terminals 50. The contact 44 is lifted to the connection surface 336 by the extension 43.

Referring to FIG. 151, the 66th embodiment of the invention provides a duplex bidirectional USB 3.0 electrical connection plug and is almost the same as the 63rd embodiment except for the differences that the insulating seat 30 has the upper and lower seats 301 and 302 stacked vertically, that each of the upper and lower seats 301 and 302 is the same as the 63rd embodiment and has one row of first terminals 40 and one row of second terminals 50, that the contacts 44 of the one row of first terminals 40 and the contacts 54 of the one row of second terminals 50 are front and rear rows of contacts disposed on the connection surface 336, that the rear row of elastically movable contacts 54 is higher than the front row of contacts 44, and that the elastically movable arm of force of the extensions 53 of the one row of second terminals 50 has the middle section fulcrum structure the same as the 63rd embodiment. When the contact 54 is pressed to move elastically toward the connection surface 336, the extension 53 disposed on an inner end of the fulcrum 531 elastically moves reversely.

Referring to FIGS. 152 and 153, the 67th embodiment of the invention provides a simplex USB 3.0 electrical connection plug and is almost the same as the 63rd embodiment except for the differences that the rear section of the insulated seat 30 is exposed from the metal housing 60, the plate surfaces of the pins 41 and 51 of the one row of first and two terminals 40 and 50 are wider and are in flat surface contact with and exposed from the top and bottom surfaces of the rear section of the insulated seat 30. In addition, the pin 51 of one terminal in the middle of the one row of second terminals 50 is separated into three plate surfaces 51.

Referring to FIGS. 155 and 156, the 68th embodiment of the invention provides a simplex USB 3.0 electrical connection plug and is almost the same as the 63rd embodiment except for the differences that the insulated seat 30 is formed by the upper and lower seats 301 and 302 stacked vertically.

Referring to FIG. 157, the 69th embodiment of the invention is almost the same as the 68th embodiment except for the differences that the extensions 43 and the pins 41 of the first terminals of two sides of the one row of first terminals 40 are biased to the outside. Thus, it is more beneficial to the signal transmission.

Referring to FIG. 158, the 70th embodiment of the invention is almost the same as the 63rd embodiment except for the differences that the extensions 43 and the pins 41 of the first terminals of two sides of the one row of first terminals 40 are biased to the outside. Thus, it is more beneficial to the signal transmission.

Referring to FIGS. 159 and 160, the 71st embodiment of the invention provides a simplex USB 3.0 electrical connection plug and is almost the same as the 63rd embodiment except for the differences that the rear sections of the one row of second terminal slots 33 of the insulated seat 30 are provided with engagement blocks 337 to form the locking slots, and the engagement block 337 is provided with a guide-in inclined surface from top to bottom. So, the fixing portions 52 of the one row of second terminals 50 are guided, from top to bottom, into the locking slots of the rear sections of the one row of second terminal slots 33 and locked by the engagement block 337.

In addition, the plug of this embodiment is connected to the transmission cable, so the rear end of the insulated seat 30 is combined with the rear plug 70 of a plastic material. The pins 41 and 51 of the first and second terminals respectively pass through two rows of perforating holes 74 of the rear plug 70 and are in flat surface contact with the upper and lower rows of bonding slots 75, and the rear end of the metal housing 60 is engaged with a clamp member 66.

Referring to FIGS. 161 and 162, the 72nd embodiment of the invention is almost the same as the 71st embodiment except for the differences that the rear section of the one row of second terminal slots 33 of the insulated seat 30 have no locking slot, the fixing portions 52 of the one row of second terminals 50 are assembled, from top to bottom, with and in flat surface contact with the rear sections of the one row of second terminal slots 33, and then the rear sections of the one row of second terminal slots 33 are hot molten to form a combination portion 340 for fixing the fixing portions 52 of the one row of second terminals 50.

Referring to FIGS. 163 and 162, the 73rd embodiment of the invention is almost the same as the 44th embodiment except for the differences that the insulated seat 30 is formed by an upper seat 301 and a lower seat 302 stacked vertically. Each of the upper and lower seats 301 and 302 is provided with one row of terminal slots 35 assembled with one row of first terminals 40. Each of the upper and lower seats 301 and 302 is provided with a connection plate 310 and a half body of the base seat 303. The upper seat 301 is assembled with one row of seven first terminals 40 (A1, A4, A5, A6, A7, A9, A12). The lower seat 302 is assembled with one row of four first terminals 40 (B1, B4, B9, B12). Each of the two rows of first terminals 40 are formed by pressing a metal sheet. The two side terminals A1, A12, B1, B12 of the two rows of first terminals 40 are ground terminals. The front ends of the extensions 43 of the four ground terminals are integrally connected to a grounding elastic sheet 650. The grounding elastic sheet 650 is provided with an extension 653. The extension 653 is vertically elastically movable in an opening hole 3210 of the connection plate 310. Each of the extensions 653 of the four grounding elastic sheets 650 is provided with a fulcrum 656 and a contact 654. The fulcrums 656 project beyond the two connection plates 310, respectively, to rest against the metal housing 60. The contacts 654 project beyond the connection surfaces 336 of the two connection plates 310, respectively. The extension of the grounding elastic sheet 653 has an inverse-U shape.

In addition, each of the ground terminals A1 and A12 is integrally connected to a resilient snap 660.

While the present invention has been described by way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

What is claimed is:

1. An electrical connector, comprising:

an insulated seat provided with a base seat and at least one connection plate, which projects beyond a front end of the base seat;

a metal housing covering the insulated seat, wherein top and bottom surfaces of the base seat and one surface of the at least one connection plate rest against the metal housing, a fitting slot is formed within the metal housing, the other surface of the connection plate is a connection surface, the connection plate is provided with an elastic movement slot depressed from the connection surface, and the connection surface faces the fitting slot; and at least one row of terminals, wherein the terminal is provided with a pin, a fixing portion and an extension, the fixing portion is fixed to the insulated seat, the extension is connected to a front end of the fixing portion, vertically elastically movable in the elastic movement slot and provided with a contact projecting beyond the connection surface of the connection plate, and the pin is connected to a rear end of the fixing portion and extends out of the insulated seat;

characterized in that the insulated seat is provided with a resting portion, the extension disposed on an inner end of each of the contacts of the at least one row of terminals is provided with a fulcrum resting against the resting portion, the extension disposed on an outer end of the fulcrum does not rest against the resting portion, so that an elastically movable arm of force of the extension has a middle section fulcrum structure, when the contact is pressed to move toward the connection surface elastically, the extension reversely disposed on an inner end of the fulcrum moves elastically, and an action of the fulcrum makes the contact have a larger normal force.

2. The electrical connector according to claim 1, characterized in that there are two of the connection plates of the insulated seat, the fitting slot is disposed between the two connection plates, the resting portion is disposed on the connection plate, the two connection plates have the same height, and the metal housing and the fitting slot can dock with a docking electrical connector in a dual-position bidirectional manner.

3. The electrical connector according to claim 2, characterized in that there are at least two rows of the terminals, the connection surface of each of the connection plates projects beyond the contact of each of the at least one row of terminals to form a contact interface.

4. The electrical connector according to claim 3, characterized in that the electric connector satisfies one of (a) to (g) or a combination of more than one of (a) to (g):

(a) wherein the two contact interfaces have the same contact interface;

(b) wherein the two contact interfaces have connection points with circuit serial numbers arranged reversely;

(c) wherein at least two grounding elastic sheets are further provided, each of the at least two grounding elastic sheets is provided with a fixing portion and an extension, the fixing portion of the ground elastic sheet is fixed to the insulated seat, the extension of the grounding elastic sheet is vertically elastically movable and provided with a fulcrum resting against the metal housing, the extension of the grounding elastic sheet does not rest against the metal housing in front of the fulcrum of the ground elastic sheet and is provided with a projecting contact projecting toward the fitting slot, when the contact of the grounding elastic sheet is pressed to move elastically toward the metal housing, an action of the fulcrum of the grounding elastic sheet makes the contact of the grounding elastic sheet have a larger normal force, the extension of the grounding elastic sheet disposed on an inner end of the fulcrum of the grounding elastic sheet elastically moves reversely, and the contacts of the at least two grounding elastic sheets respectively project beyond the connection surfaces of the two connection plates to the fitting slot;

(d) wherein the base seat of the insulated seat is formed by stacking upper and lower base seats together, and the two rows of terminals are respectively embedded into and injected molded with or assembled with the upper and lower base seats;

(e) wherein a metal partition plate partitioning the two rows of terminals is provided at a middle of the base seat of the insulated seat;

(f) wherein the two connection plates integrally form a fitting member, the two rows of terminals are embedded into and injection molded with the base seat, the extensions of the two rows of terminals extend out of and are disposed in front of the base seat, and the fitting member is fitted with a front of the base seat and covers the extensions of the two rows of terminals; and (g) wherein the two connection plates integrally form a fitting member, the base seat is composed of upper and lower seats, the two rows of terminals are embedded into and injection molded with the upper and lower seats, respectively, the extensions of the two rows of terminals extend out of and are disposed in front of the base seat, and the fitting member is fitted with a front of the base seat and covers the extensions of the two rows of terminals.

5. The electrical connector according to claim 1, characterized in that the electric connector satisfies one of (a) to (i) or a combination of more than one of (a) to (i):

(a) wherein the extension of the terminal resiliently rests against the resting portion in an overpressure manner;

(b) wherein the insulated seat is a one-piece member or a two-piece combination;

(c) wherein the at least one row of terminals are embedded into and injected molded with or assembled with the insulated seat;

(d) wherein the resting portion is disposed on the connection plate;

(e) wherein the resting portion is disposed on the base seat;

(f) wherein the electrical connector is an electrical connector plug;

(g) wherein the electrical connector is an electrical connector socket;

(h) wherein the insulating seat has terminal slots open in a vertical direction, and the at least one row of terminals are placed into the terminal slots in the vertical direction; and (i) wherein a bottom surface of the elastic movement slot having an insulating layer structure is separated from the metal housing.

6. An electrical connector, comprising:

an insulated seat provided with a connection portion, wherein the connection portion is provided with at least one connection surface and an elastic movement slot depressed from the connection surface; and at least two rows of terminals, wherein the terminal is provided with a pin, a fixing portion and an extension, the fixing portion is fixed to the insulated seat, the extension is connected to one end of the fixing portion and provided with a contact disposed on the connection surface of the connection portion, and the pin is connected to the other end of the fixing portion and extends out of the insulated seat;

characterized in that the insulated seat comprises at least two seats assembled together, each of the at least two seats fixes the at least one row of terminals, and the insulated seat is provided with a resting portion, wherein the extensions of the at least one row of terminals of the at least one seat are vertically elastically movable in the elastic movement slot the extension disposed on an inner end of the contact is provided with a fulcrum resting against the resting portion, the extension disposed on an outer end of the fulcrum does not rest against the resting portion, so that an elastically movable arm of force of the extension has a middle section fulcrum structure, and when the contact is pressed to move toward the connection surface elastically, the extension disposed on an inner end of the fulcrum elastically moves reversely to make the contact have a larger normal force through an action of the fulcrum.

7. The electrical connector according to claim 6, characterized in that a metal housing covering the insulated seat is further provided, a fitting slot is formed within the metal housing, the insulated seat is further provided with a base seat, at least one connection plate of the connection portion projects beyond a front end of the base seat, and one surface of the at least one connection plate is the connection surface disposed in the fitting slot.

8. The electrical connector according to claim 7, characterized in that the electric connector satisfies one of (a) to (f) or a combination of more than one of (a) to (f):

(a) wherein there are two of the connection plates, the fitting slot is disposed between the two connection plates, each of the two connection plates has one surface resting against the metal housing and the other surface being the connection surface facing the fitting slot, the resting portion is disposed on the connection plate, the two connection plates have the same height, and the metal housing and the fitting slot can dock with an electrical connector in a dual-position bidirectional manner;

(b) wherein the at least two rows of terminals are respectively embedded into and injected molded with or assembled with the insulated seat;

(c) wherein the resting portion is disposed on the connection plate;

(d) wherein the resting portion is disposed on the base seat;

(e) wherein the electrical connector is an electrical connector plug; and (f) wherein the electrical connector is an electrical connector socket.

9. The electrical connector according to claim 7, characterized in that the at least one connection plate is in the form of a tongue disposed in the fitting slot, two opposite surfaces of the connection plate are two connection surfaces, and the contacts of the at least two rows of terminals are disposed on the connection surfaces of the connection portion, respectively.

10. The electrical connector according to claim 9, characterized in that the electric connector satisfies one of (a) to (b) or a combination of more than one of (a) to (b):

(a) wherein the at least two seats are an inner seat and an outer seat, the inner seat is disposed inside the outer seat, the outer seat integrally provided with two side portions, an inside of the metal housing and the two side portions form a fitting slot, and the inner seat integrally provided with the connection plate disposed in the fitting slot; and (b) wherein the fitting slot is a shared slot shared by a USB 2.0 plug and an eSATA plug.

11. An electrical connector, comprising:

an insulated seat provided with a base seat and a connection plate, wherein the connection plate projects beyond a front end of the base seat, a top surface of the connection plate is a connection surface, the connection surface is lower than a top surface of the base seat, the insulated seat is provided with one row of first terminal slots and one row of second terminal slots, and the second terminal slot is provided, on the connection plate, with an elastic movement slot depressed from the connection surface;

a metal housing covering the insulated seat, wherein top and bottom surfaces of the base seat and a bottom surface of the connection plate rest against the metal housing, a fitting slot is formed within the metal housing, and the connection surface of the connection plate faces the fitting slot;

one row of first terminals assembled in the first terminal slot, wherein the first terminal is provided with a pin, a fixing portion and an extension, the fixing portion is fixed to the first terminal slot, the extension is connected to a front end of the fixing portion and provided with a contact disposed on the connection surface of the connection plate, and the pin is connected to a rear end of the fixing portion and extends out of the insulated seat; and one row of second terminals assembled in the second terminal slot, wherein the second terminal is provided with a pin, a fixing portion and an extension, the fixing portion is fixed to the second terminal slot, the extension is connected to a front end of the fixing portion, vertically elastically movable in the elastic movement slot and provided with a contact projecting beyond the connection surface of the connection plate, and the pin is connected to a rear end of the fixing portion and extends out of the insulated seat;

characterized in that fixing heights of the fixing portions of the one row of second terminals in the one row of second terminal slots are higher than fixing heights of the fixing portions of the one row of first terminals in the one row of first terminal slots, the extensions of the one row of second terminals are curved downwards and extend to be lower than the fixing portions, and the one row of second terminal slots do not have, from a rear end of the base seat, a horizontal penetrating slot providing spaces for the extensions of the second terminals and communicating with the elastic movement slot, so that the one row of second terminals cannot be horizontally and frontwardly assembled into the one row of second terminal slots from the rear end of the base seat.

12. The electrical connector according to claim 11, characterized in that bottom surfaces of rear sections of the one row of second terminal slots are higher than the extensions of the one row of second terminals, and the fixing portions of the one row of second terminals are in flat surface contact with the bottom surfaces of the rear sections of the one row of second terminal slots.

13. The electrical connector according to claim 11, characterized in that the electric connector satisfies one of (a) to (g) or a combination of more than one of (a) to (g):

(a) wherein the contacts of the one row of first terminals are in flat surface contact with the connection plate and are not vertically elastically movable, and the contacts of the one row of first terminals are disposed on front ends of the contacts of the one row of second terminals;

(b) wherein the contacts of the one row of first terminals are in flat surface contact with the connection plate and are not vertically elastically movable, and the contacts of the one row of first terminals are disposed on front ends of the contacts of the one row of second terminals; the contacts of the one row of first terminals and the contacts of the one row of second terminals form a USB 3.0 contact interface;

(c) wherein the one row of second terminals are assembled, from front to rear, into the one row of second terminal slots;

(d) wherein the insulated seat is integrally formed; or a two-piece combination of upper and lower seats, wherein the upper seat is assembled with the one row of second terminals, and the lower seat is assembled with the one row of first terminals;

(e) wherein the electrical connector is an electrical connector plug;

(f) wherein the one row of second terminals are assembled, from top to bottom, into the one row of second terminal slots;

(g) wherein the one row of second terminals are assembled into the one row of second terminal slots, and then rear sections of one row of second terminal slots are hot molten to form a combination portion fixed to the fixing portions of the one row of second terminals.

14. The electrical connector according to claim 11, characterized in that the insulated seat is provided with a resting portion, the extension disposed on an inner end of each of the contacts of the one row of second terminals is provided with a fulcrum resting against the resting portion, the extension disposed on an outer end of the fulcrum does not rest against the resting portion, so that an elastically movable arm of force of the extension has a middle section fulcrum structure, and when the contact is pressed to move toward the connection surface elastically, the extension disposed on an inner end of the fulcrum elastically moves reversely to make the contact have a larger normal force through an action of the fulcrum.

15. The electrical connector according to claim 14, characterized in that the electric connector satisfies one of (a) to (b) or a combination of more than one of (a) to (b):

(a) wherein the extension of the second terminal resiliently rests against the resting portion in an overpressure manner; and (b) wherein the resting portion is disposed on the base seat.

16. An electrical connector, comprising:

an insulated seat provided with a base seat and two connection plates, wherein a vertical gap is formed between the two connection plates projecting beyond a front end of the base seat;

a metal housing covering the insulated seat, wherein top and bottom surfaces of the base seat and first surfaces of the two connection plates rest against the metal housing, second surfaces of the two connection plates are connection surfaces, the two connection plates are provided with two elastic movement slots depressed from the connection surfaces, a fitting slot is formed between the two connection surfaces, and the metal housing and the fitting slot can dock with an electrical connector in a dual-position bidirectional manner;

two rows of terminals, wherein the terminal is provided with a pin, a fixing portion and an extension, the fixing portion is fixed to the insulated seat, the extension connected to the front end of the fixing portion is vertically elastically movable in the elastic movement slot and provided with a contact projecting beyond the connection surface of the connection plate, the pin is connected to a rear end of the fixing portion and extends out of the insulated seat, and the contacts of the two rows of terminals projects beyond the connection surfaces of the two connection plates, respectively; and at least two grounding elastic sheets, wherein the grounding elastic sheet is provided with an extension, the extension is vertically elastically movable in an opening hole of the connection plate, the extensions of the at least two grounding elastic sheets rest against the metal housing and are provided with two contacts projecting beyond the connection surfaces of the two connection plates, respectively;

characterized in that the at least two grounding elastic sheets and the two rows of terminals are made by pressing two metal sheets, respectively.

17. The electrical connector according to claim 16, characterized in that the electric connector satisfies one of (a) to (e) or a combination of more than one of (a) to (e):

(a) wherein the grounding elastic sheet is provided with a fixing portion fixed to the insulated seat, the fixing portion of the at least one grounding elastic sheet and the fixing portions of the one row of terminals are at the same height;

(b) wherein there are four of the grounding elastic sheets, wherein two of the grounding elastic sheets and the one row of terminals are formed by pressing the same metal sheet;

(c) wherein each of the extensions of the at least two grounding elastic sheets has a fulcrum projecting beyond the two connection plates and resting against the metal housing, the extension of the grounding elastic sheet does not rest against the metal housing in front of the fulcrum of the grounding elastic sheet and is provided with a projecting contact projecting toward the fitting slot, when the contact of the grounding elastic sheet is pressed to move elastically toward the metal housing to make the contact of the grounding elastic sheet have a larger normal force through an action of the fulcrum of the grounding elastic sheet, the extension of the grounding elastic sheet disposed on an inner end of the fulcrum of the grounding elastic sheet elastically moves reversely, and the contacts of the at least two grounding elastic sheets projects beyond the connection surfaces of the two connection plates, respectively, to the fitting slot;

(d) wherein the two connection plates integrally form a fitting member, the two rows of terminals are embedded into and injection molded with the base seat, the extensions of the two rows of terminals extend out of and are disposed in front of the base seat, and the fitting member is fitted with a front of the base seat and covers the extensions of the two rows of terminals; and (e) wherein the two connection plates integrally form a fitting member, the base seat is composed of upper and lower seats, the two rows of terminals are embedded into and injection molded with the upper and lower seats, respectively, the extensions of the two rows of terminals extend out of and are disposed in front of the base seat, and the fitting member is fitted with a front of the base seat and covers the extensions of the two rows of terminals.

18. The electrical connector according to claim 16, characterized in that the grounding elastic sheet is integrally connected to a front end of the extension of a ground terminal of one of the one row of terminals.

19. The electrical connector according to claim 18, characterized in that the electric connector satisfies one of (a) to (c) or a combination of more than one of (a) to (c):

(a) wherein two side terminals of the one row of terminals are two ground terminals, and each of the two ground terminal is integrally connected to the grounding elastic sheet;

(b) wherein the grounding elastic sheet is integrally connected to the front end of the extension of the ground terminal; and (c) wherein the grounding elastic sheet is integrally connected to the front end of the extension of the ground terminal, and the extension of the grounding elastic sheet has an inverse-U shape.

20. The electrical connector according to claim 6, characterized in that the electric connector satisfies one of (a) to (c) or a combination of more than one of (a) to (c):

(a) wherein the extension of the terminal resiliently rests against the resting portion in an overpressure manner;

(b) wherein the insulating seat has terminal slots open in a vertical direction, and the at least one row of terminals are placed into the terminal slots in the vertical direction; and (c) wherein a bottom surface of the elastic movement slot having an insulating layer structure is separated from the metal housing.

* * * * *